US005391466A

United States Patent [19]

Ueda et al.

[11] Patent Number: 5,391,466

[45] Date of Patent: Feb. 21, 1995

[54] CHEMICAL COMPOSITIONS AND A PROCESSING METHOD USING THE SAME FOR PROCESSING SILVER HALIDE PHOTOGRAPHIC LIGHT-SENSITIVE MATERIAL

[75] Inventors: Yutaka Ueda; Kenji Kuwae, both of Hino, Japan

[73] Assignee: Konica Corporation, Tokyo, Japan

[21] Appl. No.: 156,804

[22] Filed: Nov. 22, 1993

[30] Foreign Application Priority Data

Nov. 25, 1992 [JP] Japan ..... 4-315266

[51] Int. Cl.[6] ..... G03C 7/00; G03C 5/18; G03C 5/44; G03C 5/38

[52] U.S. Cl. ..... 430/393; 430/418; 430/429; 430/430; 430/460; 430/461

[58] Field of Search ..... 430/393, 418, 428, 429, 430/430, 455, 460, 461, 488, 490, 491

[56] References Cited

U.S. PATENT DOCUMENTS

| | | | |
|---|---|---|---|
| 2,168,181 | 8/1939 | Ulrich et al. | 430/491 |
| 3,201,246 | 8/1965 | Allen et al. | 96/61 |
| 3,260,718 | 7/1966 | Johnson | 260/247.1 |
| 3,335,161 | 8/1967 | Fields et al. | 260/455 |
| 4,268,618 | 5/1981 | Hashimura et al. | 430/393 |
| 4,897,339 | 1/1990 | Andoh et al. | 430/490 |
| 5,004,670 | 4/1991 | Okutsu et al. | 430/490 |
| 5,149,618 | 9/1992 | Tappe et al. | 430/393 |
| 5,223,379 | 6/1993 | Okada et al. | 430/393 |
| 5,238,791 | 8/1993 | Tappe et al. | 430/393 |

FOREIGN PATENT DOCUMENTS

| | | | |
|---|---|---|---|
| 3939756 | 6/1991 | Germany . | |
| 53-28426 | 3/1978 | Japan . | |
| 0037016 | 4/1978 | Japan | 430/461 |
| 53-95630 | 8/1978 | Japan . | |
| 59-149358 | 8/1984 | Japan . | |
| 59-151154 | 8/1984 | Japan . | |
| 0187341 | 10/1984 | Japan | 430/430 |
| 62-123459 | 6/1987 | Japan . | |
| 0250450 | 10/1987 | Japan | 430/430 |
| 63-17445 | 1/1988 | Japan . | |
| 63-63043 | 3/1988 | Japan . | |
| 1116545 | 5/1989 | Japan | 430/461 |
| 1-295258 | 11/1989 | Japan . | |

OTHER PUBLICATIONS

U.S. Statutory Invention Registration 11953, Goto et al., Aug. 1991.

*Primary Examiner*—Charles L. Bowers, Jr.
*Assistant Examiner*—J. Pasterczyk
*Attorney, Agent, or Firm*—Frishauf, Holtz, Goodman & Woodward

[57] ABSTRACT

A method and chemical composition for bleaching or bleach fixing exposed and developed silver halide photographic light-sensitive material using a ferric complex salt of a compound represented by the following Formula I, II, III, IV, V, VI or VII:

(I)

(II)

$(R_1)(R_2)N—X_1—(Z—X_2)_n—N(R_3)(R_4)$ (III)

$(R_1)HN—X_1—(Z—X_2)_n—NH(R_2)$ (IV)

(Abstract continued on next page.)

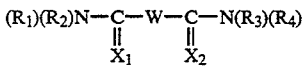
(V)
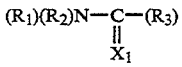
(VI)
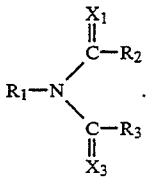
(VII)
13 Claims, No Drawings

CHEMICAL COMPOSITIONS AND A PROCESSING METHOD USING THE SAME FOR PROCESSING SILVER HALIDE PHOTOGRAPHIC LIGHT-SENSITIVE MATERIAL

FIELD OF THE INVENTION

The present invention relates to improvement of a photographic processing solution for processing an exposed silver halide photographic light-sensitive material, and more particularly to a silver halide photographic light-sensitive material processing chemical composition which contains a novel chelating agent for blocking metallic ions or for use as a bleaching agent and also to a method for processing a light-sensitive material, using the same composition.

BACKGROUND OF THE INVENTION

Generally speaking, in order to obtain an image from an exposed silver halide photographic light-sensitive material, the light-sensitive material must be processed in a developer solution, a fixing solution, and some other solutions. Particularly, the formation of a color image needs still more processing steps. The processing solutions used in these processing steps contain various kinds of constituents, so that if water that is used for preparation of them contains metallic ions such as of calcium, magnesium, iron, the constituents react with these ions to form a precipitate or sludge, which causes clogging of the filter provided to an autoprocessor or attaches to and stain the surface of the photographic light-sensitive material being processed. Even if pure water is used in preparation of the above processing solutions in order to prevent such trouble, since the metallic ion contained in the photographic light-sensitive material is eluted in or the one from the preceding processing bath is carried in the bath during the course of its processing, it is very difficult to completely prevent the formation of a precipitate or sludge. Further, some of the constituents of such processing solutions have their oxidation or decomposition accelerated by the action of metallic ions to thereby lose effect, so if processed in such a processing solution, the light-sensitive material becomes fogged or desensitized.

To prevent such undesirable actions of metallic ions to the processing solution, the addition of a chelating agent for blocking metallic ions to the photographic processing chemical composition is proposed and now in practice used. Examples of the chelating agents include the polyphosphates such as sodium hexamethaphosphate proposed by British Patent No.520,593; the alkylidenediphosphonic acid proposed by U.S. Pat. No. 321,445; the aminopolycarboxylic acids such as aminopolymethylenephosphonic acid and ethylenediaminetetraacetic acid proposed by U.S. Pat. No. 3,201,246. However, it is the fact that even if such chelating agents are used, there still occur various shortcomings in practice, bringing about unsatisfactory results; i.e., the polyphosphate is unacceptable for practical use because of being poor in metallic ion-blocking power, particularly weak in the power against heavy-metallic ions.

The alkylidenediphosphonic acid has the disadvantage that it, when present together with both calcium and sodium ions in a certain concentration or more, forms a solid precipitate to cause a trouble in the autoprocessor. The ordinary aminopolycarboxylic acid such as ethylenediaminetetraacetic acid or the aminopolymethylenephosphonic acid such as aminotrimethylenephosphonic acid has an excellently large metallic ion blocking power, but it, when present together with metallic ions in a color developer solution containing hydroxylamine, decomposes the hydroxylamine, and the light-sensitive material, when processed in such the color developer solution, produces fog, while in a black-and-white developer solution it accelerates the oxidation of the developing agent to thereby degrade the solution's storage stability, causing a high-speed film to get fogged badly.

As has been mentioned, any one of the conventionally proposed chelating agents has some shortcomings and provides no satisfactory effect when used in photographic processing chemical compositions. Further, the replenishing amount to photographic processing solutions is compelled to be made smaller and smaller in order to live up to the social environmental demand for decreasing pollution or the economical demand for cost reduction, so that the accumulation of metallic ions such as of calcium eluted from the photographic light-sensitive material has a tendency toward increasing.

Raw materials for use in producing photographic materials also tend to be replaced by lower grade, inexpensive ones for the purpose of cost reduction; the amount of metallic ions accumulated in photographic processing solutions keeps on increasing.

Thus, the above trend has lately been coming out of control with conventional techniques.

Incidentally, in the processing of a silver halide color photographic light-sensitive material, the aforementioned aminopolycarboxylic acids as the chelating agent are widely used in large quantities in the form of metallic complex salts of the foregoing metals as bleaching agents for removing silver image in a bleaching bath and a bleach-fix bath. Examples of the metallic complex salt of the above aminopolycarboxylic acid include ferric ethylenediaminetetraacetate, ferric 1,3-propylenediaminetetraacetate and ferric diethylenetriaminepentaacetate.

Out of these bleaching agents, ferric 1,3-propylenediaminetetraacetate has a very high oxidation power, and therefore applies to a bleaching bath especially for use in the rapid processing of a high-speed silver halide color photographic light-sensitive material. However, the ferric 1,3-propylenediaminetetraacetate, because of its high oxidation power, has the disadvantage that it oxidizes the color developing agent that is carried in from the prebath in the developing process to react with the unreacted coupler contained in the light-sensitive material to thereby form a dye; i.e., it causes a so-called bleaching fog.

Ferric ethylenediaminetetraacetate is inferior in the oxidation power to ferric 1,3-propylenediaminetetraacetate, but is often used as a bleaching agent for the bleach-fix process, where both bleaching and fixing are made in a single bath for simplification and speedup of the processing process. In the bleach-fix bath, since the bleaching agent as an oxidation agent and the fixing agent, such as thiosulfate ion, as a reducing agent are present together, there occurs a phenomenon where the bleaching agent oxidizes the thiosulfate ion to thereby decompose the fixing agent into sulfur, so that a sulfite ion as a preservative is usually added to the bleach-fix bath in order to prevent the thiosulfate ion from being decomposed. However, where ferric ethylenediaminetetraacetate is used in the bleach-fix bath, the ferric complex salt's oxidation rate shifting from divalent iron to trivalent iron is so high that it always keeps its trivalent iron condition in the bleach-fix bath to keep on decomposing the sulfite ion as a preservative, resulting in the acceleration of sulfurization of the thiosulfate ion, leading to lowering of the storage stability of the bleach-fix solution.

As means to solve the above problem, JP O.P.I. (Open to Public Inspection, the same shall apply hereinafter) Nos. 149358/1984, 151154/1984 and 166977/1984 disclose techniques using ferric diethylenetriaminepentaacetate.

These techniques are certainly excellent in the solution's storage stability as compared to the bleach-fix bath that uses ferric ethylenediaminetetraacetate. However, where ferric diethylenetriaminepentaacetate is used to make color paper processing, there occurs a problem that it is liable to cause a trouble called 'edge penetration' where processed color paper edges appear to be stained.

Further, the use of materials having a good spontaneous decomposability has lately been called for from the global environment protection point of view. The aforementioned ferric ethylenediaminetetraacetate and ferric diethylenetriaminepentaacetate are known to be very inferior in the spontaneous decomposability, so that the use of them is undesirable. In Germany, because the EDTA concentration in drinking water has been increasing in recent years, there is a self-imposed control move to reduce the present EDTA to half within five years.

In order to solve this problem, German Pat. DE 9,939,755 and DE 3,939,756 disclose techniques using nitrilomonopropionic acid diacetic acid (NMPDA), nitrilodipropionic acid monoacetic acid (NDPMA), and ordinary nitrilotriacetic acid (NTA) as a well spontaneously decomposable chelating agent. However, the fact that the above NMPDA and NDPMA are little decomposed is confirmed according to the decomposition proneness testing specified as a decomposability evaluation method—'amended MITI method' by the Ministry of International Trade and Industry (being recognized well-decomposable according to this method implies being decomposed fast in the natural world), so that they do not provide any radical solution to the problem.

The fact that the use of the foregoing NMPDA and NDPMA causes aforementioned bleaching fog trouble is also confirmed.

On the other hand, the NTA shows a good spontaneous decomposability in the MITI method, but its oxidation power when in the ferric complex salt form is not adequate, and therefore it is not suitable for practical use.

Accordingly, there is a strong demand for a bleaching solution having rapid desilvering characteristics without causing bleaching stain and a bleach-fix solution having excellent storage stability, causing no edge stain and having excellent decomposability.

SUMMARY OF THE INVENTION

It is an object of the invention to provide a silver halide photographic light-sensitive material processing chemical composition having a rapid bleaching characteristics, causing no edge stain and having an excellent storage stability in solution, and also to provide a processing method which uses the same.

It is another object of the invention to provide a silver halide photographic light-sensitive material processing chemical composition which enables the obtaining of a stable processing solution, giving rise to no precipitate or sludge due to the presence of metallic ions, and also to provide a processing method which uses the same.

It is still another object of the invention to provide a silver halide photographic light-sensitive material processing chemical composition which, when used in an autoprocessor processing, enables stable processing over an extensive period of time without causing any clogging of the filter attached thereto, and a processing method which uses the same.

It is a further object of the invention to provide a silver halide photographic light-sensitive material processing chemical composition which has an excellent spontaneous decomposability and is suitable for global environment protection, and also to provide a processing method which uses the same.

Still further objects of the invention will become apparent from the following descriptions of the invention.

The above objects of the invention are accomplished by the following photographic processing chemical compositions and the following processing method.

1. A silver halide photographic light-sensitive material processing composition comprising at least one of compounds represented by the following Formula I, II, III, IV, V, VI or VII:

Formula I

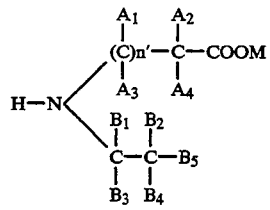

wherein n' is an integer of 1 to 3; $A_1$ to $A_4$ and $B_1$ to $B_5$ each represent H, OH, $C_nH_{2n+1}$ or $(CH_2)_mX$; n and m represent integers of 1 to 3 and 0 to 3, respectively; X represents —COOM (wherein M is H, a cation or an alkali metallic atom), —$NH_2$ or —OH; provided that all of $B_1$ to $B_5$ can not be H at the same time.

Formula II

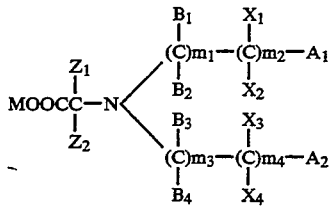

wherein $B_1$ to $B_4$ and $X_1$ to $X_4$ each represent H, $C_nH_{2n+1}$ or $(CH_2)lY$; n and l are integers of 1 to 3 and 0 to 3, respectively, wherein Y is —COOM (M is H, a cation or an alkali metallic atom), —$NH_2$ or —OH; provided that all of $B_1$ to $B_4$ and $X_1$ and $X_2$ do not represent H at the same time, and any number, except 2, of $X_1$ to $X_4$ may represent OH at the same time; $m_1$ to $m_4$ each represent an integer of 1 to 3; $A_1$ and $A_2$ each represent —$COOM_1$, —$COOM_2$ ($M_1$ and $M_2$ each represent H, a cation or an alkali metallic atom), —$NH_2$ or OH; and $Z_1$ and $Z_2$ each represent —COOM (M is H, a cation or an alkali metallic atom), an alkyl group having 1 to 3 carbon atoms, or OH.

Formula III $$(R_1)(R_2)N—X_1—(Z—X_2)_n—N(R_3)(R_4)$$

wherein $R_1$ to $R_3$ each represent $—L_1—Y_1$, wherein $L_1$ is a substituted or unsubstituted alkylene group and $Y_1$ is —OH, $—NH_2$ or —COOM (M is a hydrogen ion, an alkali metallic ion or other cation); $R_4$ represents H, $—CH_3$ or $—C_2H_5$; n is an integer of 0 to 4; Z represents an alkylene group, —O—, —NH—, $—N(L_2—Y_2)—$ or $—CH(L_3—Y_3)—$, wherein $L_2$ and $L_3$ each represent a substituted or unsubstituted alkylene group having 1 to 4 carbon atoms, and $Y_2$ and $Y_3$ each represent a hydrogen atom, —OH, $—NH_2$, $—COOM_1$ or $—COOM_2$ ($M_1$ and $M_2$ each represent a hydrogen ion, an alkali metallic ion or other cation); $X_1$ and $X_2$ each represent a substituted or unsubstituted alkylene group having 1 to 6 carbon atoms or $—CH(L_4—Y_4)—$, wherein $L_4$ is a substituted or unsubstituted alkylene group having 1 to 4 carbon atoms, and $Y_4$ is a hydrogen atom, —OH, $—NH_2$, $—COOM_1$ or $—COOM_2$ ($M_1$ and $M_2$ each represent a hydrogen ion, an alkali metallic ion or other cation); provided that when n is 0, $X_1$ is a substituted or unsubstituted alkylene group having 2 to 6 carbon atoms.

Formula IV $$(R_1)HN—X_1—(Z—X_2)n—NH(R_2)$$

wherein $R_1$, $R_2$, $X_1$, $X_2$, Z and n are as defined in Formula III, provided that when n=0, $X_1$ is a substituted or unsubstituted alkylene group having 3 to 6 carbon atoms.

Formula V $$(R_1)(R_2)N—(C{=}X_1)—W—(C{=}X_2)—N(R_3)(R_4)$$

wherein $R_1$ to $R_4$ each represent a hydrogen atom or $—(CH_2)m_3—CH[(CH_2)m_2—Z_2]—(CH_2)m_1—Z_1$, wherein $Z_1$ and $Z_2$ each represent a hydrogen atom, —COOM (M is a hydrogen ion, an alkali metallic ion or other cation), —OH or $—NH_2$; $m_1$ to $m_3$ each represent an integer of 0 to 2; provided that all of $R_1$ to $R_4$ are not always hydrogen atoms; W represents a substituted or unsubstituted alkylene group having 0 to 5 carbon atoms, $—(D_1O)m_4—D_2$ or $—O—(D_3)m_5—O—$, wherein $D_1$ to $D_3$ each represent a methylene chain having 1 to 3 carbon atoms; $m_4$ and $m_5$ each represent an integer of 1 to 3; and $X_1$ and $X_2$ each represent an oxygen atom or a sulfur atom.

Formula VI $$(R_1)(R_2)N—(C{=}X_1)—(R_3)$$

wherein $R_1$ to $R_3$ and $X_1$ are as defined in Formula V, provided all of $R_1$ to $R_3$ are not always hydrogen atoms.

Formula VII $$(R_1)N—[(C{=}X_1)—R_2]—[(C{=}X_2)—R_3]$$

wherein $R_1$ to $R_3$, $X_1$ and $X_2$ are as defined in Formula V, provided all of $R_1$ to $R_3$ are not always hydrogen atoms.

The above silver halide photographic light-sensitive material processing chemical composition includes a developer, a bleaching solution, a bleach-fixing solution, a fixing solution and a stabilizing solution. In the bleaching solution and the bleach-fixing solution, the compound represented by Formula I, II, III, IV, V, VI or VII is contained in the form of a ferric complex salt.

A preferable embodiment of the processing method using the above processing composition of the invention comprises the steps of (1) developing a silver halide color photographic material with a color developer, (2) bleaching and fixing with a bleaching solution and a fixing solution, or a bleach-fixing solution, wherein the bleaching solution and the bleach-fixing solution contain a ferric complex salt of a compound represented by the above Formula I, II, III, IV, V, VI or VII.

Among compounds represented by Formula I, II, III, IV, V, VI or VII, ones represented by Formula I, III or IV are particularly preferable.

DETAILED DESCRIPTION OF THE INVENTION

The following are examples of the compound represented by Formula I:

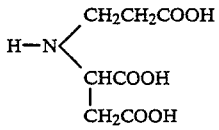
(I-1)

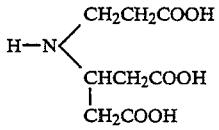
(I-2)

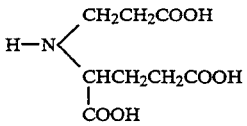
(I-3)

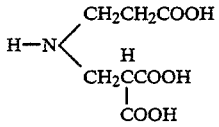
(I-4)

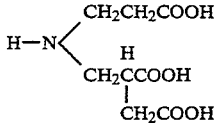
(I-5)

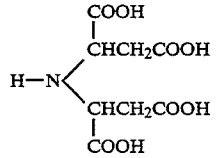
(I-6)

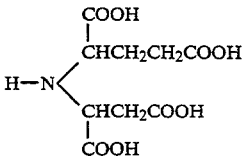
(I-7)

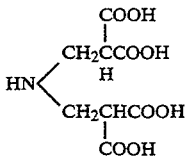
(I-8)

-continued (I-9)

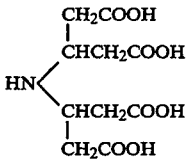

(I-10)

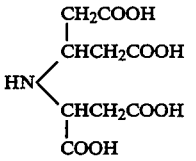

(I-11)

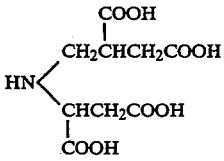

(I-12)

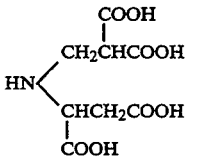

(I-13)

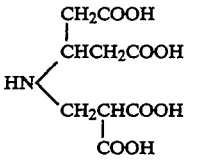

(I-14)

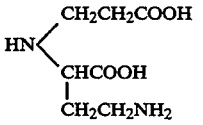

(I-15)

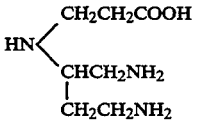

(I-16)

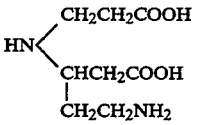

(I-17)

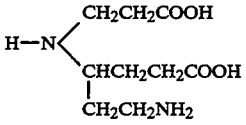

(I-18)

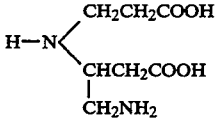

(I-19)

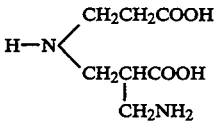

-continued (I-20)

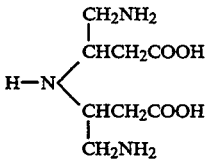

(I-21)

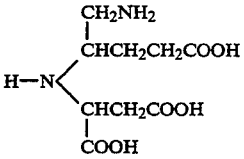

(I-22)

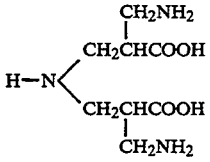

(I-23)

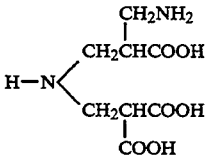

(I-24)

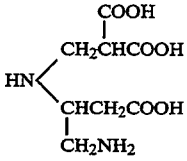

(I-25)

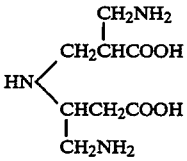

(I-26)

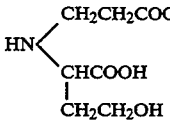

(I-27)

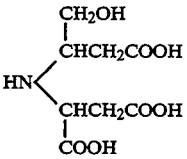

Among the above exemplified compounds the most preferred are Compounds I-1, I-3, I-6, I-8, I-14 and I-20.

As a synthesis example of a compound of Formula I a method of synthesizing the exemplified Compound I-1 is given below:

Synthesis of Exemplified Compound I-1

One hundred and thirty-three point one grams (1 mol) of L-aspartic acid are suspended in 100 ml of water, and to this suspension, with stirring under ice-cooled condition, are added dropwise 128 g (3.2 mols) of sodium hydroxide. Further, to this, with stirring gently at room temperature, are added dropwise 86.5 g (1.2 mols) of acrylic acid and then this reaction system is refluxed overnight. When the system is adjusted to pH 2.2 with 6N hydrochloric acid while being cooled with ice, it gradually deposits white crystals. For purification, the product is dissolved in an aqueous sodium hydroxide solution; pH of it is adjusted to 2.2 by adding 6N hydrochloric acid thereto to effect its deposition again; the deposit is filtered, washed with water, ethanol and either, and then dried at 90° C., spending a full day. Yield: 96.6 g (47.1%)

Elementary analysis: C: 40.980%, H: 5.404%, N: 6.827% Calculated ($C_7H_{11}NO_6$): C: 41.026%, H: 5.353%, N: 6.800%

The other exemplified compounds represented by Formula I can also be synthesized according to generally known methods like the method shown above.

The following are preferred examples of the compound of the foregoing Formula II.

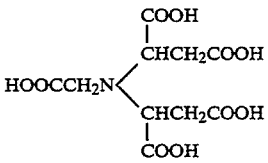
(II-1)

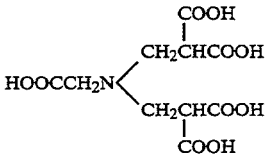
(II-2)

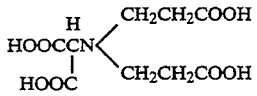
(II-3)

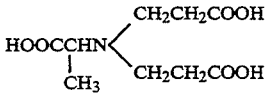
(II-4)

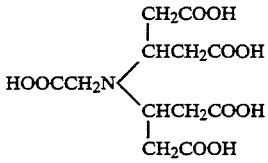
(II-5)

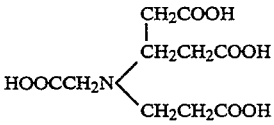
(II-6)

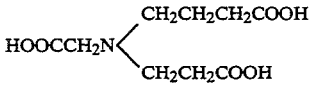
(II-7)

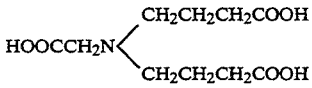
(II-8)

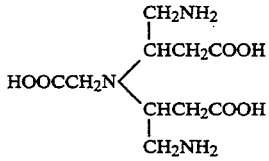
(II-9)

-continued

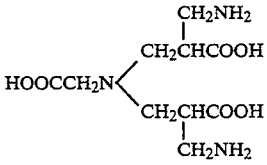
(II-10)

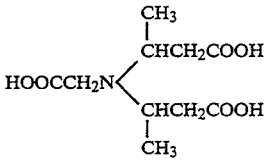
(II-11)

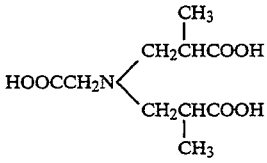
(II-12)

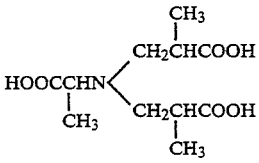
(II-13)

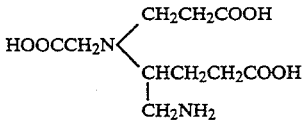
(II-14)

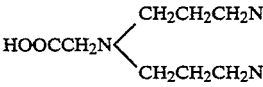
(II-15)

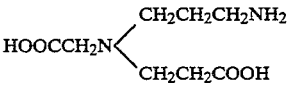
(II-16)

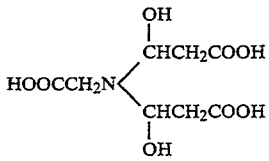
(II-17)

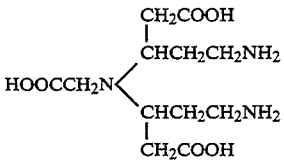
(II-18)

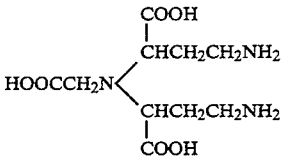
(II-19)

Among the above exemplified compounds the most preferred are compounds II-1, II-2, II-3, II-4, II-11, II-12 and II-17.

As a synthesis example of a compound of Formula II a method for synthesizing the exemplified Compound II-12 is shown below:

Synthesis of Compound II-12

Seventy-five grams (1 mol) of glycine are put in 100 ml of water, and to this, with stirring under ice-cooled condition, are added 128 g (9.2 mols) of an aqueous sodium hydroxide solution. Further, to this, with stirring at room temperature, are added dropwise 206.4 g (2.4 mols) of methacrylic acid, and the reaction system is refluxed overnight. After that, when the system is adjusted to pH 2 with 6N hydrochloric acid while being cooled with ice, it gently deposits white crystals. For purification, the obtained product is dissolved in an aqueous sodium hydroxide solution; pH of it is adjusted to 2 by adding 6N hydrochloric acid thereto to effect its deposition again; the deposit is then filtered, washed with water, ethanol and ether, and then dried at 90° C., spending a full day. Yield: 160.5 g (65.0%)

The chemical structure of the above product was ascertained by means of proton NMR, FD-MS and IR.

The other exemplified compounds of Formula II can also be synthesized according to generally known methods similar to the above method.

The following are preferred examples of compounds represented by Formulas III and IV.

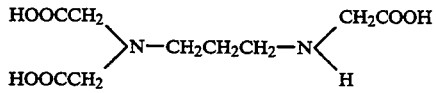
(III-1)

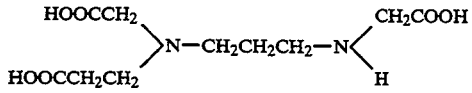
(III-2)

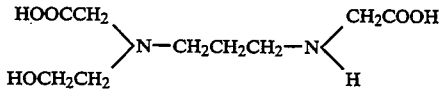
(III-3)

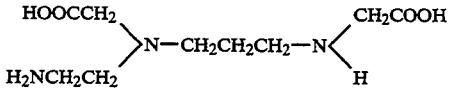
(III-4)

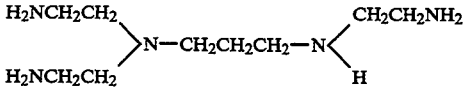
(III-5)

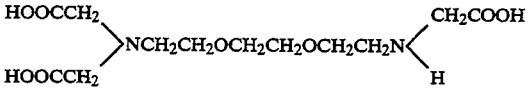
(III-6)

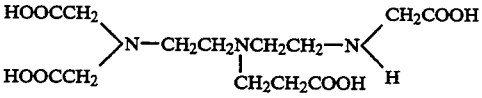
(III-7)

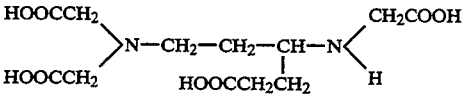
(III-8)

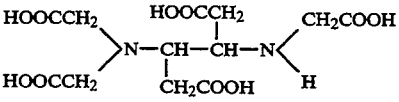
(III-9)

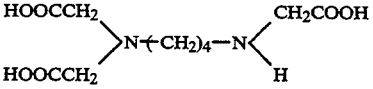
(III-10)

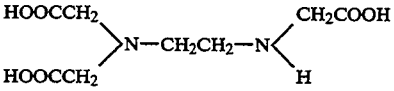
(III-11)

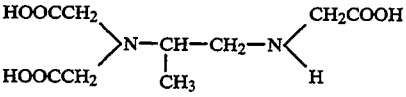
(III-12)

-continued
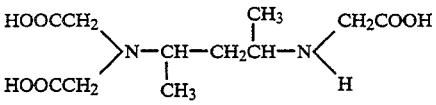
(III-13)
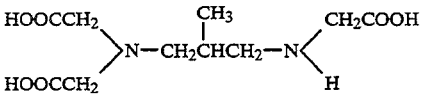
(III-14)
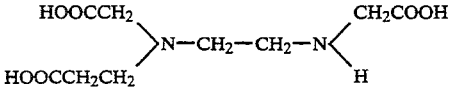
(III-15)
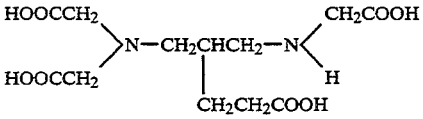
(III-16)
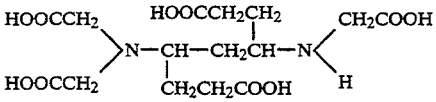
(III-17)
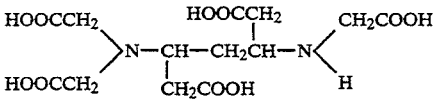
(III-18)
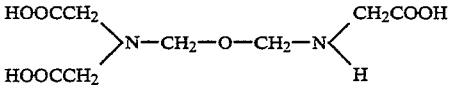
(III-19)
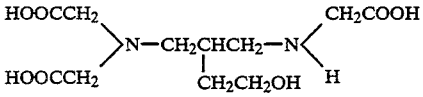
(III-20)
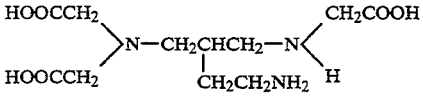
(III-21)
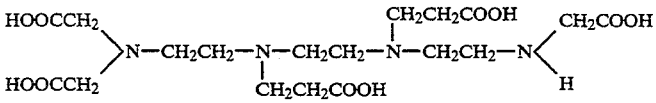
(III-22)
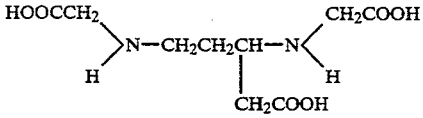
(III-23)
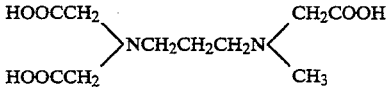
(III-24)
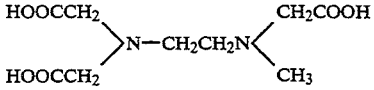
(III-25)
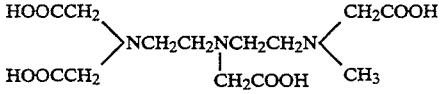
(III-26)
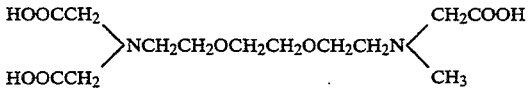
(III-27)

-continued
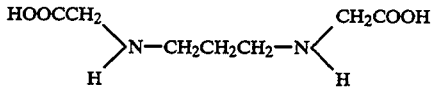
(IV-1)
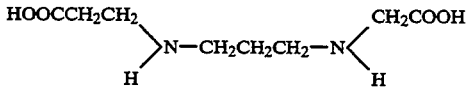
(IV-2)
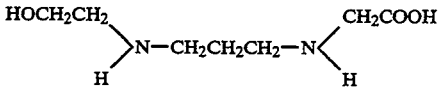
(IV-3)
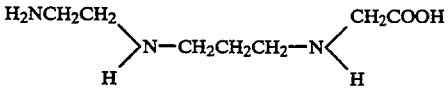
(IV-4)
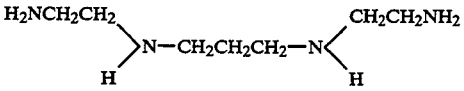
(IV-5)
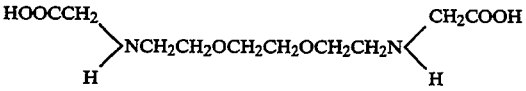
(IV-6)
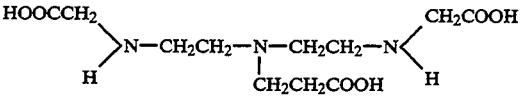
(IV-7)
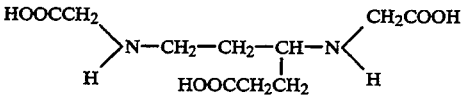
(IV-8)
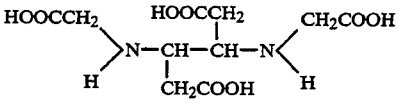
(IV-9)
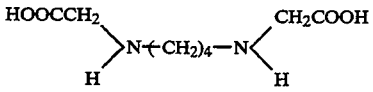
(IV-10)
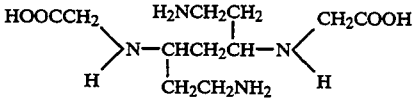
(IV-11)
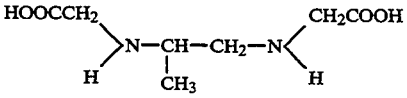
(IV-12)
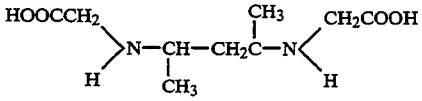
(IV-13)
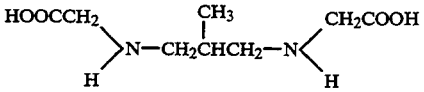
(IV-14)
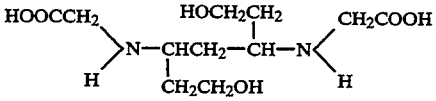
(IV-15)

-continued

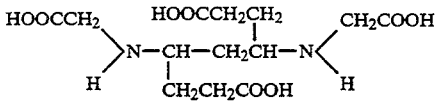
(IV-16)

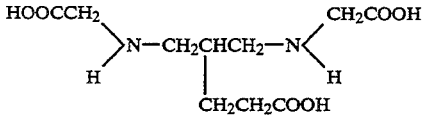
(IV-17)

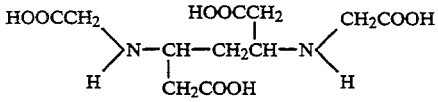
(IV-18)

Among the above-listed compounds the particularly preferred are Compounds III-1, III-6, III-7, III-17, III-18, IV-1, IV-7, IV-16 and IV-18, and the most preferred is Compound III-1.

Any of the above compounds represented by Formulas III and IV can be synthesized according to an appropriate one of those methods described in Kagehira Ueno, the 'Kireito Kagaku (Chelating Chemistry),' vol.5, Chapter 1 (Nankohdo), or other generally known methods.

A synthesis example of the above Compound III-1, 1,3-propanediamine-N,N,N'-triacetic acid, is described in detail in p.67 of the book of the abstracts of papers presented to the 42nd Complex Chemistry Forumm (1992).

The following are preferred examples of compounds represented by Formulas V, VI and VII.

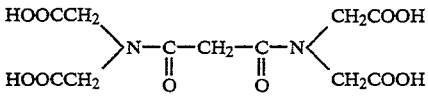
(V-1)

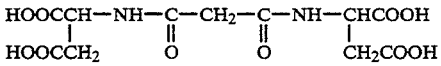
(V-2)

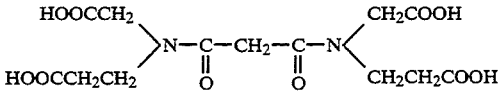
(V-3)

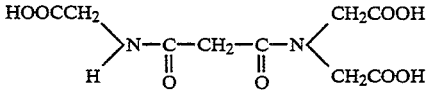
(V-4)

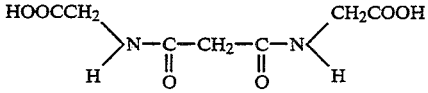
(V-5)

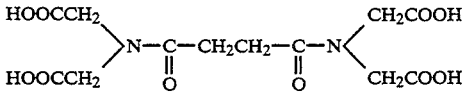
(V-6)

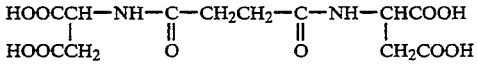
(V-7)

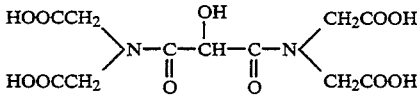
(V-8)

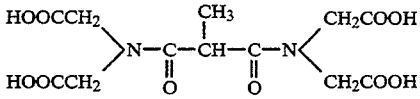
(V-9)

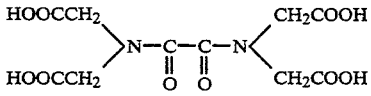
(V-10)

-continued
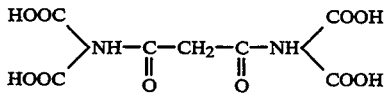
(V-11)
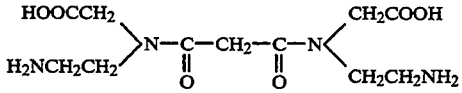
(V-12)
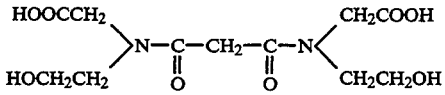
(V-13)
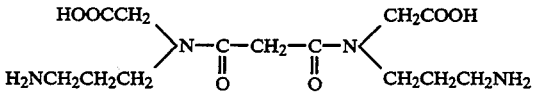
(V-14)
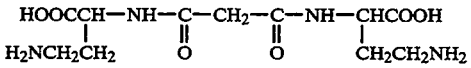
(V-15)
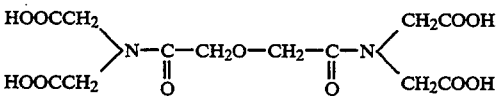
(V-16)
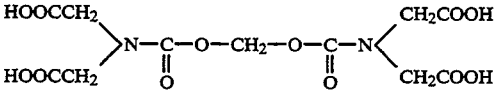
(V-17)
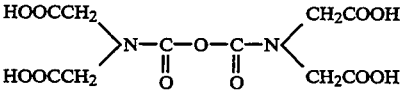
(V-18)
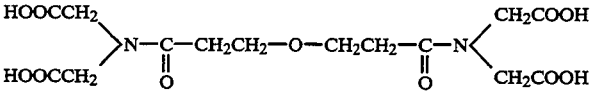
(V-19)
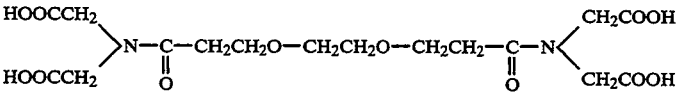
(V-20)
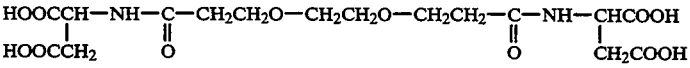
(V-21)
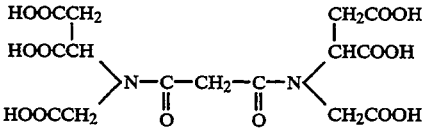
(V-22)
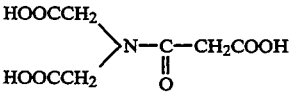
(VI-1)
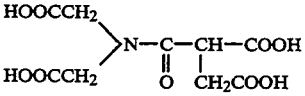
(VI-2)
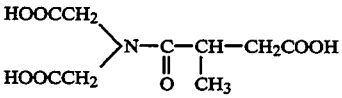
(VI-3)

-continued
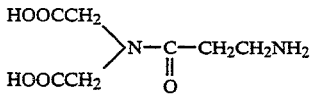
(VI-4)
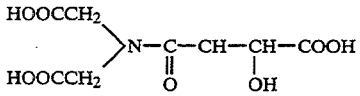
(VI-5)
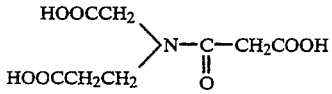
(VI-6)
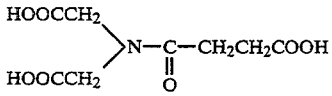
(VI-7)
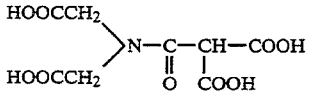
(VI-8)
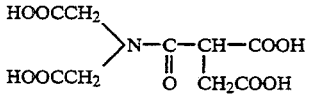
(VI-9)
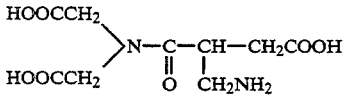
(VI-10)
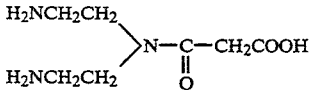
(VI-11)
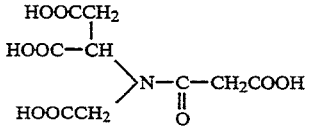
(VI-12)
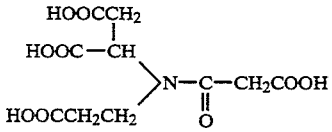
(VI-13)
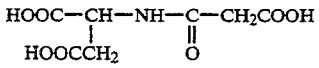
(VI-14)
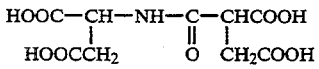
(VI-15)
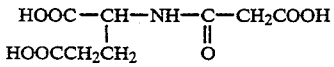
(VI-16)
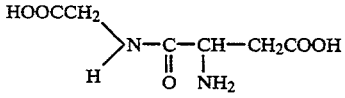
(VI-17)
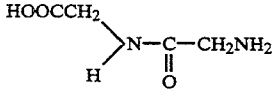
(VI-18)

-continued

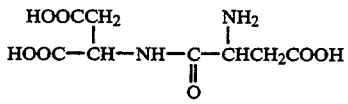
(VI-19)

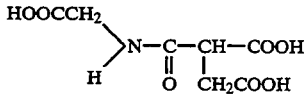
(VI-20)

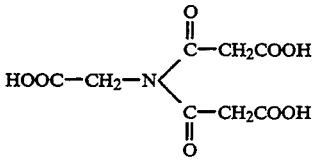
(VII-1)

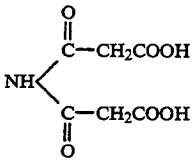
(VII-2)

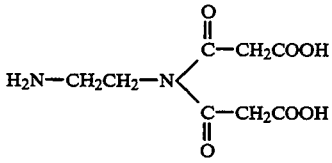
(VII-3)

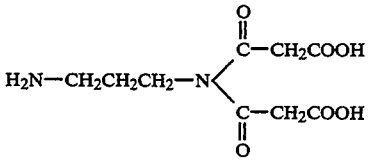
(VII-4)

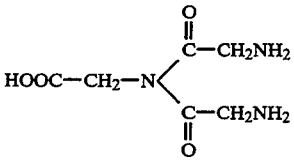
(VII-5)

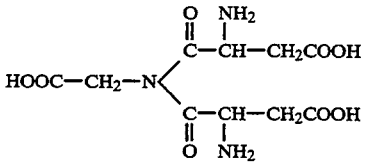
(VII-6)

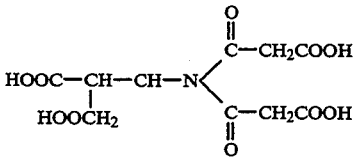
(VII-7)

Among the above-listed compounds the most preferred are Compounds V-1, V-2, VI-1, VI-14 and VII-2.

As a synthesis example of compounds of Formulas V to VII a method for synthesizing the exemplified Compound V-1 is given below:

Synthesis of Exemplified Compound V-1

Two hundred and sixty-six point two grams (2 mols) of iminodiacetic acid and 280 g (7 mols) of sodium hydroxide are dissolved in water cooled with ice, and to the solution, with stirring under ice-cooled (5° C.) condition, are slowly added dropwise 141 g (1 mol) of malonyl chloride. After two hours of stirring, pH of the solution is adjusted to 2 with use of 6N hydrochloric acid, and to this is added 1 liter of ethanol. The obtained crystals are recrystallized from a water/ethanol solution, whereby 251 g of white crystalline object V-1 are obtained (yield: 75%). The chemical structure of the obtained product is ascertained by means of proton NMR, FD-MS and IR.

The other exemplified compounds of Formulas V, VI and VII can also be synthesized according to generally known methods similar to the above described method.

Explanation of the case where the processing solution of the invention is a solution having a bleaching capacity; i.e., a bleaching or bleach-fix solution, is given below:

In the bleaching solution or bleach-fix solution of the invention it is preferable to use one of the compounds represented by Formulas I to VII in the form of a ferric complex salt.

The added amount of these compounds to the processing solution having a bleaching capacity is preferably 0.05 mol to 2.0 moles, and more preferably 0.1 mol to 1.0 mol per liter of the solution.

In the bleaching or bleach-fix solution of the invention there may also be used any one of the ferric complex salts of the following compounds besides those of the compounds of Formulas I to VII.

A'-1 Ethylenediaminetetraacetic acid
A'-2 Trans-1,2-cyclohexanediaminetetraacetic acid
A'-3 Dihydroxyethylglycine
A'-4 Ethylenediaminetetrakismethylenephoshonic acid
A'-5 Nitrilotrismethylenephosphonic acid
A'-6 Diethylenetriaminepentakismethylenephosphonic acid
A'-7 Diethylenetriaminepentaacetic acid
A'-8 Ethylenediaminediorthohydroxyphenylacetic acid
A'-9 Hydroxyethylethylenediaminetriacetic acid
A'-10 Ethylenediaminepropionic acid
A'-11 Ethylenediaminediacetic acid
A'-12 Hydroxyethyliminodiacetic acid
A'-13 Nitrilotriacetic acid
A'-14 Nitrilotripropionic acid
A'-15 Triethylenetetraminehexaacetic acid
A'-16 Ethylenediaminetetrapropionic acid The added amount of the ferric complex salts of the above organic acids to the bleaching or bleach-fix solution is preferably 0.05 mol to 2.0 mols, and more preferably 0.10 mol to 1.5 mols per mol of the solution.

The bleaching or bleach-fix solution can exhibit its suitable effect for rapid processing when it also contains at least one of the imidazoles and derivatives thereof described in JP O.P.I. No. 295258/1989 and the exemplified compounds of Formulas [I] to [IX] described in the same publication.

Besides the above additives as accelerators, there may also be used the compounds exemplified in p.51–115 of JP O.P.I. No. 123459/1987, those exemplified in p.22–25 of JP O.P.I. No. 17445/1988, and those described in JP O.P.I. Nos. 95630/1978 and 28426/1987.

The bleaching or bleach-fix solution is used at a temperature of preferably 20° C. to 50° C., and more preferably 25° C. to 45° C.

The bleaching solution is used at pH of preferably 6.0 or less, more preferably 1.0 to 5.5, and pH of the bleach-fix solution is preferably 5.0 to 9.0, and more preferably 6.0 to 8.5, provided, however, that the above pH of the bleaching or bleach-fix solution means the pH of the bath thereof at the time of processing a light-sensitive material, —absolutely not the pH of a replenisher thereto.

The bleaching or bleach-fix solution may also contain a halide such as ammonium bromide, potassium bromide or sodium bromide, and others such as a brightening agent, a defoaming agent and a surfactant in addition to the above additives.

The reprenishing amount to the bleaching or bleach-fix bath is preferably not more than 500 ml, more preferably 20 ml to 400 ml and most preferably 40 ml to 350 ml per $m^2$ of the silver halide color photographic light-sensitive material to be processed; the less the replenishing amount, the more conspicuous the effect of the invention.

In the invention, in order to increase the activity of the bleaching or bleach-fix solution, air or oxygen may, if necessary, be blown into its bath as well as into a replenisher tank therefor, or an appropriate oxidation agent such as hydrogen peroxide or a persulfide may be discretionally added thereto.

Suitably usable as the fixing agent for the bleach-fix solution or fixing solution of the invention is a thiocyanate or a thiosulfate. The thiocyanate content of the solution is preferably not less than 0.1 mol, more preferably not less than 0.5 mol, and most preferably not less than 1.0 mol per liter of the solution when processing a color negative film. The thiosulfate content of the solution is preferably not less than 0.2 mol, and more preferably not less than 0.5 mol per liter of the solution when processing a color negative film.

In addition to the fixing agent, the bleaching or bleach-fix solution of the invention may contain one of or two or more in combination of pH buffers comprising various salts. In addition, it is preferable for the solution to contain a large amount of an alkali halide or ammonium halide such as potassium bromide, sodium bromide, sodium chloride or ammonium bromide. Also, a compound known to be added to an ordinary bleach-fix bath, such as an alkylamine, a polyethylene oxide, may be arbitrarily added.

The bleach-fix bath of the invention may be subjected to silver recovery treatment according to a known, appropriate method.

Any one of the compounds of the following Formula FA and the exemplified compounds therefor described in JP O.P.I. No. 295258/1989 is preferably added to the bleach-fix solution of the invention to not only exhibit the effect of the invention better but also provide other effect to markedly lessen the sludge generated in the processing solution having a fixing capacity when processing small quantities of light-sensitive materials over a long period of time.

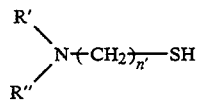

Formula FA wherein R' and R'' are each a hydrogen atom, an alkyl group, an aryl group, an aralkyl group or a heterocyclic group, and n' is an integer or 2 or 3.

Any of those compounds represented by the Formula FA shown in the above publication can be synthesized in accordance with common methods as described in U.S. Pat. Nos. 3,335,161 and 3,260,718. These compounds having Formula FA may be used alone or in combination.

The added amount of the compound of Formula FA is preferably 0.1 to 200 g per liter of the solution.

The processing time in the bleaching or bleach-fix bath is discretionary, but is preferably not longer than 3 minutes and 30 seconds, more preferably 10 seconds to 2 minutes and 20 seconds, and most preferably 20 seconds to 1 minute and 20 seconds. The processing time in the bleach-fix solution is preferably not longer than 4 minutes, and more preferably seconds to 2 minutes and 20 seconds.

When the percentage of the ammonium ion accounting for of the whole cations in the silver halide color photographic light-sensitive material processing solution of the invention is not more than 50%, the solution exhibits the effect of the invention better and little emits a foul odor, so that it is one of the preferred embodiments of the invention; the percentage is more preferably not more than 30 mole %, and most preferably not more than 10 mol %.

The bleaching or bleach-fix solution of the invention may contain one of the compounds represented by the Formula II described in JP Application No. 64897/1989 and hydroxyacetic acid.

Next, where the processing solution of the invention is outside of the bleaching solution and bleach-fix solution is described below.

Where the processing solution of the invention is one other than the bleaching or bleach-fix solution, good results can be obtained by adding one of those compounds represented by Formulas I to VII in an amount of preferably 0.1 to 50 g and more preferably 0.5 to 10 g/liter to the solution. Two or more of the above compounds may be used in combination and may also be used in combination with other chelating agents. In preparation, these compounds together with other necessary constituents may be added to the solution, or may, as they are, be packed into a powdery kit or a condensed liquid kit.

The photographic processing chemical composition of the invention can apply to every processing solution for use in processing silver halide photographic light-sensitive materials. Examples of the processing solution include a developer solution for ordinary black-and-white light-sensitive materials, an infectious developer solution for lith films, a color developer solution, a bleaching solution, a fixing solution, a bleach-fix solution, a short-stop solution, a hardening solution, a stabilizing solution, a fogging solution and a toning solution, but are not limited thereto. The photographic processing chemical composition of the invention can apply to the processing of all silver halide photographic light-sensitive materials, including color films, color photographic papers, ordinary black-and-white films, X-ray films, graphic arts films and micrographic films.

The bleach-fix solution adopted in the invention is preferably followed by a stabilization treatment in a stabilizing solution.

It is particularly preferred for the object of the invention to have the stabilizing solution contain a chelating agent having a chelating stability constant of not less than 8 to iron ions, wherein the chelating stability constant implies a generally known constant according to L. G. Sillen and A. E. Martell, 'Stability Constants of Metal-ion Complexes' The Chemical Society, London (1964); S. Chaberek and A. E. Martell, 'Organic Sequestering Agents,' Wiley (1959).

Examples of the chelating agent having a chelating stability constant of not less than 8 to iron ions include organic carboxylic acid chelating agents, organic phosphoric acid chelating agents, inorganic phosphoric acid chelating agents and polyhydroxy compounds, wherein the iron ion implies ferric ion $Fe^{3+}$.

As the chelating agent having a chelating stability constant of not less than 8 to ferric ions, in addition to the compounds of Formulas I to VII of the invention there are the following compounds, but not limited thereto: Ethylenediaminediorthohydroxyphenylacetic acid, diaminopropanetetraacetic acid, nitrilotriacetic acid, hydroxyethylenediaminetriacetic acid, dihydroxyethylglycine, ethylenediaminediacetic acid, ethylenediaminedipropionic acid, iminodiacetic acid, diethylenetriaminepentaacetic acid, hydroxyethyliminodiacetic acid, diaminopropanoltetraacetic acid, trans-cyclohexanediaminetetraacetic acid, glycolether-diaminetetraacetic acid, ethylenediaminetetrakismethylenephosphonic acid, nitrilotrimethylenephosphonic acid, 1-hydroxyethylidene-1,1-diphosphonic acid, 1,1-diphosphonoethane-2-carboxylic acid, 2-phosphonobutane-1,2,4-tricarboxylic acid, 1-hydroxy-1-phosphonopropane-1,2,3-tricarboxylic acid, catechol-3,5-diphosphonic acid, sodium pyrophosphate, sodium tetrapolyphosphate and sodium hexametaphosphate. Among these compounds the particularly preferred are the diethylenetriaminepentaacetic acid, nitrilotriacetic acid, nitrilotrimethylenephosphonic and 1-hydroxyethylidene-1,1-diphosphonic acid, and the most preferred is the 1-hydroxyethylidene-1,1-diphosphonic acid.

The amount of the above chelating agent to be used is preferably 0.01 to 50 g, and more preferably 0.05 to 20 g per liter of the stabilizing solution from the standpoint of giving good results.

Suitable compounds to be added to the stabilizing solution are ammonium compounds, which may be supplied in the form of various inorganic and organic ammonium salts, examples of which include ammonium hydroxide, ammonium bromide, ammonium carbonate, ammonium chloride, ammonium hypophosphite, ammonium phosphate, ammonium phosphite, ammonium fluoride, ammonium hydrogenfluoride, ammonium fluoroboric acid, ammonium arsenate, ammonium hydrogencarbonate, ammonium hydrogenfluoride, ammonium hydrogensulfate, ammonium sulfate, ammonium iodide, ammonium nitrate, ammonium pentaborate, ammonium acetate, ammonium adipate, ammonium lauryltricarboxylate, ammonium benzoate, ammonium carbamate, ammonium citrate, ammonium diethyldithiocarbamate, ammonium formate, ammonium hydrogenmalate, ammonium hydrogenoxalate, ammonium hydrogenphthalate, ammonium hydrogentartarate, ammonium thiosulfate, ammonium sulfite, ammonium ethylenediaminetetraacetate, ferric-ammonium ethylenediaminetetraacetate, ammonium lactate, ammonium malate, ammonium maleate, ammonium oxalate, ammonium phthalate, ammonium picrate, ammonium pyrolidinedithiocarbamate, ammonium salicylate, ammonium succinate, ammonium sulfanylate, ammonium tartarate, ammonium thioglycolate and ammonium 2,4,6-trinitrophenol. These ammonium compounds may be used alone or in combination. The amount of the ammonium compound to be used is preferably 0.001 mol to 1.0 mol, more preferably 0.002 mol to 0.8 mol per liter of the stabilizing solution.

The stabilizing solution preferably contains a sulfite. The sulfite may be any organic or inorganic one as long as it releases sulfite ions, but is preferably an inorganic sulfite, suitable examples of which include sodium sulfite, potassium sulfite, ammonium sulfite, ammonium hydrogensulfite, potassium hydrogensulfite, sodium hydrogensulfite, sodium metabisulfite, potassium metabisulfite, ammonium metabisulfite and hydrosulfite. The above sulfite is added in an amount of preferably $1\times10^{-3}$ mol/liter, and more preferably $5\times10^{-3}$ mol to $10^{-1}$ mol/liter to the stabilizing solution. The sulfite has an anti-stain effect. The sulfite may be added directly to the stabilizing solution, but is preferably added to a stabilizer replenisher.

Generally known compounds other than the above compounds to be added to the stabilizing solution include polyvinylpyrrolidones (PVP K-15, K-30, K-90); organic acid salts such as citrates, acetates, succinates, oxalates, benzoates; pH adjusting agents such as malates, borates, hydrochloric acid, sulfuric acid; fungicides such as phenol derivatives, catechol derivatives, imidazole derivatives, triazole derivatives, thiabendazole derivatives, organic halogenated compounds, and other fungicides known as slime control agents in the field of the paper-pulp industry; brightening agents, surface active agents, preservatives; and metallic salts such as Bi, Mg, Zn, Ni, Al , Sn, Ti and Zr. From among the above compounds one or two or more of them may be arbitrarily selected within limits not to impair the effect of the invention and used.

No washing treatment is required at all after processing in the stabilizing bath, but a short-time linsing or surface-washing of the light-sensitive material with a small amount of water may, if necessary, be discretionally made.

The presence of a soluble iron salt inside the stabilizing solution is preferable for making the most of the effect of the invention. The soluble iron salt is used in a concentration of preferably at least $5\times10^{-3}$ mol/liter, more preferably $8\times10^{-3}$ to $150\times10^{-3}$ mol/liter, and most preferably $12\times10^{-3}$ to $100\times10^{-3}$ mol/liter. The soluble iron salt may be incorporated into the stabilizing bath solution by adding it to the stabilizer replenisher for replenishing the stabilizing bath, by having it eluted from the light-sensitive material into the stabilizing bath, or by letting it attach to the light-sensitive material in processing thereby to be carried in from the preceding bath to the stabilizing bath.

In the invention, there may be used a stabilizing solution subjected to ion-exchange treatment to reduce its calcium ion and magnesium ion content to 5 ppm or lower, and the stabilizing solution may contain the aforementioned fungicide and a halogen ion-releasing compound.

In the invention, the pH range of the stabilizing solution is preferably 5.5 to 10.0. The pH adjusting agent usable for the stabilizing solution may be any of generally known alkali agents or acid agents.

The processing temperature in the stabilizing solution is preferably 15° C. to 70° C. and more preferably 20° C. to 55° C. The processing time is preferably not longer than 120 seconds, more preferably 3 to 90 seconds and most preferably 6 to 50 seconds.

The supplying amount of a replenisher to the stabilizing bath is preferably 0.1 time to 50 times, more preferably 0.5 time to 30 times the carry-in amount/unit area of a light-sensitive material from the preceding bath (bleach-fix solution) for the sake of rapid processing and improving the dye image quality preservability.

The stabilizing bath preferably consists of a plurality of sub-baths, preferably 2 to 6 sub-baths, more preferably 2 to 3 sub-baths and most preferably 2 sub-baths in the countercurrent system, wherein a replenisher is supplied to the subsequent bath, from which the liquid is allowed to overflow to the preceding bath.

As the color developing agent for the color developing process there are two types; aminophenol-type and p-phenylenediamine-type compounds. In the invention, however, p-phenylenediamine compounds having a water-solubilizing group are preferred. The water-solubilizing group, at least one on the amino group or on the benzene nucleus of the p-phenylenediamine compound, includes $-(CH_2)_n-CH_2OH$, $-(CH_2)_m-NHSO_2-(CH_2)_n-CH_3$, $-(CH_2)_m-O-(CH_2)_n-CH_3$, $-(CH_2CH_2O)_n-C_mH_{2m+1}$ (m and n each are an integer of 0 or more), —COOH or $-SO_3$.

The following are useful examples of the color developing agent for the invention.

Exemplified color developing agents

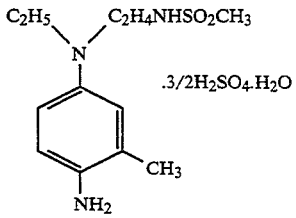

(A-1)

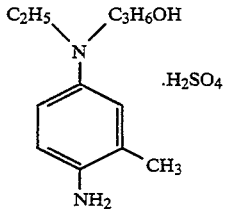

(A-2)

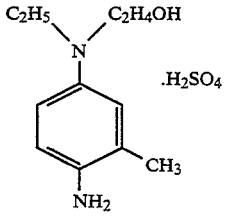

(A-3)

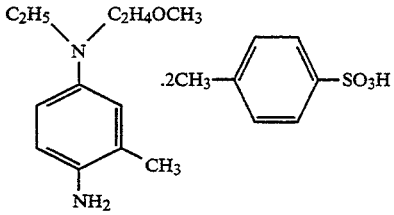

(A-4)

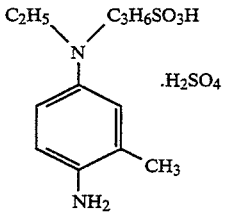

(A-5)

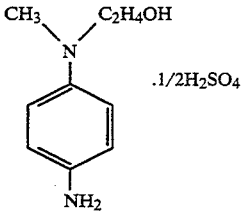

(A-6)

-continued (A-7)

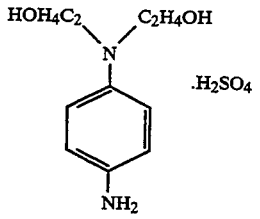

(A-8)

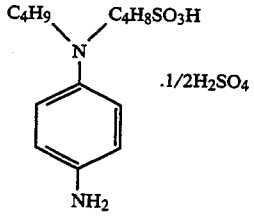

(A-9)

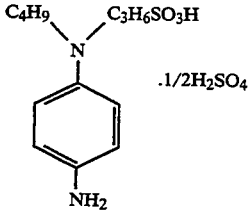

(A-10)

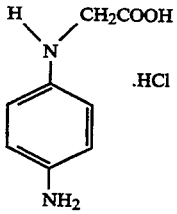

(A-11)

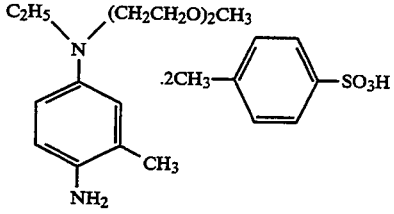

(A-12)

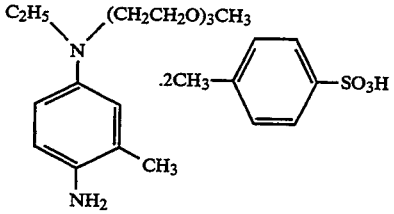

(A-13)

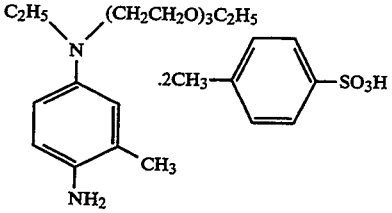

-continued (A-14)

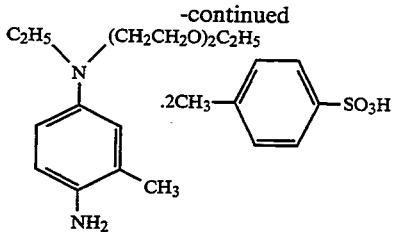

(A-15)

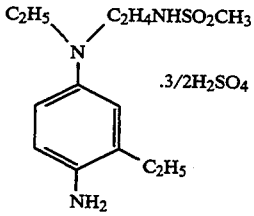

(A-16)

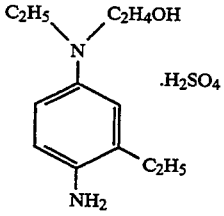

Among the above exemplified color developing agents the preferred for the invention are A-2, A-2, A-3, A-4, A-6, A-7 and A-15, and the most preferred are A-1 and A-3.

Any of the above color developing agents is used usually in the form of a salt such as hydrochloride, sulfate or p-toluenesulfonate. The adding amount of the color developing agent is preferably not less than $0.5\times10^{-2}$ mol, more preferably $1.0\times10^{-2}$ to $1.0\times10^{-1}$ mol and most preferably $1.5\times10^{-2}$ to $7.0\times10^{-2}$ mol per liter of a color developer solution.

The color developer solution used in a color developing process may contain any alkali agent generally used in developer solutions, such as sodium hydroxide, potassium hydroxide, ammonium hydroxide, sodium carbonate, potassium carbonate, sodium sulfate, sodium metaborate or borax. Further, the developer solution may also contain various additives including benzyl alcohol; an alkali halide such as potassium bromide, potassium chloride; a development control agent such as citrazinic acid; a preservative such as hydroxylamine, a hydroxylamine derivative such as diethylhydroxylamine, disulfoethylhydroxylamine, dicarboxyethylhydroxylamine, a hydrazine derivatives such as hydrazinoacetic acid, or a sulfite. Also it may arbitrarily contain a defoaming agent, a surface active agent, an organic dolvent such as methanol, dimethylformamide or dimethylsulfoxide.

The pH of the color developer solution is normally not less than 7, preferably 9 to 13.

The color developer solution may, if necessary, contain an antioxidation agent such as tetronic acid, tetronimide, 2-anilinoethanol, dihydroxyacetone, aromatic secondary alcohol, hydroxamic acid, pentose or hexose, or pyrogallol-1,3-dimethylether.

In the color developer solution, various chelating agents may be used in combination as metallic ion blocking agents; for example, aminopolycarboxylic acids such as ethylenediaminetetraacetic acid, diethylenetriaminepentaacetic acid; organic phosphonic acids such as 1-hydroxyethylidene-1,1-diphosphonic acid; aminopolyphosphonic acids such as aminotri(methylenephosphonic acid) and ethylenediaminetetraphosphonic acid; oxycarboxylic acids such as citric acid and gluconic acid; phosphonocarboxylic acids such as 2-phosphonobutane-1,2,4-tricarboxylic acid; polyphosphonic acids such as tripolyphosphonic acid and hexametaphosphoni acid, not to mention the compounds represented by Formulas I to VII.

The supplying amount of a replenisher to the color developer solution in the running processing of color negative films is preferably not more than 1500 ml, more preferably 250 to 900 ml and most preferably 300 to 700 ml per $m^2$ of the film, and in the running processing of color photographic papers is preferably 20 to 300 ml, and more preferably 30 to 160 ml per $m^2$ of the paper.

EXAMPLES

Example 1

Preparation of a silver halide color photographic light-sensitive material (color photographic paper)

A paper support with its one side polyethylene-laminated and with the other side titanium-containing polyethylene-laminated was used to coat the following layers of the following constituents on the titanium-containing polyethylene side thereof, whereby a multilayer silver halide color photographic light-sensitive material was prepared. The coating liquids were prepared as follows:

Layer 1 coating liquid

A solution of 26.7 g of yellow coupler Y-1, 100 g of dye image stabilizer ST-1, 6.67 g of dye image stabilizer ST-2 and 0.67 g of additive HQ-1 dissolved in 6.67 g of high-boiling organic solvent DNP with 60 ml of ethyl acetate was emulsifiedly dispersed in 220 ml of an aqueous 10% gelatin solution containing 7 ml of a 20% surfactant SU-1 by using a ultrasonic homogenizer, whereby a yellow coupler dispersion was prepared. This dispersion was mixed with a blue-sensitive silver halide emulsion (containing 9.5 g of silver) prepared under the following conditions, whereby a coating liquid for Layer 1 was prepared.

The coating liquids for Layers 2 to 7 also were prepared in similar manner to the above coating liquid for Layer 1.

In addition, hardener H-1 was added to Layers 2 and 4, hardener H-2 to Layer 7, and surfactants SU-2 and SU-3 as coating aids to adjust the surface tension of the emulsion.

TABLE 1

| Layer | Composition | Added amt ($g/m^2$) |
|---|---|---|
| Layer 7(protective layer) | Gelatin | 1.0 |
| Layer 6 (UV absorbing layer) | Gelatin | 0.35 |
| | UV absorbent UV-1 | 0.10 |
| | UV absorbent UV-2 | 0.04 |
| | UV absorbent UV-3 | 0.18 |
| | Antistain agent HQ-1 | 0.01 |
| | DNP | 0.18 |
| | PVP | 0.03 |
| | Antiirradiation dye AI-2 | 0.02 |
| Layer 5 (Red-sensitive layer) | Gelatin | 1.21 |
| | Red-sensitive silver chlorobromide emulsion EmC, in silver equivalent | 0.19 |
| | Cyan coupler C-1 | 0.20 |
| | Cyan coupler C-2 | 0.25 |
| | Dye image stabilizer ST-1 | 0.20 |
| | Antistain agent HQ-1 | 0.01 |
| | HBS-1 | 0.20 |
| | DOP | 0.20 |
| Layer 4 (UV absorbing layer) | Gelatin | 0.90 |
| | UV absorbent UV-1 | 0.28 |
| | UV absorbent UV-2 | 0.08 |
| | UV absorbent UV-3 | 0.38 |
| | Antistain agent HQ-1 | 0.03 |
| | DNP | 0.35 |

TABLE 2

| Layer | Composition | Added Amt ($g/m^2$) |
|---|---|---|
| Layer 3 (Green-sensitive layer | Gelatin | 1.40 |
| | Green-sensitive silver chlorobromide emulsion EmB, silver equivalent | 0.15 |
| | Magenta coupler M-C | 0.32 |
| | Dye image stabilizer ST-3 | 0.15 |
| | Dye image stabilizer ST-4 | 0.15 |
| | Dye image stabilizer ST-5 | 0.15 |
| | DNP | 0.20 |
| | Antiirradiation dye AI-1 | 0.02 |
| Layer 2 (Intermediate layer) | Gelatin | 1.20 |
| | Antistain agent HQ-2 | 0.12 |
| | DIDP | 0.15 |
| Layer 1 (Blue-sensitive layer) | Gelatin | 1.20 |
| | Blue-sensitive silver chlorobromide emulsion EmA, in silver equivalent | 0.25 |
| | Yellow coupler Y-1 | 0.82 |
| | Dye image stabilizer ST-1 | 0.30 |
| | Dye image stabilizer ST-2 | 0.20 |
| | Antistain agent HQ-1 | 0.02 |
| | Antiirradiation dye SI-3 | 0.02 |
| | DNP | 0.20 |
| Support | Polyethylene-laminated paper | |

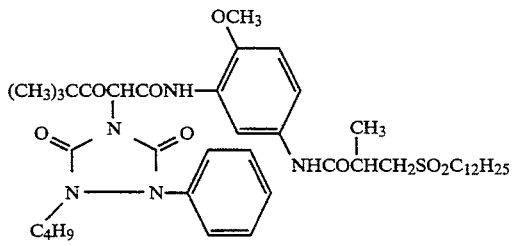

Y-1

-continued
M-C
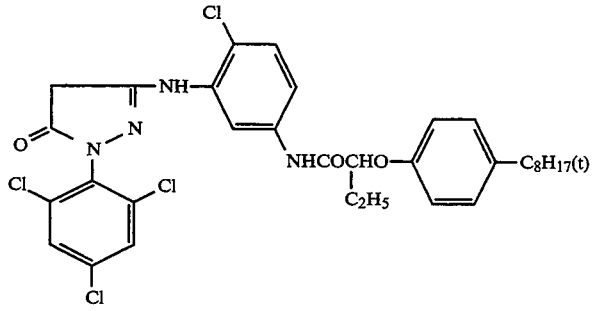
C-1
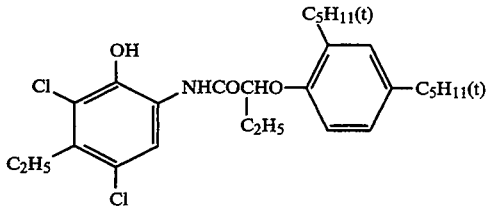
C-2
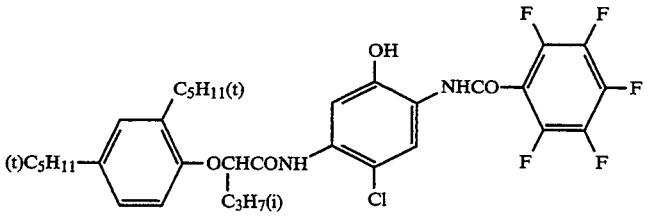
ST-1
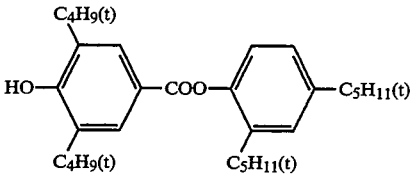
ST-2
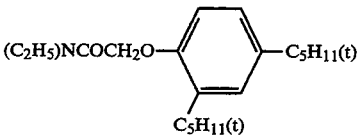
ST-3
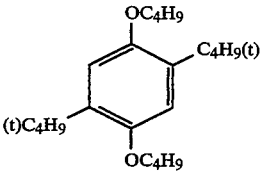
ST-4
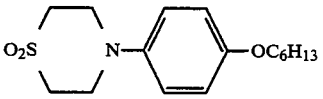
ST-5
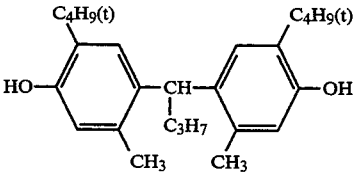

-continued
UV-1
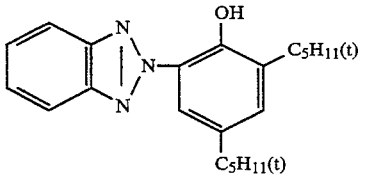
UV-2
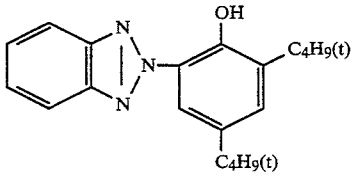
UV-3
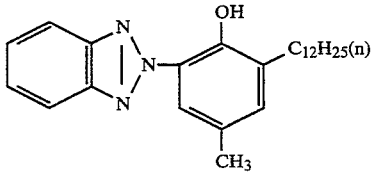
DOP Dioctyl phthalate
DNP Dinonyl phthalate
DIDP Diisodecyl phthalate
PVP Polyvinyl pyrrolidone
HQ-1
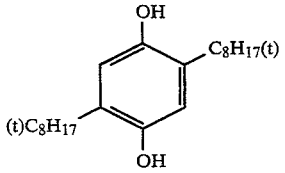
HQ-2
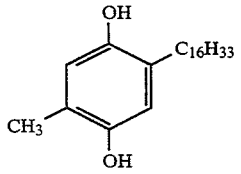
HBS-1
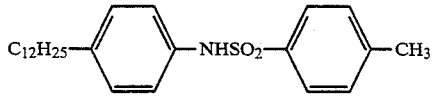
AI-1
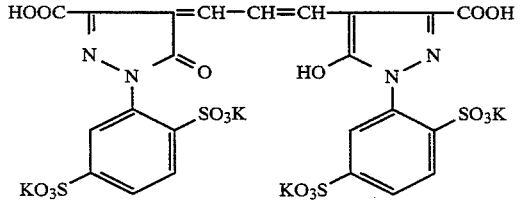
AI-2
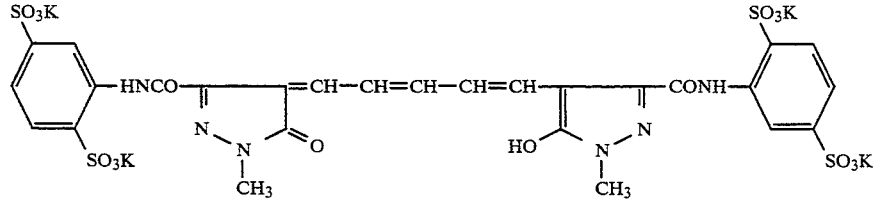

-continued

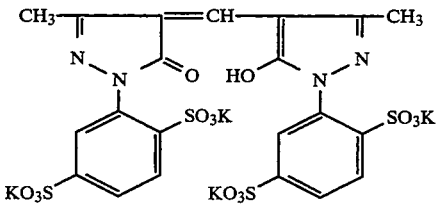

AI-3

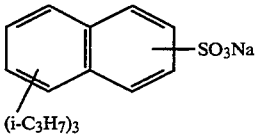

SU-1

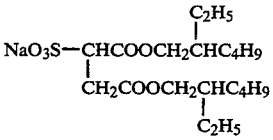

SU-2

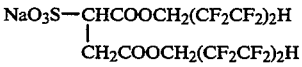

SU-3

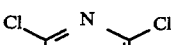

H-1

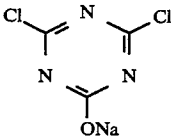

H-2

Preparation of a blue-sensitive silver halide emulsion

To one thousand milliliters of an aqueous 2% gelatin solution kept at 40° C. were simultaneously added spending 30 minutes the following Solutions A and B with regulating pAg and pH of the mixture to 6.5 and 3.0, respectively, and further simultaneously added spending 180 minutes the following Solutions C and D with regulating pAg and pH of the mixture to 7.3 and 5.5, respectively.

In this instance, the regulation of pAg was made according to the method described in JP O.P.I. No. 45437/1984, while that of pH was made with sulfuric acid or an aqueous sodium hydroxide solution.

| | |
|---|---|
| Solution A | |
| Sodium chloride | 3.42 g |
| Potassium bromide | 0.03 g |
| Water to make | 200 ml |
| Solution B | |
| Silver nitrate | 10 g |
| Water to make | 200 ml |
| Solution C | |
| Sodium chloride | 102.7 g |
| Potassium bromide | 1.0 g |
| Water to make | 600 ml |
| Solution D | 300 g |
| Silver nitrate | |
| Water to make | 600 ml |

After completion of the addition, the emulsion was desalted by using an aqueous 5% solution of Demol N, produced by Kawo Atlas Co., and an aqueous 20% magnesium sulfate solution, and then mixed with an aqueous gelatin solution, whereby a monodisperse cubic grains emulsion EMP-1, having an average grain diameter of 0.85 μm, a grain size distribution's variation coefficient of 7% and a silver chloride content of 99.5 mol %, was obtained.

The above emulsion EMP-1 was chemically ripened at 50° C. for 90 minutes with use of the following compounds, whereby a blue-sensitive silver halide emulsion Em-A was obtained.

| | |
|---|---|
| Sodium thiosulfate | 0.8 mg/mol AgX |
| Chloroauric acid | 0.5 mg/mol AgX |
| Stabilizer STAB-1 | $5.8 \times 10^{-4}$ mol/mol AgX |
| Sensitizing dye BS-1 | $4.1 \times 10^{-4}$ mol/mol AgX |
| Sensitizing dye BS-2 | $1.2 \times 10^{-4}$ mol/mol AgX |

Preparation of a green-sensitive silver halide emulsion

A monodisperse cubic grains emulsion EMP-2, having an average grain diameter of 0.43 μm, a grain size distribution's variation coefficient of 8% and a silver chloride content of 99.5 mol %, was prepared in the same manner as in EMP-1 except that the adding time of Solutions A and B and that of Solutions C and D were changed.

EMP-2 was subjected to 120-minute chemical ripening at 55° C. with use of the following compounds to thereby obtain a green-sensitive silver halide emulsion Em-B.

| | |
|---|---|
| Sodium thiosulfate | 1.5 mg/mol AgX |
| Chloroauric acid | 1.0 mg/mol AgX |
| Stabilizer STAB-1 | $5.8 \times 10^{-4}$ mol/mol AgX |
| Sensitizing dye BS-1 | $4.1 \times 10^{-4}$ mol/mol AgX |

Preparation of a red-sensitive silver halide emulsion

A monodisperse cubic grains .emulsion EMP-3, having an average grain diameter of 0.50 μm, a grain size distribution's variation coefficient of 8% and a silver chloride content of 99.5 mol %, was prepared in the same manner as in EMP-1 except that the adding time of Solutions A and B and that of Solutions C and D were changed.

EMP-3 was subjected to 90-minute chemical ripening at 60° C. with use of the following compounds to thereby obtain a red-sensitive silver halide emulsion Em-C.

| | |
|---|---|
| Sodium thiosulfate | 1.8 mg/mol AgX |
| Chloroauric acid | 2.0 mg/mol AgX |
| Stabilizer STAB-1 | $5.8 \times 10^{-4}$ mol/mol AgX |
| Sensitizing dye BS-1 | $4.1 \times 10^{-4}$ mol/mol AgX |

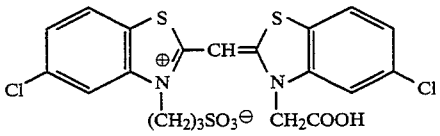

BS-1

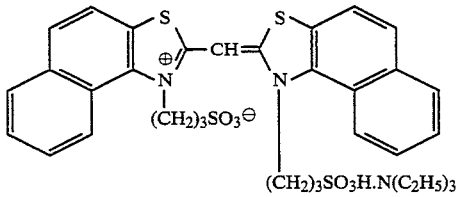

BS-2

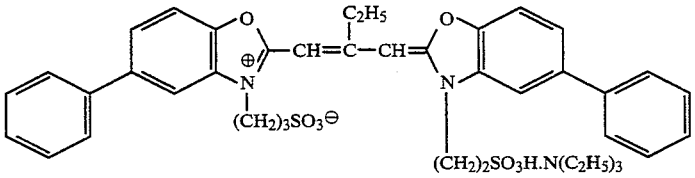

GS-1

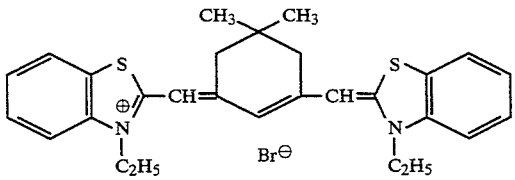

RS-1

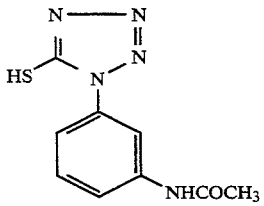

STAB-1

The sample thus prepared in above was exposed in the usual manner and then processed in the following processing solutions according to the following processing steps:

| Processing step | Temperature | Time | Rep. amt. |
|---|---|---|---|
| 1. Color develop | 35.0 ± 0.3° C. | 45 seconds | 162 ml/m² |
| 2. Bleach-fix | 35.0 ± 0.5° C. | 45 seconds | 60 ml/m² |
| 3. Stabilize (tri-bath cascade) | 30 to 34° C. | 90 seconds | 248 ml/m² |
| 4. Dry | 60 to 80° C. | 30 seconds | |

-continued

Color developer

| | |
|---|---|
| Triethanolamine | 10 g |
| Ethylene glycol | 6 g |
| N,N-diethylhydroxylamine | 3.6 g |
| Disodium 2,2'-hydroxyimino-bis-ethanesulfonate | 5.0 g |
| Potassium bromide | 20 mg |
| Potassium chloride | 3 g |
| Diethylenetriaminepentaacetic acid | 5 g |
| Potassium sulfite | $5.0 \times 10^{-4}$ mol |
| Color developing agent, 3-methyl-4-amino-N-ethyl-N-(β-methanesulfonamidoethyl)-aniline sulfate | 5.5 g |
| Potassium carbonate | 25.0 g |
| Potassium hydrogencarbonate | 5 g |
| Water to make 1 liter | |
| Adjust pH to 10.10 with potassium hydroxide or sulfuric acid | |

Color developer replenisher

| | |
|---|---|
| Triethanolamine | 14.0 g |
| Ethylene glycol | 8.0 g |
| N,N-diethylhydroxylamine | 5 g |
| Disodium 2,2'-hydroxyimino-bis-ethanesulfonate | 7.5 g |
| Potassium bromide | 8.0 mg |
| Potassium chloride | 0.3 g |
| Diethylenetriaminepentaacetic acid | 7.5 g |
| Potassium sulfite | $7.0 \times 10^{-4}$ mol |
| Color developing agent, 3-methyl-4-amino-N-ethyl-N-(β-methanesulfonamidoethyl)-aniline | 8 g |

-continued

| | |
|---|---|
| sulfate | |
| Potassium carbonate | 30 g |
| Potassium hydrogencarbonate | 1 g |
| Water to make 1 liter | |
| Adjust pH to 10.40 with potassium hydroxide or sulfuric acid | |
| Bleach-fix bath | |
| Water | 600 ml |
| Organic ferric complex salt (shown in Tables 3 and 4) | 0.15 mol |
| Thiosulfate | 0.55 mol |
| Sulfite | 0.20 mol |
| 1,3-Propanediaminetetraacetic acid | 2 g |
| Adjust pH to 7.0 with ammonia water, potassium hydroxide or acetic acid, and add water to make 1 liter. | |

Regarding the above additives, their ammonium and potassium salts were appropriately used to adjust the rate (mol %) of the ammonium ion in the bleach-fix bath as shown in Tables 3 and 4.

Bleach-fix replenisher

A bleach-fix replenisher solution was prepared in the same way as in the above bleach-fix solution except that the concentration of each of the above additives was made 1.6-fold and pH of the solution was changed to 5.8.

| Stabilizing bath and replenisher | |
|---|---|
| o-Phenyl-phenol | 0.1 g |
| Uvitex MST (produced by Ciba Geigy) | 1.0 g |
| $ZNSO_4.7H_2O$ | 0.1 g |
| Ammonium sulfite (40% solution) | 5.0 ml |
| 1-Hydroxyethylidene-1,1-diphosphonic acid (60% solution) | 3.0 g |
| Ethylenediaminetetraacetic acid | 1.5 g |
| Adjust pH to 7.8 with ammonia water or sulfuric acid, and add water to make 1 liter. | |

The prepared color paper was subjected to running processing by using the above processing solutions.

The running processing was carried out in the manner that the color developer solution, the bleach-fix solution and the stabilizing solution were filled in their respective tanks provided therefor of an automatic processor, and these tanks, while processing the foregoing color paper sample, were replenished at intervals of 3 minutes with color developer replenisher, bleach-fix replenisher and stabilizing bath replenisher, respectively, supplied by and through their respective metering pumps.

The running processing lasted until the total replenishing amount to the bleach-fix bath came to three times the original volume of the bleach-fix tank solution.

After completion of the processing, the exposed area of the processed sample was divided into two; one was subjected to residual silver amount measurement according to fluorescent X-ray spectrographic analysis. Further, the stained condition of the edge portion of the processed color paper at the time of ending the running processing was visually examined. Also, the bleach-fix tank solution's condition (generation of a sulfide) at the time of completion of the running processing was evaluated visually. The results of these tests are given in Tables 3 and 4.

The symbols used in the 'Sulfurized condition' column of Tables 3 and 4 represent as follows:

A: No sulfide at all.

B: Very slight suspended matter observed on the surface of the solution.

C: Slight sulfide observed.

D: Sulfide generation clearly observed.

E: A lot of sulfide observed

The symbols for the 'Edge stain' column mean as follows.

A: No edge stain at all.

B: Very slight edge stain observed.

C: Slight edge stain observed.

D: As much edge stain as problematic observed.

E: Conspicuous edge stain observed.

TABLE 3

| Sample No. | Organic ferric complex salt | Rate of ammonium ion accounting for of the whole cations in bleach-fix bath (mol %) | Residual amount of silver (mg/100 $cm^2$) | Edge stain | Sulfurized condition |
|---|---|---|---|---|---|
| 1-1(comp.) | EDTA.Fe | 100 | 0.8 | C | D |
| 1-2(comp.) | " | 60 | 0.8 | C | D |
| 1-3(comp.) | " | 50 | 0.9 | C | D |
| 1-4(comp.) | " | 30 | 1.0 | B | D |
| 1-5(comp.) | " | 10 | 1.0 | B | D |
| 1-6(comp.) | " | 0 | 1.1 | B | D |
| 1-7(comp.) | PDTA.Fe | 100 | 1.8 | C | E |
| 1-8(comp.) | " | 60 | 1.9 | C | E |
| 1-9(comp.) | " | 50 | 1.9 | B | E |
| 1-10(comp.) | " | 30 | 2.0 | B | E |
| 1-11(comp.) | " | 10 | 2.0 | B | E |
| 1-12(comp.) | " | 0 | 2.2 | B | E |
| 1-13(comp.) | DTPA.Fe | 100 | 0 | E | B |
| 1-14(comp.) | " | 60 | 0 | E | B |
| 1-15(comp.) | " | 50 | 0.1 | E | B |
| 1-16(comp.) | " | 30 | 0.2 | E | B |
| 1-17(comp.) | " | 10 | 0.2 | D | B |
| 1-18(comp.) | " | 0 | 0.3 | D | B |
| 1-19(comp.) | NTA.Fe | 100 | 1.3 | C | B |
| 1-20(comp.) | " | 60 | 1.3 | C | B |
| 1-21(comp.) | " | 50 | 1.4 | B | B |
| 1-22(comp.) | " | 30 | 1.5 | B | B |
| 1-23(comp.) | " | 10 | 1.7 | B | B |
| 1-24(comp.) | " | 0 | 1.7 | B | B |
| 1-25(Inv.) | I-1.Fe | 100 | 0 | C | B |
| 1-26(Inv.) | " | 60 | 0 | C | B |
| 1-27(Inv.) | " | 50 | 0 | B | A |

TABLE 3-continued

| Sample No. | Organic ferric complex salt | Rate of ammonium ion accounting for of the whole cations in bleach-fix bath (mol %) | Residual amount of silver (mg/100 cm$^2$) | Edge stain | Sulfurized condition |
|---|---|---|---|---|---|
| 1-28(Inv.) | " | 30 | 0 | B | A |
| 1-29(Inv.) | " | 10 | 0.1 | A | A |
| 1-30(Inv.) | " | 0 | 0.1 | A | A |

TABLE 4

| Sample No. | Organic ferric complex salt | Rate of ammonium ion accounting for of the whole cations in bleach-fix bath (mol %) | Residual amount of silver (mg/100 cm$^2$) | Edge stain | Sulfurized condition |
|---|---|---|---|---|---|
| 1-31(Inv.) | I-3.Fe | 100 | 0 | C | B |
| 1-32(Inv.) | " | 60 | 0 | C | B |
| 1-33(Inv.) | " | 50 | 0 | B | A |
| 1-34(Inv.) | " | 30 | 0 | B | A |
| 1-35(Inv.) | " | 10 | 0.1 | A | A |
| 1-36(Inv.) | " | 0 | 0.1 | A | A |
| 1-37(Inv.) | I-6.Fe | 100 | 0 | C | B |
| 1-38(Inv.) | " | 60 | 0 | C | B |
| 1-39(Inv.) | " | 50 | 0 | B | A |
| 1-40(Inv.) | " | 30 | 0.1 | B | A |
| 1-41(Inv.) | " | 10 | 0.1 | A | A |
| 1-42(Inv.) | " | 0 | 0.2 | A | A |
| 1-43(Inv.) | I-8.Fe | 100 | 0.1 | C | B |
| 1-44(Inv.) | " | 60 | 0.1 | C | B |
| 1-45(Inv.) | " | 50 | 0.1 | C-B | A |
| 1-46(Inv.) | " | 30 | 0.1 | B | A |
| 1-47(Inv.) | " | 10 | 0.2 | A | A |
| 1-48(Inv.) | " | 0 | 0.2 | A | A |
| 1-49(Inv.) | I-14.Fe | 100 | 0 | C | B |
| 1-50(Inv.) | " | 60 | 0 | C | B |
| 1-51(Inv.) | " | 50 | 0 | B | A |
| 1-52(Inv.) | " | 30 | 0.1 | B | A |
| 1-53(Inv.) | " | 10 | 0.2 | A | A |
| 1-54(Inv.) | " | 0 | 0.2 | A | A |
| 1-55(Inv.) | I-20.Fe | 100 | 0 | C | B |
| 1-56(Inv.) | " | 60 | 0 | C | B |
| 1-57(Inv.) | " | 50 | 0.1 | C-B | A |
| 1-58(Inv.) | " | 30 | 0.1 | B | A |
| 1-59(Inv.) | " | 10 | 0.1 | A | A |
| 1-60(Inv.) | " | 0 | 0.2 | A | A |

In Tables 3 and 4 and the following tables, EDTA.Fe stands for ferric complex salt of ethylenediaminetetraacetic acid, PDTA.Fe for ferric complex salt of 1,3-propylenediaminetetraacetic acid, DTPA.Fe for ferric complex salt of diethylenetriaminepentaacetic acid, NTA.Fe for ferric complex salt of nitrilotriacetic acid, I-1.Fe for ferric complex salt of exemplified Compound I-1, I-3.Fe for ferric complex salt of exemplified Compound I-3, I-6.Fe for ferric complex salt of exemplified Compound I-6, and others likewise.

From Tables 3 and 4, it is understood that the samples of the invention, where organic ferric complex salts of the invention were used, show less residual amounts of silver, less edge stain and better storage stability of the bleach-fix solution than the comparative samples. Further, where the rate of ammonium ions accounting for of the whole cations in the bleach-fix bath is not more than 50 mol %, the above effects become better; when not more than 30 mol %, the effects become far better; and when not more than 10 mol %, the effects become the best.

Example 2

In the following example, the adding amount of each additive is indicated in milligrams per m$^2$ of the silver halide photographic light-sensitive material except that silver halide and colloidal silver are given in silver equivalent.

A silver iodobromide color photographic light-sensitive material sample was prepared in the following manner:

Silver iodobromide color photographic light-sensitive material

A triacetyl cellulose film support of 60 μm in thickness was coated on one side (obverse) thereof with a subbing layer and on the other side (reverse) thereof with the following layers of the following compositions in the described order.

| | |
|---|---|
| Reverse-side Layer 1 | 0.8 g |
| Aluminasol AS-100 (aluminum oxide) (produced by Nissal Chemical Ind., Co.) | |
| Reverse-side Layer 2 | |
| Diacetyl cellulose | 100 mg |
| Stearic acid | 10 mg |
| Silica fine particles (average particle diameter: 0.2 μm) | 50 mg |

Next, on the obverse side of the above subbed triacetyl cellulose film support were formed the following layers of the following compositions in order from the support side, whereby a multilayer color photographic light-sensitive material Sample a-1 was prepared.

| | |
|---|---|
| Layer 1: Antihalation layer (HC) | |
| Black colloidal silver | 0.13 g |
| UV absorbent UV-1 | 0.20 g |
| Colored cyan coupler CC-1 | 0.02 g |
| High-boiling solvent Oil-1 | 0.20 g |
| High-boiling solvent Oil-2 | 0.20 g |
| Gelatin | 1.6 g |
| Layer 2: Intermediate layer (IL-1) | 1.3 g |
| Gelatin | |
| Layer 3: Low-speed red-sensitive emulsion layer (R-L) | |
| Silver iodobromide emulsion (average grain diameter: 0.3 μm) | 0.35 g |
| Silver iodobromide emulsion (average grain diameter: 0.4 μm) | 0.3 g |
| Sensitizing dye S-1 | $3.0 \times 10^{-4}$ mol/mol Ag |
| Sensitizing dye S-2 | $3.2 \times 10^{-4}$ mol/mol Ag |
| Sensitizing dye S-3 | $3.0 \times 10^{-4}$ mol/mol Ag |
| Cyan coupler C-1 | 0.48 g |
| Cyan coupler C-2 | 0.20 g |
| Colored cyan coupler CC-1 | 0.07 g |
| DIR compound D-1 | 0.006 g |
| DIR compound D-2 | 0.01 g |
| High-boiling solvent Oil-1 | 0.55 g |
| Gelatin | 1.0 g |
| Layer 4: High-speed red-sensitive emulsion layer (R-H) | |
| Silver iodobromide emulsion (average grain diameter: 0.7 μm) | 0.92 g |
| Sensitizing dye S-1 | $1.7 \times 10^{-4}$ mol/mol Ag |
| Sensitizing dye S-2 | $1.6 \times 10^{-4}$ mol/mol Ag |
| Sensitizing dye S-3 | $0.2 \times 10^{-4}$ mol/mol Ag |
| Cyan coupler C-2 | 0.22 g |
| Colored cyan coupler CC-1 | 0.03 g |
| DIR compound D-2 | 0.02 g |
| High-boiling solvent Oil-1 | 0.30 g |
| Gelatin | 1.0 g |
| Layer 5: Intermediate layer (IL-2) | 0.8 g |
| Gelatin | |
| Layer 6: Low-speed green-sensitive emulsion layer (G-L) | |
| Silver iodobromide emulsion (average grain diameter: 0.4 μm) | 0.58 g |
| Silver iodobromide emulsion (average grain diameter: 0.3 μm) | 0.2 g |
| Sensitizing dye S-4 | $6.7 \times 10^{-4}$ mol/mol Ag |
| Sensitizing dye S-5 | $1.0 \times 10^{-4}$ mol/mol Ag |
| Magenta coupler M-A | 0.22 g |
| Magenta coupler M-B | 0.40 g |
| Colored magenta coupler CM-1 | 0.10 g |
| DIR compound D-3 | 0.02 g |
| High-boiling solvent Oil-2 | 0.7 g |
| Gelatin | 1.0 g |
| Layer 7: High-speed green-sensitive emulsion layer (G-H) | |
| Silver iodobromide emulsion (average grain diameter: 0.7 μm) | 0.88 g |
| Sensitizing dye S-6 | $1.1 \times 10^{-4}$ mol/mol Ag |
| Sensitizing dye S-7 | $2.0 \times 10^{-4}$ mol/mol Ag |
| Sensitizing dye S-8 | $0.5 \times 10^{-4}$ mol/mol Ag |
| Magenta coupler M-A | 0.48 g |

-continued

| | |
|---|---|
| Magenta coupler M-B | 0.13 g |
| Colored magenta coupler CM-1 | 0.04 g |
| DIR compound D-3 | 0.004 g |
| High-boiling solvent Oil-2 | 0.35 g |
| Gelatin | 1.0 g |
| Layer 8: Yellow filter layer (YC) | |
| Yellow colloidal silver | 0.12 g |
| Additive HS-1 | 0.07 g |
| Additive HS-2 | 0.07 g |
| Additive SC-1 | 0.12 g |
| High-boiling solvent Oil-2 | 0.15 g |
| Gelatin | 0.9 g |
| Layer 9: Low-speed blue-sensitive emulsion layer (B-H) | |
| Silver iodobromide emulsion (average grain diameter: 0.3 μm) | 0.25 g |
| Silver iodobromide emulsion (average grain diameter: 0.4 μm) | 0.25 g |
| Sensitizing dye S-9 | $5.8 \times 10^{-4}$ mol/mol Ag |
| Yellow coupler Y-1 | 0.71 g |
| Yellow coupler Y-2 | 0.30 g |
| DIR compound D-1 | 0.003 g |
| DIR compound D-2 | 0.006 g |
| High-boiling solvent Oil-2 | 0.18 g |
| Gelatin | 1.2 g |
| Layer 10: High-speed blue-sensitive emulsion layer (B-H) | |
| Silver iodobromide emulsion (average grain diameter: 0.8 μm) | 0.5 g |
| Sensitizing dye S-10 | $3.0 \times 10^{-4}$ mol/mol Ag |
| Sensitizing dye S-11 | $1.2 \times 10^{-4}$ mol/mol Ag |
| Yellow coupler Y-1 | 0.18 g |
| Yellow coupler Y-2 | 0.20 g |
| High-boiling solvent Oil-2 | 0.005 g |
| Gelatin | 0.9 g |
| Layer 11: First protective layer (PRO-1) | |
| Silver iodobromide (average grain diameter: 0.08 μm) | 0.3 g |
| UV absorbent UV-1 | 0.07 g |
| UV absorbent UV-2 | 0.10 g |
| Additive HS-1 | 0.2 g |
| Additive HS-2 | 0.1 g |
| High-boiling solvent Oil-1 | 0.07 g |
| High-boiling solvent Oil-3 | 0.07 g |
| Gelatin | 0.85 g |
| Layer 12: Second protective layer (PRO-2) | |
| Compound A | 0.04 g |
| Compound B | 0.004 g |
| Polymethyl methacrylate (average particle diameter: 3 μm) | 0.02 g |
| Copolymer of methyl methacrylate: ethyl methacrylate: methacrylic acid = 3:3:4 by weight (average particle diameter: 3 μm) | 0.13 g |

In addition, the above color photographic light-sensitive material further contains Compounds Su-1 and Su-2, a viscosity adjusting agent, hardening agents H-1 and H-2, stabilizer ST-1, antifoggants AF-1 and AF-2 (average molecular weights: 10,000 and 1,100,000), dyes AI-1 and AI-2, and Compound DI-1 (9.4mg/m$^2$).

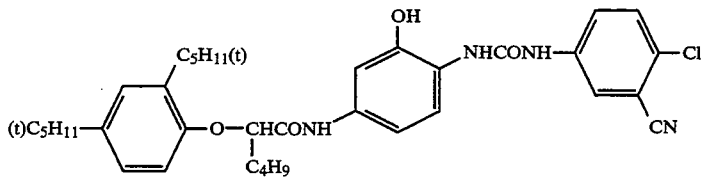

C-1

-continued
C-2
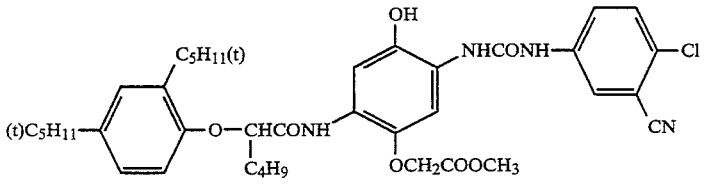
M-A
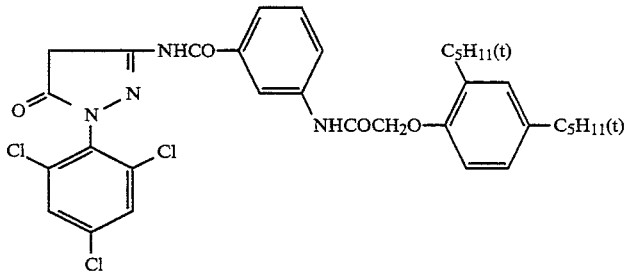
M-B
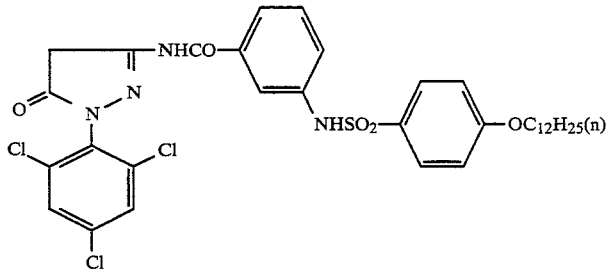
Y-1
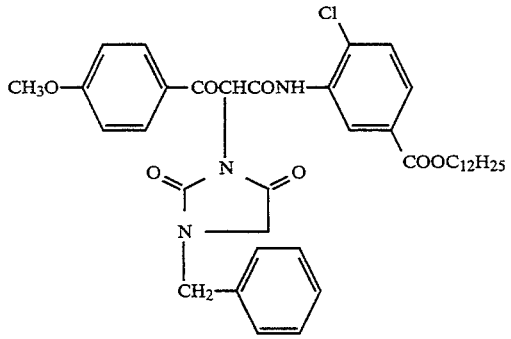
Y-2
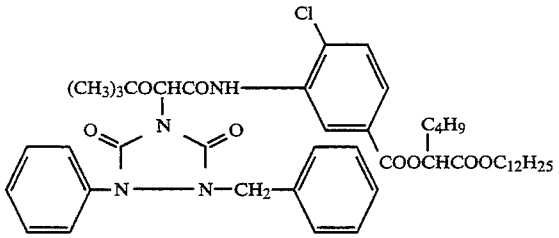
CC-1
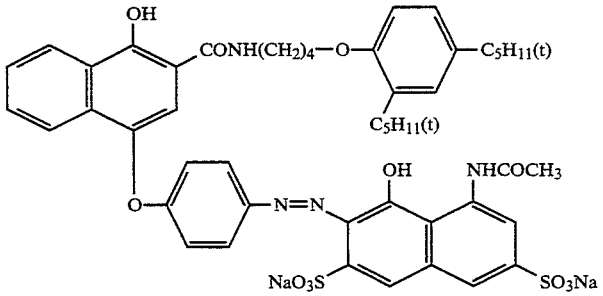

-continued
CM-1
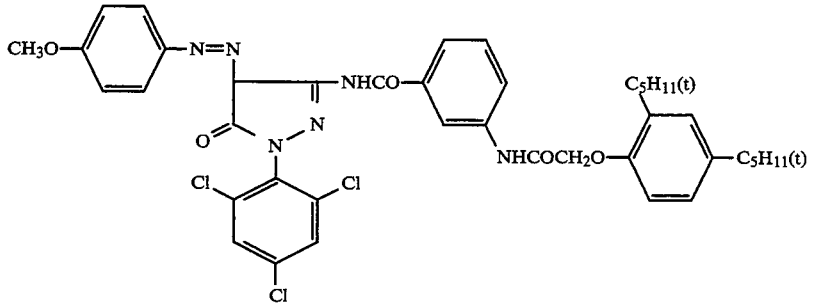
D-1
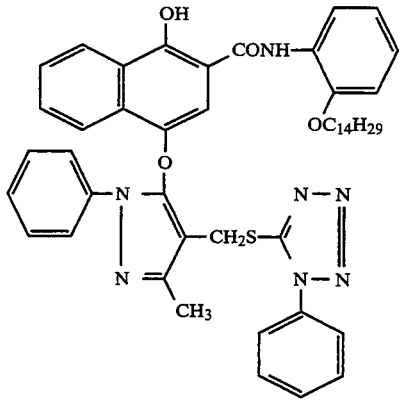
D-2
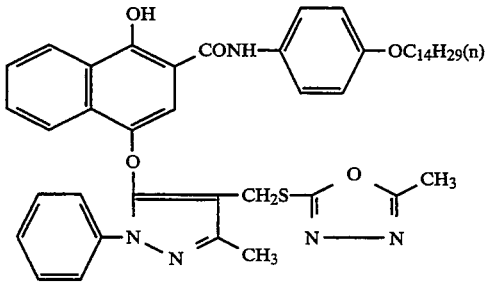
D-3
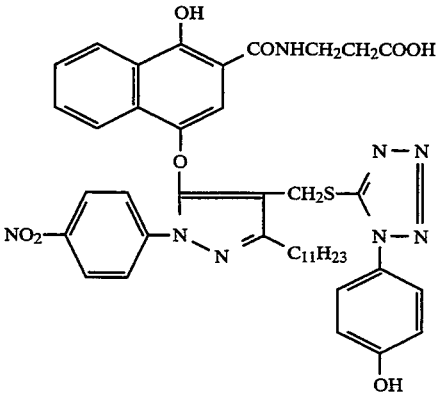
UV-1
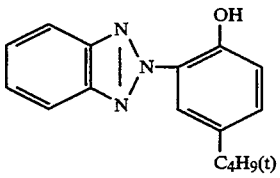

-continued
UV-2
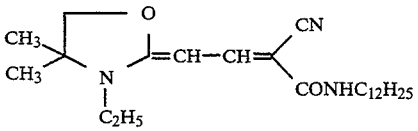
S-1
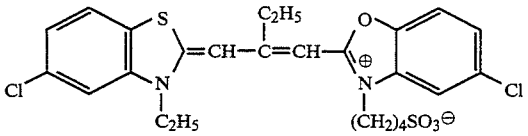
S-2
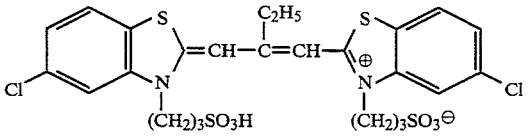
S-3
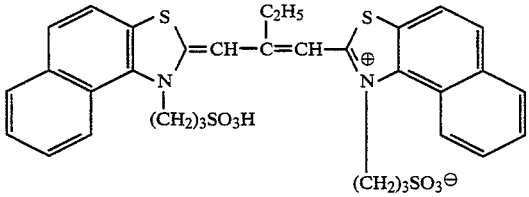
S-4
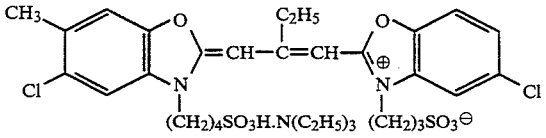
S-5
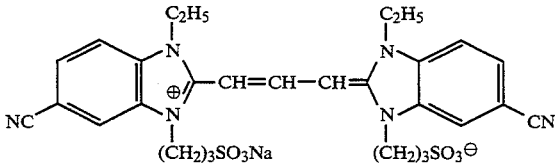
S-6
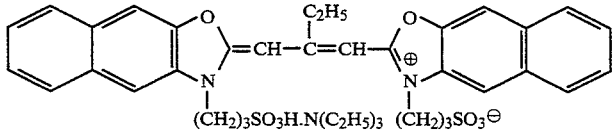
S-7
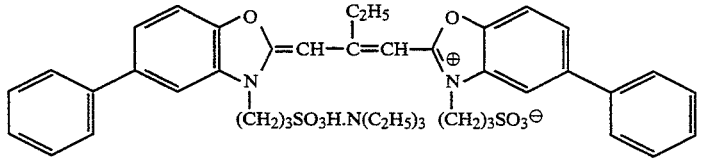
S-8
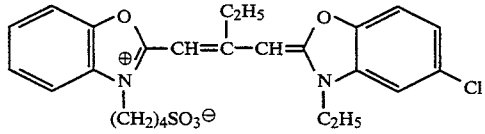
S-9
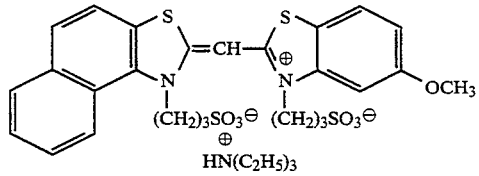

-continued
S-10
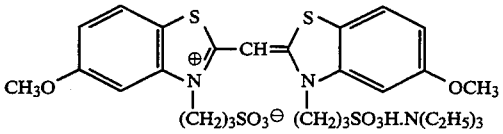
S-11
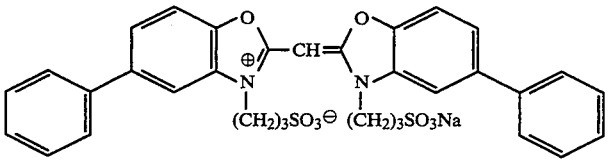
HS-1
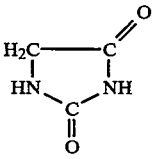
HS-2
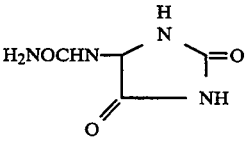
SC-1
A mixture of
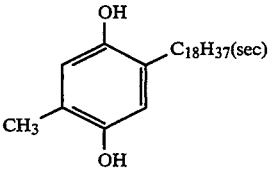
and
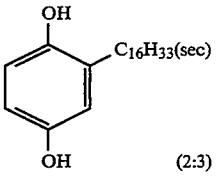
(2:3)
Oil-1
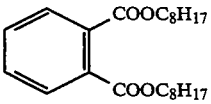
Oil-2
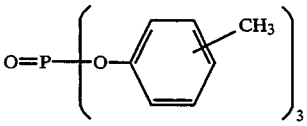
Oil-3
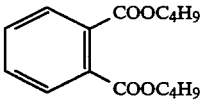
H-1
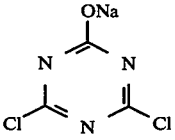
H-2
$(CH_2{=}CHSO_2CH_2)_2O$
SU-1
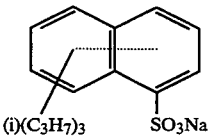

-continued
SU-2
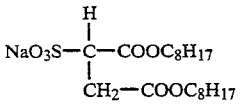
AI-1
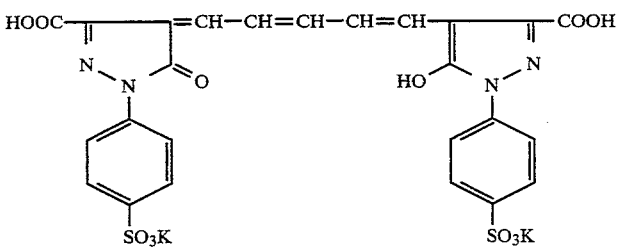
AI-2
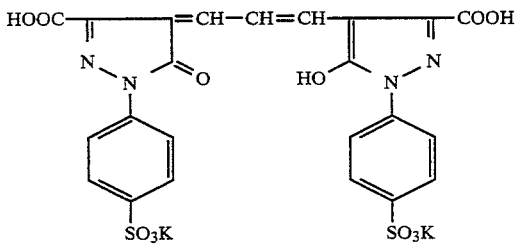
ST-1
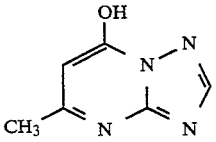
AF-1
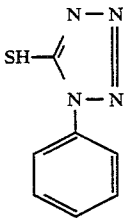
AF-2
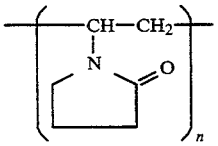
Compound A
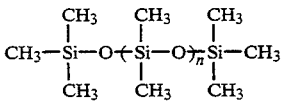
Weight average molecular weight = 3000
Compound B
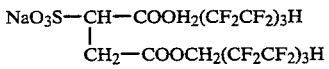
DI-1
A mixture of the following three constituents
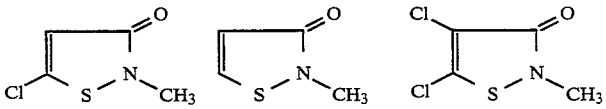
(A) (B) (C)
A:B:C = 50:23:20 (molar ratio)
Preparation of emulsions To the following Solution G-1 kept at 70° C., pAg 7.8 and pH 7.0, with stirring vigorously, was added a seed emulsion in an amount equivalent to 0.34 mol.

Formation of high-iodide-content inner phase (core phase)

After that, the following Solutions H-1 and S-1, with their flow rate being kept in the ratio of 1:1, were added at an accelerated flow rate (the final flow rate is 3.6 times the initial flow rate), spending 86 minutes, to the emulsion.

Formation of low-iodide-content outer phase (shell phase)

Subsequently, to the emulsion, with its pAg and pH being kept at 10.1 and 6.0, respectively, the following Solutions H-2 and S-2, with their flow rate being kept in the ratio of 1:1, were added at an accelerated flow rate (the final flow rate is 5.2 times the initial flow rate), spending 65 minutes.

During the grain formation, pAg was controlled by use of an aqueous potassium bromide solution and pH by an aqueous 56% acetic acid solution. After the grain formation, the emulsion was desalted according to the usual flocculation method, redispersed by adding gelatin thereto, and then subjected to adjustment of its pH and pAg at 40° C. to 5.8 and 8.06, respectively.

The obtained emulsion was a monodisperse emulsion comprising octahedral silver iodobromide grains having an average grain diameter of 0.80 μm, a grain size distribution's variation coefficient of 12.4% and a silver iodide content of 9.0 mol %.

| | |
|---|---|
| Solution G-1 | |
| Osein gelatin | 100.0 g |
| Compound-1, 10 wt % methanol solution | 25.0 ml |
| Aqueous 28% ammonia solution | 440.0 ml |
| Water to make | 5000.0 ml |
| Solution H-1 | |
| Osein gelatin | 82.4 g |
| Potassium bromide | 151.6 g |
| Potassium iodide | 90.6 g |
| Water to make | 1030.5 ml |
| Solution S-1 | |
| Silver nitrate | 309.2 g |
| Aqueous 28% ammonia solution | equivalent |
| Water to make | 1030.5 ml |
| Solution H-2 | |
| Osein gelatin | 300.0 g |
| Potassium bromide | 770.0 g |
| Potassium iodide | 33.2 g |
| Water to make | 3776.8 ml |
| Solution S-2 | |
| Silver nitrate | 1133.0 g |
| Aqueous 28% ammonia solution | Equivalent |
| Water to make | 3776.8 ml |

*'Equivalent' means the amount of an ammonia solution necessary to form a water-soluble silver complex salt.

The above Compound-1 has the following formula:

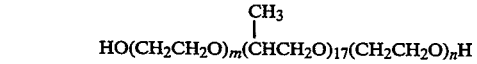

(Average molecular weight = 1300)

The foregoing emulsions different in the average grain diameter and silver iodide content were prepared in the same manner as in the above emulsion except that the seed crystal's average grain diameter, temperature, pAg, pH, flow rate, adding time and halide composition were changed.

The obtained were core/shell-type monodisperse emulsions each having a grain size distribution's variation coefficient of not more than 20%. Each emulsion was optimally chemically ripened in the presence of sodium thiosulfate, chloroauric acid and ammonium thiocyanate, and also to it were added sensitizing dyes, 4-hydroxy-6-methyl-1,3,3a7-tetrazaindene and 1-phenyl-5-mercaptotetrazole, [0197] provided that the above silver iodobromide color photographic light-sensitive material sample's emulsions were adjusted so as to have an average silver iodide content of 8 mol %.

The thus prepared light-sensitive material sample, after being exposed through an optical wedge, was subjected to running processing according to the following processing steps, provided that the running processing was continued until the supply amount of the bleach-fix replenisher comes to twice the volume of the bleach-fix tank solution.

| Processing step | Time | Temp. | Rep.* |
|---|---|---|---|
| 1. Color develop (single bath) | 3 min. 15 sec. | 38° C. | 20 ml |
| 2. Bleach (single bath) | 45 seconds | 38° C. | 5 ml |
| 3. Fixing (single bath) | 1 min. 30 sec. | 38° C. | 33 ml |
| 4. Stabilize (tribath cascade) | 1 minute | 38° C. | 40 ml |
| 5. Dry | 1 minute | 40–80° C. | |

Note: * Replenished amount per roll of 24EX.135-size film

| | |
|---|---|
| Color developer | |
| Potassium carbonate | 30.0 g |
| Sodium hydrogencarbonate | 2.0 g |
| Potassium sulfite | 3.0 g |
| Sodium bromide | 1.2 g |
| Potassium iodide | 1.2 mg |
| Hydroxylamine sulfate | 2.5 g |
| Sodium chloride | 0.6 g |
| 4-Amino-3-methyl-N-ethyl-N-(β-hydroxylethyl)-aniline sulfate | 4.5 g |
| Diethylenetriaminepentaacetic acid | 3.0 g |
| Potassium hydroxide | 1.2 g |
| Water to make 1 liter. | |
| Adjust pH to 10.00 with potassium hydroxide or 20% sulfuric acid. | |
| Color developer replenisher | |
| Potassium carbonate | 35.0 g |
| Sodium hydrogencarbonate | 3.0 g |
| Potassium sulfite | 5.0 g |
| Sodium bromide | 0.4 g |
| Hydroxylamine sulfate | 3.5 g |
| 4-Amino-3-methyl-N-ethyl-N-(β-hydroxylethyl)-aniline sulfate | 6.0 g |
| Potassium hydroxide | 2.0 g |
| Diethylenetriaminepentaacetic acid | 3.0 g |
| Water to make 1 liter. | |
| Adjust pH to 10.15 with potassium hydroxide or sulfurtic acid. | |
| Bleaching bath Solution | |
| Organic ferric salt (Tables 5 and 6) | 0.33 mol |
| Ethylenediaminetetraacetic acid | 10 g |
| Brodmide | 1.2 mol |
| Glacial acetic acid | 40 ml |
| Adjust pH to 4.5 with ammonia water or acetic acid. | |
| Water to make 1 liter. | |

Provided that to adjust the rate (mol %) of the ammonium ion in the bleach-fix bath as shown in Tables 5 and 6, the above ammonium and potassium salts of additives were discretionarily used.

Bleaching bath replenisher

The replenisher was prepared in the same manner as in the above bleaching bath except that the concentration of each of the additives was made 1.2-fold and pH was adjusted to 3.5.

Fixing solution (also as replenisher)

-continued

| | |
|---|---|
| Ammonium thiosulfate (70% solution) | 350 ml |
| Anhydrous sodium hydrogensulfite | 10 g |
| Sodium metabisulfite | 2.5 g |
| Disodium ethylenediaminetetraacetate | 0.5 g |
| Stabilizing solution (also as replenisher) | |
| Hexamethylenetetramine | 5 g |
| Diethylene glycol | 10 g |
| 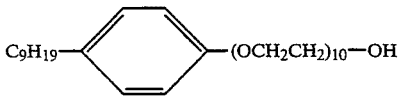 | 1 g |

-continued

| |
|---|
| Adjust pH to 8.0 with KOH. |
| Water to make 1 liter. |

The running processing of the light-sensitive material sample was made in the same manner as in Example 1. The magenta transmission density, measured by green-light, of the unexposed area of the film sample, and at the same time the exposed area's residual amount of silver was determined according to a fluorescent X-ray spectrographic analysis.

The results are collectively shown in Tables 5 and 6.

TABLE 5

| Experiment No. | Organic ferric complex salt | Rate of ammonium ion accounting for of the whole cations in bleaching bath (mol %) | Residual amount of silver (mg/100 cm$^2$) | Magenta transmission density of unexposed area |
|---|---|---|---|---|
| 2-1(comp.) | EDTA.Fe | 100 | 7.6 | 0.57 |
| 2-2(comp.) | " | 60 | 7.7 | 0.57 |
| 2-3(comp.) | " | 50 | 7.8 | 0.56 |
| 2-4(comp.) | " | 30 | 7.9 | 0.56 |
| 2-5(comp.) | " | 10 | 8.0 | 0.56 |
| 2-6(comp.) | " | 0 | 8.1 | 0.56 |
| 2-7(comp.) | PDTA.Fe | 100 | 0 | 0.66 |
| 2-8(comp.) | " | 60 | 0 | 0.64 |
| 2-9(comp.) | " | 50 | 0.1 | 0.63 |
| 2-10(comp.) | " | 30 | 0.1 | 0.62 |
| 2-11(comp.) | " | 10 | 0.2 | 0.61 |
| 2-12(comp.) | " | 0 | 0.3 | 0.60 |
| 2-13(comp.) | DTPA.Fe | 100 | 6.8 | 0.59 |
| 2-14(comp.) | " | 60 | 6.8 | 0.58 |
| 2-15(comp.) | " | 50 | 7.0 | 0.57 |
| 2-16(comp.) | " | 30 | 7.1 | 0.56 |
| 2-17(comp.) | " | 10 | 7.2 | 0.56 |
| 2-18(comp.) | " | 0 | 7.3 | 0.56 |
| 2-19(comp.) | NTA.Fe | 100 | 8.5 | 0.57 |
| 2-20(comp.) | " | 60 | 8.6 | 0.56 |
| 2-21(comp.) | " | 50 | 8.8 | 0.56 |
| 2-22(comp.) | " | 30 | 9.0 | 0.55 |
| 2-23(comp.) | " | 10 | 9.1 | 0.55 |
| 2-24(comp.) | " | 0 | 9.3 | 0.55 |
| 2-25(Inv.) | I-1.Fe | 100 | 0 | 0.58 |
| 2-26(Inv.) | " | 60 | 0 | 0.58 |
| 2-27(Inv.) | " | 50 | 0 | 0.57 |
| 2-28(Inv.) | " | 30 | 0 | 0.56 |
| 2-29(Inv.) | " | 10 | 0.1 | 0.56 |
| 2-30(Inv.) | " | 0 | 0.2 | 0.56 |

TABLE 6

| Experiment No. | Organic ferric complex salt | Rate of ammonium ion accounting for of the whole cations in bleaching bath (mol %) | Residual amount of silver (mg/100 cm$^2$) | Magenta transmission density of unexposed area |
|---|---|---|---|---|
| 2-31(Inv.) | 1-3.Fe | 100 | 0 | 0.58 |
| 2-32(Inv.) | " | 60 | 0 | 0.58 |
| 2-33(Inv.) | " | 50 | 0 | 0.57 |
| 2-34(Inv.) | " | 30 | 0.1 | 0.56 |
| 2-35(Inv.) | " | 10 | 0.1 | 0.56 |
| 2-36(Inv.) | " | 0 | 0.2 | 0.55 |
| 2-37(Inv.) | 1-6.Fe | 100 | 0 | 0.59 |
| 2-38(Inv.) | " | 60 | 0 | 0.58 |
| 2-39(Inv.) | " | 50 | 0 | 0.57 |
| 2-40(Inv.) | " | 30 | 0.1 | 0.56 |
| 2-41(Inv.) | " | 10 | 0.1 | 0.55 |
| 2-42(Inv.) | " | 0 | 0.2 | 0.54 |
| 2-43(Inv.) | 1-8.Fe | 100 | 0.1 | 0.59 |
| 2-44(Inv.) | " | 60 | 0.1 | 0.58 |
| 2-45(Inv.) | " | 50 | 0.1 | 0.57 |
| 2-46(Inv.) | " | 30 | 0.2 | 0.57 |
| 2-47(Inv.) | " | 10 | 0.3 | 0.55 |
| 2-48(Inv.) | " | 0 | 0.4 | 0.55 |
| 2-49(Inv.) | 1-14.Fe | 100 | 0 | 0.59 |
| 2-50(Inv.) | " | 60 | 0 | 0.58 |

TABLE 6-continued

| Experiment No. | Organic ferric complex salt | Rate of ammonium ion accounting for of the whole cations in bleaching bath (mol %) | Residual amount of silver (mg/100 cm$^2$) | Magenta transmission density of unexposed area |
|---|---|---|---|---|
| 2-51(Inv.) | " | 50 | 0 | 0.57 |
| 2-52(Inv.) | " | 30 | 0.1 | 0.56 |
| 2-53(Inv.) | " | 10 | 0.2 | 0.56 |
| 2-54(Inv.) | " | 0 | 0.2 | 0.55 |
| 2-55(Inv.) | 1-20.Fe | 100 | 0 | 0.58 |
| 2-56(Inv.) | " | 60 | 0 | 0.57 |
| 2-57(Inv.) | " | 50 | 0 | 0.56 |
| 2-58(Inv.) | " | 30 | 0.1 | 0.56 |
| 2-59(Inv.) | " | 10 | 0.1 | 0.55 |
| 2-60(Inv.) | " | 0 | 0.2 | 0.54 |

From Tables 5 and 6, it is understood that the samples of the invention, where organic ferric complex salts of the invention were used, show less residual amounts of silver and less rise of the magenta transmission density of the unexposed area than the comparative samples. Further, where the rate of ammonium ions accounting for of the whole cations in the bleach-fix bath is not more than 50 mol %, the above effects become better; when not more than 30 mol %, the effects become far better; and when not more than 10 mol %, the effects become the best.

Example 3

As a photographic processing solution a color developer solution having the following composition was prepared.

| | |
|---|---|
| Potassium carbonate | 30.0 g |
| Sodium hydrogencarbonate | 2.5 g |
| Potassium sulfite | 3.0 g |
| Sodium bromide | 1.3 g |
| Potassium iodide | 1.2 mg |
| Hydroxylamine sulfate | 2.5 g |
| Sodium chloride | 0.6 g |
| 4-Amino-3-methyl-N-ethyl-N-(β-hydroxylethyl)-aniline sulfate | 4.7 g |
| Diethylenetriaminepentaacetic acid | 3.0 g |
| Potassium hydroxide | 1.2 g |
| Water to make one liter. | |
| Adjust pH to 10.00 with potassium hydroxide or sulfuric acid. | |

The above developer solution was designated as Sample A. To Sample A were added 2 g/liter of Exemplified Compound I-1 to prepare Sample B, 2 g/liter of Exemplified Compound I-3 to prepare Sample C, 2 g/liter of Compound I-6 to prepare Sample D, 2 g/liter of Compound I-8 to prepare Sample E, 2 g/liter of Compound I-14 to prepare Sample F, 2 g/liter of Compound I-20 to prepare Sample G, 2 g/liter of sodium hexametaphosphate (abbreviated to HMP) to prepare Sample H, 3.3 g/liter of a 60% solution of 1-hydroxyethylidene-1,1-diphosphonic acid (abbreviated to HEDP) to prepare Sample I, 2 g/liter of ethylenediaminetetraacetic acid (abbreviated to EDTA) to prepare Sample J, and 2 g/liter of nitrilotrimethylenephosphonic acid (abbreviated to NTP) to prepare Sample K, thus preparing eleven developer solution samples.

The pH values of the above samples, since not uniform due to the different compounds added thereto, were all adjusted to 10.0 with use of potassium hydroxide or dilute sulfuric acid, thereby to be ready for the following experiments. The results of the respective experiments are collectively given hereinafter.

Experiment 1

Each of the above developer solution Samples A to K, after adding 1.5 ppm of a ferric ion and 0.7 ppm of a copper ion thereto, was allowed to stand at 35° C. for 7 days, and then subjected to a quantitative analysis of the hydroxylamine to find its attenuation rate. The analysis of hydroxylamine is carried out by the method in which hydroxylamine is converted to hydroxamic acid by the addition of ethyl acetate, and the amount of hydroxamic acid is determined by colorimetry in the form of Fe(III) complex.

Experiment 2

The same light-sensitive material as what was used in Example 2, after being exposed through an optical step-wedge to a white light, was processed in the following color image forming steps by using each of the developer Samples A to K after being allowed to stand for 7 days in Experiment 1.

| Processing step | Time | Temperature |
|---|---|---|
| Color develop | 3 min. 15 sec. | 38° C. |
| Bleach | 45 sec. | 38° C. |
| Fix | 1 min. 30 sec. | 38° C. |
| Stabilize | 50 sec. | 38° C. |
| Dry | 1 min. | 40 to 70° C. |

The compositions of the processing solutions other than the developer used in the above process are as follows:

| Bleaching bath | |
|---|---|
| Ferric ammonium 1,3-propylendiaminetetraacetate | 0.32 mol |
| Disodium ethylenediaminetetraacetate | 10 g |
| Ammonium bromide | 100 g |
| Glacial acetic acid | 40 g |
| Ammonium nitrate | 40 g |
| Water to make one liter. | |
| Adjust pH to 4.4 with ammonia water or glacial acetic acid. | |

Fixing bath and stabilizing bath

The same as those which were used in Example 2.

The above light-sensitive material pieces processed in the above processing solutions including the foregoing developer samples were measured with respect to their unexposed area's reflection densities, measured by blue light, as fog densities by using a PDA65 photoelectric densitometer, manufactured by KONICA Corp.

Experiment 3

Developer Samples A to K, after adding 200 ppm of a calcium ion and 3000 ppm of a sodium ion thereto, were allowed to stand at room temperature for 8 days, and then the precipitated conditions of the developer samples were examined visually.

The results of the above Experiments 1 to 3 are collectively shown in Table 7.

TABLE 7

| Sample No. | Chelating agent (2 g/liter) | (Exp. 1) Hydroxylamine attenunation rate(%) | (Exp. 2) Fog density | (Exp. 3) Precipitated condition |
|---|---|---|---|---|
| A (Comp.) | Not added | 53 | 0.13 | xxx |
| B (Inv.) | I-1 | 12 | 0.01 | ∘ |
| C (Inv.) | I-3 | 14 | 0.01 | ∘ |
| D (Inv.) | I-6 | 14 | 0.02 | ∘ |
| E (Inv.) | I-8 | 17 | 0.03 | ∘ |
| F (Inv.) | I-14 | 15 | 0.02 | ∘ |
| G (Inv.) | I-20 | 15 | 0.02 | ∘ |
| H (Comp.) | HMP | 51 | 0.10 | xx |
| I (Comp.) | HEDP | 34 | 0.03 | xxx |
| J (Comp.) | EDTA | 75 | 0.12 | ∘ |
| K (Comp.) | NTP | 74 | 0.11 | x |

Note: In Experiment 3,
∘: Not precipited at all.
x: Precipited; the number of x marks increases as the precipitate increases.

As is apparent from the above results, the developer Samples B to G for the invention show less decomposition of the hydroxylamine, less fogging and less generation of precipitates attributable to the presence of metallic ions than the comparative samples.

On the other hand, the comparative Sample I is effective to some extent in inhibiting hydroxylamine decomposition and fogging, but not effective at all in preventing the generation of precipitates due to the presence of metallic ions, thus being unacceptable for use.

Further, the comparative Sample J, although effective similarly to the chelating agent used in the invention, accelerates the decomposition of hydroxylamine and causes the light-sensitive material to be badly fogged, so that it can not be used. Samples A, H and K not only decompose the hydroxylamine and bring about fogging but little prevent the generation of precipitates attributable to the presence of metallic ions, thus being unacceptable for practical use.

Example 4

As a photographic processing composition, a first developer solution or black-and-white developer having the following composition for processing reversal film was prepared.

| | |
|---|---|
| Potassium sulfite (50% solution) | 45.0 ml |
| Sodium bromide | 2.0 g |
| Sodium thiocyanate | 1.1 g |
| Potassium iodide | 3.0 mg |
| Diethylene glycol | 20.0 ml |
| 1-Phenyl-3-pyrazolidone (Phenidone) | 0.58 g |
| Hydroquinone | 6.3 g |
| Potassium carbonate | 28.2 g |
| Potassium hydroxide | 2.8 g |
| Water to make one liter. | |

The above prepared developer solution was designated as Sample L. To Sample L were added 2 g/liter of ethylenediaminetetraacetic acid (abbreviated to EDTA) to prepare Sample M, 2 g/liter of Exemplified Compound I-1 to make Sample N, and 2 g/liter of ethylenediaminetetramethylenephosphonic acid (abbreviated to EDTP) to prepare Sample O, thus preparing four different samples. pH of each sample was adjusted to 9.90 with use of potassium hydroxide or 20% sulfuric acid.

Each of the above samples, after adding 2.5 ppm of a ferric ion and 200 ppm of a calcium ion thereto, was allowed to stand at 37° C. for 8 days, and then subjected to quantitative analysis for determination of its Phenidone attenuation rate, and also the precipitated condition in each sample was examined visually. The amount of Phenidone is determined according to the method in which Phenidone is extracted by chloroform, consequently by ferric chloride solution and titrated with a calcium sulfate solution.

The obtained results are shown in Table 8.

TABLE 8

| Sample No. | Chelating agent | Phenidone attenuation rate (%) | Precipitated condition |
|---|---|---|---|
| L (Comp.) | Not added | 40 | xxx |
| M (Comp.) | EDTA | 73 | ∘ |
| N (Inv.) | I-1 | 10 | ∘ |
| O (Comp.) | EDTP | 55 | x |

Note: ∘: Not precipitated at all.
x: Precipitated; the number of x marks increases as the precipitate increases.

From the above results it is apparent that the comparative Sample M, although effective in preventing the generation of precipitate due to the presence of metallic ions, accelerates the decomposition of Phenidone, a developing agent.

On the other hand, the comparative Samples L and O are little or not effective in decomposing Phenidone nor in preventing the generation of precipitate. In contrast, Sample N for the invention, containing the chelating agent, can not only effectively prevent the formation of precipitates but also effectively inhibit decomposition of Phenidone.

Example 5

Fixing and bleach-fix solutions of the following compositions were prepared. Both solutions were used to examine exemplified compounds' effects on the generation of precipitates due to the presence of metallic ions.

| | |
|---|---|
| Fixing solution | |
| Ammonium thiosulfate | 200 g |
| Ammonium sulfite | 20 g |
| Potassium metabisulfite | 5 g |
| Water to make one liter. | |
| Bleach-fix solution | |
| Ferric ammonium ethylenediaminetetraacetate | 65 g |
| Ammonium sulfite (40% solution) | 20 ml |
| Ammonium thiosulfate (70% solution) | 180 ml |
| Ammonia water (28% solution) | 30 ml |
| Water to make one liter. | |

Each of the above fixing and bleach-fix solutions was divided into parts. One as it is for comparison and the rest for preparing 6 different samples by adding thereto 5 g/liter each of Exemplified Compounds I-1, I-3, I-6, I-8, I-14 and I-20. Ammonia water or acetic acid was used to adjust pH of each fixing solution to 6.8 and pH of each bleach-fix solution to 7.1, and then 200 ppm of a calcium ion ($CaCl_2$) were added thereto.

After being allowed to stand for days, both fixing and bleach-fix solution samples for comparison with nothing added thereto, showed conspicuous deposition of precipitates, whereas those containing Exemplified Compounds I-1, I-3, I-6, I-8, I14 and I-20 showed no precipitates at all.

Example 6

A stabilizing solution (also called a washing-substitute stabilizing bath) having the following composition was prepared, and to this was added the bleach-fix solution used in Example 3 in an amount 10% of the stabilizing bath in order to examine its effect on preventing the generation of suspended matter due to sulfurization.

| Stabilizing bath | |
|---|---|
| 5-Chloro-2-methyl-4-isothiazoline-3-one | 0.02 g |
| 2-Methyl-4-isothiazoline-3-one | 0.02 g |
| Ethylene glycol | 1.5 g |
| 2-Octyl-4-isoazoline-3-one | 0.01 g |
| Benzotriazole | 1.2 g |
| Ammonia water (28%) | 3.0 ml |
| Water to make one liter. | |
| Adjust pH to 8.0 with potassium hydroxide or 20% sulfuric acid. | |

The above stabilizing solution, after being in part reserved intact for use as a comparative sample, was used to prepare therefrom test Samples by adding 3.5 g/liter each of Exemplified Compounds I-1, I-3, I-6, I-8, I-14 and I-20, thereby making 6 different samples.

Each stabilizing solution sample, after adjusting its pH to 8.0 with KOH or 20% sulfuric acid and adding 100 ppm of a calcium ion thereto, was allowed to stand for days. As a result, the comparative sample with nothing added thereto was found in 2 days having a precipitate as suspended matter on the surface thereof, whereas the samples containing the Compounds I-1, I-3, I-6, I-8, I-14 and I-20 showed nothing abnormal even after 10 days, and further they were found effective in preventing mold growth.

Example 7

Ethylenediaminetetraacetic acid (EDTA) and diethylenetriaminepentaacetic acid (DTPA), generally known as chelating agents for photographic use, and Exemplified Compounds I-1, I-3 and I-8 were examined for finding their spontaneous decomposabilities in compliance with the 301C amended MITI test (I) in the OECD Chemical Materials testing guideline (adopted May 12, 1981).

The results are shown in Table 9.

TABLE 9

| Chelating agent | Spontaneous decomposition rate (%) |
|---|---|
| EDTA | 4 |
| DTPA | 6 |
| I-1 | 98 |
| I-3 | 96 |
| I-8 | 98 |

As is apparent from Table 9, the chelating agents of the invention are all satisfactory in the spontaneous decomposition, whereas EDTA and DTPA show almost no spontaneous decomposition, so that the chelating agents of the invention are very advantageous from the standpoint of global environment protection.

Example 8

Samples were prepared and evaluated in the same manner as in Example 1 except that the organic ferric complex salt in the bleach-fix solution in Example 1 was replaced by the compounds described in Tables 10 and 11, the adding amount thereof was changed to 0.13 mol, pH of the solution was changed to 7.2, and pH of its replenisher was changed to 6.0, wherein the evaluation was made according to the same criteria as in Example 1.

The results are shown in Tables 10 and 11.

TABLE 10

| Sample No. | Organic ferric complex salt | Rate of ammonium ion accounting for of the whole cations in bleach-fix bath (mol %) | Residual amount of silver (mg/100 cm$^2$) | Edge stain | Sulfurized condition |
|---|---|---|---|---|---|
| 8-1(comp.) | EDTA.Fe | 100 | 0.9 | C | D |
| 8-2(comp.) | " | 60 | 0.9 | C | D |
| 8-3(comp.) | " | 50 | 1.0 | C | D |
| 8-4(comp.) | " | 30 | 1.1 | B | D |
| 8-5(comp.) | " | 10 | 1.1 | B | D |
| 8-6(comp.) | " | 0 | 1.2 | B | D |
| 8-7(comp.) | PDTA.Fe | 100 | 1.7 | C | E |
| 8-8(comp.) | " | 60 | 1.9 | C | E |
| 8-9(comp.) | " | 50 | 1.9 | B | E |
| 8-10(comp.) | " | 30 | 2.0 | B | E |
| 8-11(comp.) | " | 10 | 2.1 | B | E |
| 8-12(comp.) | " | 0 | 2.2 | B | E |
| 8-13(comp.) | DTPA.Fe | 100 | 0 | E | B |
| 8-14(comp.) | " | 60 | 0 | E | B |
| 8-15(comp.) | " | 50 | 0.1 | E | B |
| 8-16(comp.) | " | 30 | 0.2 | E | B |
| 8-17(comp.) | " | 10 | 0.3 | D | B |
| 8-18(comp.) | " | 0 | 0.3 | D | B |
| 8-19(comp.) | NTA.Fe | 100 | 1.4 | C | B |
| 8-20(comp.) | " | 60 | 1.4 | C | B |
| 8-21(comp.) | " | 50 | 1.5 | B | B |
| 8-22(comp.) | " | 30 | 1.6 | B | B |
| 8-23(comp.) | " | 10 | 1.7 | B | B |
| 8-24(comp.) | " | 0 | 1.8 | B | B |
| 8-25(comp.) | NMPDA.Fe | 100 | 0.6 | C | B |
| 8-26(comp.) | " | 60 | 0.6 | C | B |
| 8-27(comp.) | " | 50 | 0.7 | B | B |

TABLE 10-continued

| Sample No. | Organic ferric complex salt | Rate of ammonium ion accounting for of the whole cations in bleach-fix bath (mol %) | Residual amount of silver (mg/100 cm$^2$) | Edge stain | Sulfurized condition |
|---|---|---|---|---|---|
| 8-28(comp.) | " | 30 | 0.8 | B | B |
| 8-29(comp.) | " | 10 | 1.0 | B | B |
| 8-30(comp.) | " | 0 | 1.0 | B | B |

TABLE 11

| Sample No. | Organic ferric complex salt | Rate of ammonium ion accounting for of the whole cations in bleach-fix bath (mol %) | Residual amount of silver (mg/100 cm$^2$) | Edge stain | Sulfurized condition |
|---|---|---|---|---|---|
| 8-31(Inv.) | II-1.Fe | 100 | 0 | C | B |
| 8-32(Inv.) | " | 60 | 0 | C | B |
| 8-33(Inv.) | " | 50 | 0 | B | A |
| 8-34(Inv.) | " | 30 | 0 | B | A |
| 8-35(Inv.) | " | 10 | 0.1 | A | A |
| 8-36(Inv.) | " | 0 | 0.1 | A | A |
| 8-37(Inv.) | II-2.Fe | 100 | 0 | C | B |
| 8-38(Inv.) | " | 60 | 0 | C | B |
| 8-39(Inv.) | " | 50 | 0 | B | A |
| 8-40(Inv.) | " | 30 | 0.1 | B | A |
| 8-41(Inv.) | " | 10 | 0.1 | A | A |
| 8-42(Inv.) | " | 0 | 0.1 | A | A |
| 8-43(Inv.) | II-3.Fe | 100 | 0 | C | B |
| 8-44(Inv.) | " | 60 | 0 | C | B |
| 8-45(Inv.) | " | 50 | 0 | C-B | A |
| 8-46(Inv.) | " | 30 | 0.1 | B | A |
| 8-47(Inv.) | " | 10 | 0.1 | A | A |
| 8-48(Inv.) | " | 0 | 0.2 | A | A |
| 8-49(Inv.) | II-4.Fe | 100 | 0 | C | B |
| 8-50(Inv.) | " | 60 | 0 | C | B |
| 8-51(Inv.) | " | so | 0 | B | A |
| 8-52(Inv.) | " | 30 | 0.1 | B | A |
| 8-53(Inv.) | " | 10 | 0.2 | A | A |
| 8-54(Inv.) | " | 0 | 0.2 | A | A |
| 8-55(Inv.) | II-11.Fe | 100 | 0 | C | B |
| 8-56(Inv.) | " | 60 | 0 | C | B |
| 8-57(Inv.) | " | 50 | 0 | C-B | A |
| 8-58(Inv.) | " | 30 | 0.1 | B | A |
| 8-59(Inv.) | " | 10 | 0.1 | A | A |
| 8-60(Inv.) | " | 0 | 0.1 | A | A |
| 8-61(Inv.) | II-12.Fe | 100 | 0 | C | B |
| 8-62(Inv.) | " | 60 | 0 | C | B |
| 8-63(Inv.) | " | 50 | 0 | B | A |
| 8-64(Inv.) | " | 30 | 0 | B | A |
| 8-65(Inv.) | " | 10 | 0.1 | A | A |
| 8-66(Inv.) | " | 0 | 0.1 | A | A |

In Tables 10 and 11 and the following tables, EDTA.Fe stands for ferric complex salt of ethylenediaminetetraacetic acid, PDTA.Fe for ferric complex salt of 1,3-propylenediaminetetraacetic acid, DTPA.Fe for ferric complex salt of diethylenetriaminepentaacetic acid, NTA.Fe for ferric complex salt of nitrilotriacetic acid, NMPDA.Fe for ferric complex salt of nitrilomonopropionic-diacetic acid, II-1.Fe for ferric complex salt of Exemplified Compound II-1, II-2.Fe for ferric complex salt of Exemplified Compound II-2, and II-3.Fe for ferric complex salt of Exemplified Compound II-3, and others likewise.

From Tables 10 and 11, it is understood that the samples of the invention, where organic ferric complex salts of the invention were used, show less residual amounts of silver, less edge stain and better storage stability of the bleach-fix solution than the comparative samples. Further, where the rate of ammonium ions accounting for of the whole cations in the bleach-fix bath is not more than 50 mol %, the above effects become better; when not more than 30 mol %, the effects become far better; and when not more than 10 mol %, the effects become the best. The pH of the bleach-fix bath in the above experiments is 7.0; in this pH level, NMPDA.Fe is so poor in the oxidation power as to cause desalting failure.

Samples were prepared and evaluated in the same manner as in Example 2 except that the organic ferric complex salt in the bleach-fix bath in Example 2 was replaced by the compounds described in Tables 12 and 13, and the adding amount thereof was changed to 0.36 mol, and the amount of glacial acetic acid was changed to 27 ml.

The results are shown in Tables 12 and 13.

TABLE 12

| Experiment No. | Organic ferric complex salt | Rate of ammonium ion accounting for of the whole cations in bleaching bath (mol %) | Residual amount of silver (mg/100 cm$^2$) | Magenta transmission density of unexposed area |
|---|---|---|---|---|
| 9-1(comp.) | EDTA.Fe | 100 | 7.5 | 0.57 |
| 9-2(comp.) | " | 60 | 7.7 | 0.57 |
| 9-3(comp.) | " | 50 | 7.9 | 0.56 |
| 9-4(comp.) | " | 30 | 7.9 | 0.56 |
| 9-5(comp.) | " | 10 | 8.0 | 0.56 |
| 9-6(comp.) | " | 0 | 8.1 | 0.56 |
| 9-7(comp.) | PDTA.Fe | 100 | 0 | 0.67 |
| 9-8(comp.) | " | 60 | 0 | 0.65 |
| 9-9(comp.) | " | 50 | 0.1 | 0.63 |
| 9-10(comp.) | " | 30 | 0.1 | 0.63 |
| 9-11(comp.) | " | 10 | 0.2 | 0.61 |
| 9-12(comp.) | " | 0 | 0.2 | 0.61 |
| 9-13(comp.) | DTPA.Fe | 100 | 6.9 | 0.58 |
| 9-14(comp.) | " | 60 | 6.9 | 0.58 |
| 9-15(comp.) | " | 50 | 7.1 | 0.57 |
| 9-16(comp.) | " | 30 | 7.2 | 0.56 |
| 9-17(comp.) | " | 10 | 7.3 | 0.56 |
| 9-18(comp.) | " | 0 | 7.3 | 0.56 |
| 9-19(comp.) | NTA.Fe | 100 | 8.7 | 0.57 |
| 9-20(comp.) | " | 60 | 8.8 | 0.56 |
| 9-21(comp.) | " | 50 | 8.8 | 0.56 |
| 9-22(comp.) | " | 30 | 9.0 | 0.55 |
| 9-23(comp.) | " | 10 | 9.1 | 0.55 |
| 9-24(comp.) | " | 0 | 9.3 | 0.55 |
| 9-25(comp.) | NMPDA.Fe | 100 | 1.5 | 0.70 |
| 9-26(comp.) | " | 60 | 1.6 | 0.69 |
| 9-27(comp.) | " | 50 | 1.6 | 0.69 |
| 9-28(comp.) | " | 30 | 1.8 | 0.67 |
| 9-29(comp.) | " | 10 | 1.9 | 0.66 |
| 9-30(comp.) | " | 0 | 2.0 | 0.65 |

TABLE 13

| Experiment No. | Organic ferric complex salt | Rate of ammonium ion accounting for of the whole cations in bleaching bath (mol %) | Residual amount of silver (mg/100 cm$^2$) | Magenta transmission density of unexposed area |
|---|---|---|---|---|
| 9-31(Inv.) | II-1.Fe | 100 | 0 | 0.58 |
| 9-32(Inv.) | " | 60 | 0 | 0.57 |
| 9-33(Inv.) | " | 50 | 0 | 0.57 |
| 9-34(Inv.) | " | 30 | 0 | 0.56 |
| 9-35(Inv.) | " | 10 | 0.1 | 0.56 |
| 9-36(Inv.) | " | 0 | 0.1 | 0.55 |
| 9-37(Inv.) | II-2.Fe | 100 | 0 | 0.59 |
| 9-38(Inv.) | " | 60 | 0 | 0.57 |
| 9-39(Inv.) | " | so | 0 | 0.57 |
| 9-40(Inv.) | " | 30 | 0 | 0.56 |
| 9-41(Inv.) | " | 10 | 0.1 | 0.56 |
| 9-42(Inv.) | " | 0 | 0.1 | 0.55 |
| 9-43(Inv.) | II-3.Fe | 100 | 0 | 0.58 |
| 9-44(Inv.) | " | 60 | 0 | 0.57 |
| 9-45(Inv.) | " | so | 0 | 0.57 |
| 9-46(Inv.) | " | 30 | 0.1 | 0.56 |
| 9-47(Inv.) | " | 10 | 0.1 | 0.56 |
| 9-48(Inv.) | " | 0 | 0.2 | 0.55 |
| 9-49(Inv.) | II-4.Fe | 100 | 0 | 0.58 |
| 9-50(Inv.) | " | 60 | 0 | 0.57 |
| 9-51(Inv.) | " | 50 | 0.1 | 0.56 |
| 9-52(Inv.) | " | 30 | 0.1 | 0.56 |
| 9-53(Inv.) | " | 10 | 0.2 | 0.56 |
| 9-54(Inv.) | " | 0 | 0.2 | 0.55 |
| 9-55(Inv.) | II-11.Fe | 100 | 0 | 0.59 |
| 9-56(Inv.) | " | 60 | 0 | 0.57 |
| 9-57(Inv.) | " | 50 | 0 | 0.57 |
| 9-58(Inv.) | " | 30 | 0.1 | 0.56 |
| 9-59(Inv.) | " | 10 | 0.1 | 0.56 |
| 9-60(Inv.) | " | 0 | 0.2 | 0.55 |
| 9-61(Inv.) | II-12.Fe | 100 | 0 | 0.58 |
| 9-62(Inv.) | " | 60 | 0 | 0.57 |
| 9-63(Inv.) | " | 50 | 0 | 0.56 |
| 9-64(Inv.) | " | 30 | 0 | 0.56 |
| 9-65(Inv.) | " | 10 | 0.1 | 0.55 |
| 9-66(Inv.) | " | 0 | 0.1 | 0.54 |

From Tables 12 and 13, it is understood that the samples of the invention, in which organic ferric complex salts of the invention were used, show less residual amounts of silver and less rise of the magenta transmission density of the unexposed area than the comparative samples. Further, where the rate of ammonium ions accounting for of the whole cations in the bleach-fix bath is not more than 50 mol %, the above effects become better; when not more than 30 mol %, the effects become far better; and when not more than 10 mol %, the effects become the best. The use of NMPDA.Fe as a bleaching agent is unfavorable because it leaves bleaching stain marks on the processed light-sensitive material.

Example 10

As a photographic processing solution a color developer solution having the following composition was prepared.

| | |
|---|---|
| Potassium carbonate | 30.0 g |
| Sodium hydrogencarbonate | 2.5 g |
| Potassium sulfite | 3.0 g |
| Sodium bromide | 1.3 g |
| Potassium iodide | 1.2 mg |
| Hydroxylamine sulfate | 3.0 g |
| Sodium chloride | 0.6 g |
| 4-Amino-3-methyl-N-ethyl-N-(β-hydroxylethyl)-aniline sulfate | 4.6 g |
| Diethylenetriaminepentaacetic acid | 3.0 g |
| Potassium hydroxide | 1.2 g |
| Water to make one liter. | |
| Adjust Ph to 10.00 with use of potassium hydroxide or 20% sulfuric acid. | |

The above developer was designated as Sample A. To Sample A were added 2 g/liter of the foregoing Exemplified Compound II-1 to prepare Sample B, 2 g/liter of Compound II-2 to prepare Sample C, Compound II-3 to prepare Sample D, 2 g/liter of Compound II-4 to prepare Sample E, 2 g/liter of Compound II-11 to prepare Sample F, 2 g/liter of Compound II-12 to prepare Sample G, 2 g/liter of sodium hexametaphosphate (HMP) to prepare Sample H, 3.3 g/liter of a 60% solution of 1-hydroxyethylidene-1,1-diphosphonic acid (HEDP) to prepare Sample I, 2 g/liter of ethylenediaminetetraacetic acid (EDTA) to prepare Sample J, and 2 g/liter of trinitrotrimethylenephosphonic acid (NTP) to prepare Sample K, thus preparing eleven different samples.

The pH values of the above samples, since not uniform due to the different compounds added thereto, were all adjusted to 10.2 with use of potassium hydroxide or dilute sulfuric acid to be made ready for the following experiments. The results are shown collectively hereinafter.

Experiment 1

Each of the above developer Samples A to K, after adding 1.5 ppm of a ferric ion and 0.6 ppm of a copper ion thereto, was allowed to stand at 35° C. for 8 days, and then subjected to a quantitative analysis of the hydroxylamine to thereby obtain its attenuated rate.

Experiment 2

The same light-sensitive material as what was used in Example 2, after being exposed through a stepwedge to white light, was processed by using the developer Samples A to K separately that were allowed to stand for 8 days in Experiment 1 in accordance with the following color-forming processing steps.

| Processing step | Time | Temperature |
|---|---|---|
| Color develop | 3 min. 15 sec. | 38° C. |
| Bleach | 45 seconds | 38° C. |
| Fix | 1 min. 30 sec. | 38° C. |
| Stabilize | 50 seconds | 38° C. |
| Dry | 1 minute | 40 to 70° C. |

The compositions of the processing solutions used in the above processing steps are as follows:

| Bleaching solution | |
|---|---|
| Ferric ammonium 1,3-propylenediaminetetra-acetate | 0.32 mol |
| Disodium ethylenediaminetetraacetate | 10 g |
| Ammonium bromide | 100 g |
| Glacial acetic acid | 40 g |
| Ammonium nitrate | 40 g |
| Water to make one liter. | |
| Adjust pH to 4.4 with use of ammonia water or glacial acetic acid. | |

Fixing solution, stabilizing solution

The same as those used in Example 2.

Each of the light-sensitive material pieces processed in the above processing baths including the above developer samples was measured with respect to its unexposed area's fog density in the form of a reflection density by means of a PDA-65 photoelectric densitometer using a blue light, manufactured by KONICA Corp.

Experiment 3

Each of the developer Samples A to K, after adding 200 ppm of a calcium ion and 3200 ppm of a sodium ion thereto, was allowed to stand at room temperature for 6 days, and then the precipited condition thereof was examined visually.

The results of the above Experiments 1 to 3 are collectively shown in Tables 14.

TABLE 14

| Sample No. | Chelating agent (2 g/liter) | (Exp. 1) Hydroxylamine attenunation rate (%) | (Exp. 2) Fog density | (Exp. 3) Precipitated condition |
|---|---|---|---|---|
| A (Comp.) | Not added | 55 | 0.14 | xxx |
| B (Inv.) | II-1 | 11 | 0.01 | ○ |
| C (Inv.) | II-2 | 13 | 0.01 | ○ |
| D (Inv.) | II-3 | 14 | 0.02 | ○ |
| E (Inv.) | II-4 | 16 | 0.02 | ○ |
| F (Inv.) | II-11 | 14 | 0.01 | ○ |
| G (Inv.) | II-12 | 12 | 0.01 | ○ |
| H (Comp.) | HMP | 53 | 0.10 | xx |
| I (Comp.) | HEDP | 36 | 0.05 | xxx |
| J (Comp.) | EDTA | 72 | 0.14 | ○ |
| K (Comp.) | NTP | 73 | 0.12 | x |

Note: In Experiment 3,
○: Not precipitated at all.
x: Precipitated; the number of x marks increases as the precipitate increases.

From the above results, it is apparent that the developer Samples B to G for the invention show less decomposition of the hydroxylamine, less fog, and less generation of the precipitate due to the presence of metallic ions than the comparative samples.

On the other hand, the comparative Sample I, although effective to some extent to prevent the hydroxylamine from decomposition and also to prevent fogging, has no preventive effect at all upon the precipitation due to the presence of metallic ions, thus being unacceptable for practical use.

The comparative Sample J is effective similarly to the chelating agent of the invention in preventing the formation of a precipitate, but is unacceptable for practical use because it accelerates the decomposition of the hydroxylamine to cause the light-sensitive material to be badly fogged. Samples A, H and K also decompose the hydroxylamine to cause the light-sensitive material to be fogged, and besides, they are weak in preventing the precipitate formation due to the presence of metallic ions, and therefore unacceptable for practical use.

Example 11

As a photographic processing composition a first developer solution (black-and-white developer) for reversal film having the following composition was prepared.

| | |
|---|---|
| Potassium sulfite (50% solution) | 45.0 ml |
| Sodium bromide | 2.0 g |
| Sodium thiocyanate | 1.1 g |
| Potassium iodide | 3.0 mg |
| Diethylene glycol | 20.0 mg |
| 1-Phenyl-3-pyrazolidone (trade name: Phenidone) | 0.58 g |
| Hydroquinone | 6.2 g |
| Potassium carbonate | 28.2 g |
| Potassium hydroxide | 2.8 g |
| Water to make one liter. | |

The above developer solution was designated as Sample L. To Sample L were added 2 g/liter of ethylenediaminetetraacetic acid (EDTA) to prepare Sample M, 2 g/liter of Exemplified Compound II-1 to prepare Sample N, and 2 g/liter of ethylenediaminetetramethylenephosphonic acid (EDTP) to prepare Sample O, thus preparing four different samples. Potassium hydroxide or 20% sulfuric acid was used to adjust pH of each sample to 9.90.

Each of the above samples, after adding 3.0 ppm of a ferric ion and 200 ppm of a calcium ion thereto, was allowed to stand at 35° C. for 8 days, and then subjected to a quantitative analysis of the Phenidone to determine its attenuation rate, and its precipitated condition was examined visually.

The obtained results are shown in Table 15.

TABLE 15

| Sample No. | Chelating agent | Phenidone attenuation rate (%) | Precipitated condition |
|---|---|---|---|
| L (Comp.) | Not added | 39 | xxx |
| M (Comp.) | EDTA | 72 | ∘ |
| N (Inv.) | II-1 | 9 | ∘ |
| O (Comp.) | EDTP | 53 | x |

Not: In the above table,
∘: Not precipitated at all.
x: Precipitated; the number of x marks increases as the precipitate increases.

As is apparent from the above table, the comparative Sample M effectively prevents the precipitate formation caused by the presence of metallic ions, but accelerates the decomposition of Phenidone, a developing agent.

On the other hand, the comparative Samples L and O little or not decompose Phenidone and are not so effective in preventing the generation of a precipitate. In contrast, Sample N, which contains the chelating agent of the invention, is capable of not only effectively preventing the formation of a precipitate but also well inhibiting the Phenidone from decomposing.

Example 12

Fixing and bleach-fix solutions of the following compositions were prepared for examining the effects of the exemplified compounds on preventing the precipitate formation caused by the presence of metallic ions.

| | |
|---|---|
| Fixing solution | |
| Ammonium thiosulfate | 200 g |
| Ammonium sulfite | 20 g |
| Potassium metabisulfite | 5 g |
| Water to make one liter. | |
| Bleach-fix solution | |
| Ferric ammonium ethylenediaminetetraacetate | 60 g |
| Ammonium sulfite (40% solution) | 20 ml |
| Ammonium thiosulfate (70% solution) | 180 ml |
| Ammonia water (28% solution) | 30 ml |
| Water to make one liter. | |

Each of the above fixing and bleach-fix solutions was divided into parts; one as it is for comparison and the rest for preparing 6 different samples by adding thereto 4 g/liter each of Exemplified Compounds II-1, II-2, II-3, II-4, II-11 and II-12. Ammonia water or acetic acid was used to adjust pH of each prepared fixing solution sample to 6.8 and pH of each bleach-fix solution sample to 7.1, and then 200 ppm of a calcium ion was added thereto.

After being allowed to stand for days, both the fixing and bleach-fix solutions for comparison generated precipitates conspicuously, whereas those prepared by adding Exemplified Compounds II-1, II-2, II-3, II-4, II-11 and II-12 showed no precipitates at all.

Example 13

A stabilizing solution (also called a washing-substitute stabilizing solution) of the following composition was prepared, and to this the bleach-fix solution in Example 3 was added in an amount 10% thereof in order to examine its effect of preventing the suspended matter caused by sulfurization.

| Stabilizing solution | |
|---|---|
| 5-Chloro-2-methyl-4-isothiazoline-3-one | 0.02 g |
| 2-Methyl-4-isothiazoline-3-one | 0.02 g |
| Ethylene glycol | 1.5 g |
| 2-Octyl-4-isothiazoline-3-one | 0.01 g |
| Benzotriazole | 1.2 g |
| Ammonia water (28%) | 3.0 ml |
| Water to make one liter. | |
| Adjust pH to 8.0 with potassium hydroxide or 20% sulfuric acid. | |

The above stabilizing solution was divided into parts; one as it is for comparison and the rest for preparing 6 different samples by adding thereto 3 g/liter each of Exemplified Compounds II-1, II-2, II-3, II-4, II-11 and II-12.

Potassium hydroxide or 20% sulfuric acid was used to adjust pH of each stabilizing solution sample to 8.0. Each of the samples, after adding 100 ppm of a calcium ion thereto, was allowed to stand for days. As a result, the comparative solution with nothing added thereto was found in two days having a precipitate appearing as suspended matter on the surface thereof, whereas those prepared by adding Exemplified-Compounds II-1, II-2, II-3, II-4, II-11 and II-12 showed no abnormality even after 10 days, and also were found effective in preventing mold growth.

Example 14

Ethylenediaminetetraacetic acid (EDTA) and diethylenetriaminepentaacetic acid (DTPA), generally known as chelating agents for photographic use, and Exemplified Compounds II-1, II-2 and II-12 were examined to find their spontaneous decomposabilities in compliance with the 301C amended MITI test (I) in the OECD Chemical Materials testing guideline (adopted May 12, 1981).

The results are shown in Table 16.

TABLE 16

| Chelating agent | Spontaneous decomposition rate (%) |
|---|---|
| EDTA | 3 |
| DTPA | 7 |
| II-1 | 97 |
| II-2 | 98 |
| II-12 | 95 |

As is apparent from Table 16, the chelating agents of the invention are very satisfactory in the spontaneous decomposition, whereas EDTA and DTPA show almost no spontaneous decomposition, so that the chelating agents of the invention are very favorable from the global environment protection point of view.

Example 15

Samples were prepared and evaluated in the same manner as in Example 1 except that the added amount of the triethanolamine to the color developer solution in Example 1 was changed to 8.0 g, the added amount of the potassium sulfite was changed to $6\times10^{-4}$ mol, that of the triethanolamine in the color developer replenisher was changed to 12.0 g, the organic ferric complex salt in the bleach-fix solution was replaced by the compounds given in Tables 16 and 17 and their added amount was changed to 0.19 mol, the pH values of the bleach-fix solution and the bleach-fix replenisher were changed to 6.8 and 5.7, respectively, and the added amount of the 1-hydroxyethylidene1,1-diphosphonic acid (60% solution) to the stabilizing solution and the stabilizing bath replenisher was changed to 1.5 g. The evaluation criteria also is the same as in Example 1.

TABLE 17

| Sample No. | Organic ferric complex salt | Rate (mol %) of ammonium ion accounting for of the whole cations in the bleach-fix bath | Amount of residual silver (mg/100 cm$^2$) | Edge stain | Sulfurated condition |
|---|---|---|---|---|---|
| 15-1(Comp.) | EDTA.Fe | 100 | 0.6 | C | D |
| 15-2(Comp.) | " | 60 | 0.7 | C | D |
| 15-3(Comp.) | " | 50 | 0.8 | C | D |
| 15-4(Comp.) | " | 30 | 0.9 | B | D |
| 15-5(Comp.) | " | 10 | 0.9 | B | D |
| 15-6(Comp.) | " | 0 | 1.0 | B | D |
| 15-7(Comp.) | PDTA.Fe | 100 | 1.7 | C | E |
| 15-8(Comp.) | " | 60 | 1.7 | C | E |
| 15-9(Comp.) | " | 50 | 1.8 | B | E |
| 15-10(Comp.) | " | 30 | 1.8 | B | E |
| 15-11(Comp.) | " | 10 | 1.9 | B | E |
| 15-12(Comp.) | " | 0 | 1.9 | B | E |
| 15-13(Comp.) | DTPA.Fe | 100 | 0 | E | B |
| 15-14(Comp.) | " | 60 | 0 | E | B |
| 15-15(Comp.) | " | 50 | 0 | E | B |
| 15-16(Comp.) | " | 30 | 0.1 | E | B |
| 15-17(Comp.) | " | 10 | 0.1 | D | B |
| 15-18(Comp.) | " | 0 | 0.2 | D | B |
| 15-19(Comp.) | NTA.Fe | 100 | 1.2 | C | D |
| 15-20(Comp.) | " | 60 | 1.3 | C | D |
| 15-21(Comp.) | " | 50 | 1.4 | B | D |
| 15-22(Comp.) | " | 30 | 1.4 | B | D |
| 15-23(Comp.) | " | 10 | 1.7 | B | D |
| 15-24(Comp.) | " | 0 | 1.8 | B | D |
| 15-25(Inv.) | III-1.Fe | 100 | 0 | C | B |
| 15-26(Inv.) | " | 60 | 0 | C | B |
| 15-27(Inv.) | " | 50 | 0 | B | A |
| 15-28(Inv.) | " | 30 | 0 | B | A |
| 15-29(Inv.) | " | 10 | 0.1 | A | A |
| 15-30(Inv.) | " | 0 | 0.1 | A | A |

TABLE 18

| Sample No. | Organic ferric complex salt | Rate (mol %) of ammonium ion accounting for of the whole cations in the bleach-fix bath | Amount of residual silver (mg/100 cm$^2$) | Edge stain | Sulfurated condition |
|---|---|---|---|---|---|
| 15-31(Inv.) | III-4.Fe | 100 | 0 | C | B |
| 15-32(Inv.) | " | 60 | 0 | C | B |
| 15-33(Inv.) | " | 50 | 0 | B | A |
| 15-34(Inv.) | " | 30 | 0.1 | B | A |
| 15-35(Inv.) | " | 10 | 0.2 | A | A |
| 15-36(Inv.) | " | 0 | 0.2 | A | A |
| 15-37(Inv.) | III-7.Fe | 100 | 0 | C | B |

TABLE 18-continued

| Sample No. | Organic ferric complex salt | Rate (mol %) of ammonium ion accounting for of the whole cations in the bleach-fix bath | Amount of residual silver (mg/100 cm$^2$) | Edge stain | Sulfurated condition |
|---|---|---|---|---|---|
| 15-38(Inv.) | " | 60 | 0 | C | A |
| 15-39(Inv.) | " | 50 | 0.1 | B | A |
| 15-40(Inv.) | " | 30 | 0.1 | B | A |
| 15-41(Inv.) | " | 10 | 0.2 | A | A |
| 15-42(Inv.) | " | 0 | 0.2 | A | A |
| 15-43(Inv.) | IV-1.Fe | 100 | 0 | C | B |
| 15-44(Inv.) | " | 60 | 0 | C | B |
| 15-45(Inv.) | " | 50 | 0.1 | B-C | B |
| 15-46(Inv.) | " | 30 | 0.1 | B | A |
| 15-47(Inv.) | " | 10 | 0.2 | A | A |
| 15-48(Inv.) | " | 0 | 0.4 | A | A |
| 15-49(Inv.) | IV-7.Fe | 100 | 0 | C | B |
| 15-50(Inv.) | " | 60 | 0 | C | A |
| 15-51(Inv.) | " | 50 | 0.1 | B-C | A |
| 15-52(Inv.) | " | 30 | 0.2 | B | A |
| 15-53(Inv.) | " | 10 | 0.2 | A | A |
| 15-54(Inv.) | " | 0 | 0.3 | A | A |
| 15-55(Inv.) | IV-16.Fe | 100 | 0 | C | B |
| 15-56(Inv.) | " | 60 | 0 | C | B |
| 15-57(Inv.) | " | 50 | 0.1 | B | B |
| 15-58(Inv.) | " | 30 | 0.1 | B | A |
| 15-59(Inv.) | " | 10 | 0.2 | A | A |
| 15-60(Inv.) | " | 0 | 0.2 | A | A |

In Tables 17 and 18 and the following tables, EDTA.Fe stands for ferric complex salt of ethylenediaminetetraacetic acid, PDTA.Fe for ferric complex salt of 1,3-propylenediaminetetraacetic acid, DTPA.Fe for ferric complex salt of diethylenetriaminepentaacetic acid, NTA.Fe for ferric complex salt of nitrilotriacetic acid, III-1.Fe for ferric complex salt of Exemplified Compound III-1, III-4.Fe for ferric complex salt of Exemplified Compound III-4, and the others for ferric complex salts of corresponding compounds likewise.

From Tables 17 and 18, it is apparent that the samples of the invention, where organic ferric complex salts of the invention were used, show less amounts of residual silver, less edge stain and better storage stability of the bleach-fix solution than the comparative samples. Further, where the rate of ammonium ions accounting for of the whole cations in the bleach-fix solution is not more than 50 mol %, the above effects become better; when not more than 30 mol %, the above effects become far better; and when not more than 10 mol %, the effects become the best.

Example 16

Samples were prepared and evaluated in the same manner as in Example 2 except that the added amount of the hydroxylamine sulfate in the color developer solution was changed to 2.4 g, that of the hydroxylamine sulfate in the color developer replenisher was changed to 3.4 g, the organic ferric complex salt in the bleaching bath was replaced by the compounds described in Tables 19 and 20 and the added amount thereof was changed to 0.37 mol, the added amount of the ethylenediaminetetraacetic acid was changed to 3 g, that of the bromide was changed to 1.0 mol, that of the glacial acetic acid was changed to 25 ml, and pH of the bleaching bath replenisher was adjusted to 3.7.

The results are shown in Tables 19 and 20.

TABLE 19

| Sample No | Organic ferric complex salt | Rate (mol %) of ammonium ion accounting for of the whole cations in the bleach-fix bath | Amount of residual silver (mg/100 cm$^2$) | Unexposed area's magenta transmission density |
|---|---|---|---|---|
| 16-1(Comp.) | EDTA.Fe | 100 | 7.2 | 0.57 |
| 16-2(Comp.) | " | 60 | 7.2 | 0.57 |
| 16-3(Comp.) | " | 50 | 7.2 | 0.57 |
| 16-4(Comp.) | " | 30 | 7.5 | 0.57 |
| 16-5(Comp.) | " | 10 | 7.6 | 0.56 |
| 16-6(Comp.) | " | 0 | 7.8 | 0.56 |
| 16-7(Comp.) | PDTA.Fe | 100 | 0 | 0.69 |
| 16-8(Comp.) | " | 60 | 0 | 0.65 |
| 16-9(Comp.) | " | so | 0.1 | 0.64 |
| 16-10(Comp.) | " | 30 | 0.1 | 0.63 |
| 16-11(Comp.) | " | 10 | 0.2 | 0.62 |
| 16-12(Comp.) | " | 0 | 0.2 | 0.62 |
| 16-13(Comp.) | DTPA.Fe | 100 | 6.5 | 0.59 |
| 16-14(Comp.) | " | 60 | 6.5 | 0.58 |
| 16-15(Comp.) | " | 50 | 6.7 | 0.57 |
| 16-16(Comp.) | " | 30 | 9.9 | 0.57 |
| 16-17(Comp.) | " | 10 | 6.9 | 0.56 |
| 16-18(Comp.) | " | 0 | 7.0 | 0.56 |
| 16-19(Comp.) | NTA.Fe | 100 | 8.3 | 0.57 |
| 16-20(Comp.) | " | 60 | 8.4 | 0.57 |
| 16-21(Comp.) | " | 50 | 8.5 | 0.56 |

TABLE 19-continued

| Sample No | Organic ferric complex salt | Rate (mol %) of ammonium ion accounting for of the whole cations in the bleach-fix bath | Amount of residual silver (mg/100 cm$^2$) | Unexposed area's magenta transmission density |
|---|---|---|---|---|
| 16-22(Comp.) | " | 30 | 8.7 | 0.56 |
| 16-23(Comp.) | " | 10 | 9.1 | 0.55 |
| 16-24(Comp.) | " | 0 | 9.1 | 0.53 |
| 16-25(Inv.) | III-1.Fe | 100 | 0 | 0.58 |
| 16-26(Inv.) | " | 60 | 0 | 0.58 |
| 16-27(Inv.) | " | 50 | 0 | 0.57 |
| 16-28(Inv.) | " | 30 | 0 | 0.57 |
| 16-29(Inv.) | " | 10 | 0.1 | 0.56 |
| 16-30(Inv.) | " | 0 | 0.1 | 0.55 |

TABLE 20

| Sample No | Organic ferric complex salt | Rate (mol %) of ammonium ion accounting for of the whole cations in the bleach-fix bath | Amount of residual silver (mg/100 cm$^2$) | Unexposed area's magenta transmission density |
|---|---|---|---|---|
| 16-31(Inv.) | III-6.Fe | 100 | 0 | 0.58 |
| 16-32(Inv.) | " | 60 | 0 | 0.57 |
| 16-33(Inv.) | " | 50 | 0 | 0.57 |
| 16-34(Inv.) | " | 30 | 0 | 0.56 |
| 16-35(Inv.) | " | 10 | 0.1 | 0.56 |
| 16-36(Inv.) | " | 0 | 0.1 | 0.55 |
| 16-37(Inv.) | III-11.Fe | 100 | 0 | 0.58 |
| 16-38(Inv.) | " | 60 | 0 | 0.57 |
| 16-39(Inv.) | " | 50 | 0 | 0.57 |
| 16-40(Inv.) | " | 30 | 0.1 | 0.57 |
| 16-41(Inv.) | " | 10 | 0.2 | 0.56 |
| 16-42(Inv.) | " | 0 | 0.2 | 0.55 |
| 16-43(Inv.) | IV-1.Fe | 100 | 0 | 0.58 |
| 16-44(Inv.) | " | 60 | 0 | 0.57 |
| 16-45(Inv.) | " | 50 | 0 | 0.55 |
| 16-46(Inv.) | " | 30 | 0.1 | 0.55 |
| 16-47(Inv.) | " | 10 | 0.1 | 0.55 |
| 16-48(Inv.) | " | 0 | 0.2 | 0.54 |
| 16-49(Inv.) | IV-16.Fe | 100 | 0 | 0.57 |
| 16-50(Inv.) | " | 60 | 0 | 0.57 |
| 16-51(Inv.) | " | 50 | 0 | 0.57 |
| 16-52(Inv.) | " | 30 | 0.1 | 0.56 |
| 16-53(Inv.) | " | 10 | 0.2 | 0.56 |
| 16-54(Inv.) | " | 0 | 0.2 | 0.55 |
| 16-55(Inv.) | IV-18.Fe | 100 | 0 | 0.58 |
| 16-56(Inv.) | " | 60 | 0 | 0.57 |
| 16-57(Inv.) | " | 50 | 0 | 0.57 |
| 16-58(Inv.) | " | 30 | 0.1 | 0.56 |
| 16-59(Inv.) | " | 10 | 0.1 | 0.55 |
| 16-60(Inv.) | " | 0 | 0.2 | 0.55 |

From Tables 19 and 20, it is understood that the samples of the invention, where organic ferric complex salts of the invention were used, show less amounts of residual silver and less rise of the magenta transmission density of the unexposed area than the comparative samples. Further, where the rate of ammonium ions accounting for of the whole cations in the bleaching solution is not more than 50 mol %, the above effects become better; when not more than 30 mol %, the above effects become far better; and when not more than 10 mol %, the effects become the best.

Example 17

Color developer solution samples of the following compositions were prepared.

| | |
|---|---|
| Potassium carbonate | 30.0 g |
| Sodium hydrogencarbonate | 2.5 g |
| Potassium sulfite | 3.0 g |
| Sodium bromide | 1.3 g |
| Potassium iodide | 1.2 mg |

-continued

| | |
|---|---|
| Hydroxylamine sulfate | 2.5 g |
| Sodium chloride | 0.6 g |
| 4-Amino-3-methyl-N-ethyl-N-(β-hydroxylethyl)-aniline sulfate | 4.5 g |
| Diethylenetriaminepentaacetic acid | 3.0 g |
| Potassium hydroxide | 1.2 g |
| Chelating agent (described in Table 21) | 2.0 g |
| Water to make one liter. | |

The above solution, after adjusting its pH to 10.05 with potassium hydroxide or 20% sulfuric acid, was used for the following experiments.

Experiment 1

Each of the above developer Samples 17-1 to 17-11, after adding 1.5 ppm of a ferric ion and 0.7 ppm of a copper ion thereto, was allowed to stand at 33° C. for 10 days, and then was subjected to a quantitative analysis of the hydroxylamine to determine its attenuation rate.

Experiment 2

The same light-sensitive material as what was used in Example 2, after being exposed through a stepwedge to a white light, was processed, using the developer solution Samples 17-1 to 17-11 aged for 10 days in the above Experiment 1, according to the following processing steps:

| Processing step | Time | Temperature |
|---|---|---|
| Color develop | 3 min. 15 sec. | 38° C. |
| Bleach | 45 seconds | 38° C. |
| Fix | 1 min. 30 sec. | 38° C. |
| Stabilize | 50 seconds | 38° C. |
| Dry | 1 minute | 40 to 70° C. |

The compositions of the solutions used in the above processing steps are as follows:

| Bleaching solution | |
|---|---|
| Ferric ammonium 1,3-propylenediaminetetra-acetate | 0.32 mol |
| Disodium ethylenediaminetetraacetate | 10 g |
| Ammonium bromide | 100 g |
| Glacial acetic acid | 40 g |
| Ammonium nitrate | 40 g |
| Water to make one liter. | |
| Adjust pH to 4.4 with ammonia water or glacial acetic acid. | |

Fixing solution, stabilizing solution

The same as those used in Example 2.

Each of the light-sensitive material pieces processed in the above color developer samples was measured with respect to its unexposed area's fog density in the form of a reflection density by using a PDA65 photoelectric densitometer with a blue light, manufactured by KONICA Corp.

Experiment 3

Each of the developer Samples 17-1 to 17-11, after adding 190 ppm of a calcium ion and 2800 ppm of sodium ion thereto, was allowed to stand at room temperature for 10 days in order to observe its precipitated condition.

The results of the above Experiments 1 to 3 are collectively shown in Table 21.

TABLE 21

| Sample No. | Chelating agent | (Exp.1) Developing agent attenuation rate (%) | (Exp.2) Fog density | (Exp.3) Precipitated condition |
|---|---|---|---|---|
| 17-1 (Comp.) | Not added | 56 | 0.16 | xxx |
| 17-2 (Inv.) | III-1 | 18 | 0.01 | ∘ |
| 17-3 (Inv.) | III-4 | 20 | 0.02 | ∘ |
| 17-4 (Inv.) | III-7 | 23 | 0.01 | ∘ |
| 17-5 (Inv.) | IV-1 | 25 | 0.02 | ∘ |
| 17-6 (Inv.) | IV-7 | 27 | 0.03 | ∘ |
| 17-7 (Inv.) | IV-16 | 22 | 0.02 | ∘ |
| 17-8 (Comp.) | HMP | 52 | 0.12 | xx |
| 17-9 (Comp.) | HEDP | 34 | 0.06 | xxx |
| 17-10 (Comp.) | EDTA | 73 | 0.15 | ∘ |
| 17-11 (Comp.) | NTP | 75 | 0.13 | x |

In Table 21, HMP stands for sodium hexametaphosphate, HEDP for hydroxyethylidene-1,1-diphosphonic acid, EDTA for ethylenediaminetetraacetic acid, and NTP for nitrilotrimethylenephosphonic acid.
Note: In the Exp. 3 column of the above table,
∘: Not precipitated at all.
x: Precipitated; the number of x marks increases as the precipitate increases.

As is apparent from the above table, the developer solution Samples 17-2 to 17-7 of the invention show little decomposition of the hydroxylamine, little fog and no generation of the precipitate caused by the presence of metallic ions.

On the other hand, the comparative Sample 17-8 is effective to some extent in preventing the decomposition of hydroxylamine and fogging, but is ineffective to prevent the precipitation attributable to the presence of metallic ions.

Further, the comparative Sample 17-10, although effective similarly to the chelating agent for the invention in preventing the generation of a precipitate, accelerates the decomposition of the hydroxylamine to cause the light-sensitive material to be badly fogged, thus being unacceptable for practical use. Samples 17-1, 17-8 and 17-11 also decompose the hydroxylamine to produce a fog and are weak in preventing the formation of a precipitate due to the presence of metallic ions.

Example 18

First developer Samples 18-1 to 18-5 of the following compositions for reversal film processing (black-and-white developer solutions) were prepared.

| | |
|---|---|
| Potassium sulfite (50% solution) | 45.0 ml |
| Sodium bromide | 2.0 g |
| Sodium thiocyanate | 1.1 g |
| Potassium iodide | 3.0 mg |
| Diethylene glycol | 20.0 ml |
| 1-Phenyl-3-pyrazolidone (Phenidone) | 0.58 g |
| Hydroquinone | 6.0 g |
| Potassium carbonate | 28.2 g |
| Potassium hydroxide | 2.8 g |
| Chelating agent (described in Table 22) | 2.5 g |
| Water to make one liter. | |
| Adjust pH to 9.9 with potassium hydroxide or 20% sulfuric acid. | |

Each of the above samples, after adding 2.8 ppm of a ferric ion (in the form of ferric chloride) and 200 ppm of a calcium ion thereto, was allowed to stant at 35° C. for 10 days, and then subjected to a quantitative analysis to determine the attenuation rate of the Phenidone, and also the precipitated condition of each sample was visually examined.

The obtained results are shown in Table 22.

TABLE 22

| Sample No. | Chelating agent | Phenidone attenuation rate (%) | Precipitated condition |
|---|---|---|---|
| 18-1 (Comp.) | Not added | 43 | xxx |
| 18-2 (Comp.) | EDTA | 78 | ∘ |
| 18-3 (Comp.) | EDTP | 55 | x |
| 18-4 (Inv.) | III-1 | 10 | ∘ |
| 18-5 (Inv.) | III-11 | 12 | ∘ |

Note: ∘: Not precipitated at all.
x: Precipitated; the number of x marks increases as the precipitate increases.

As is apparent from Table 22, the comparative Sample 18-2 effectively prevents the generation of a precipitate due to the presence of metallic ions, but accelerates the decomposition of the phenydon, a developing agent.

On the other hand, the comparative Samples 18-1 and 18-3 are little or not effective in decomposing the Phenidone, and not so effective, either, in preventing the generation of a precipitate. In contrast, Samples 18-4 and 18-5, containing the chelating agent of the invention, are capable of effectively preventing the generation of a precipitate and also effectively inhibiting the Phenidone from decomposing.

Example 19

Fixing and Bleach-fix solutions of the following compositions were prepared to examine the effect of the following exemplified compounds on the generation of precipitates due to the presence of metallic ions.

| | |
|---|---|
| Fixing solution | |
| Ammonium thiosulfate | 200 g |
| Ammonium sulfite | 20 g |
| Potassium metabisulfite | 5 g |
| Water to make one liter. | |
| Bleach-fix solution | |
| Ferric ammonium ethylenediaminetetraacetate | 60 g |
| Ammonium sulfite (40% solution) | 20 ml |
| Ammonium thiosulfate (70% solution) | 180 ml |
| Ammonia water (28% solution) | 30 ml |
| water to make one liter. | |

Each of both fixing and bleach-fix solutions was divided into parts; one as it is for comparison and the rest for preparing 4 different samples by adding thereto 4 g/liter each of Exemplified Compounds III-1, III-11, IV-1 and IV-16. Ammonia water or acetic acid was used to adjust pH of each fixing solution sample to 6.8 and pH of each bleach-fix solution Sample to 7.1, and then 200 ppm of a calcium ion were added to each solution.

When these samples were allowed to stand for days, both comparative fixing solution and bleach-fix solution samples, with nothing added thereto, produced conspicuous precipitates, whereas the other samples prepared by adding Exemplified Compounds III-1, III-2, IV-1 and IV-16 showed no precipitates at all.

Example 20

A stabilizing solution (also called a washing-substitute satilizing solution) of the following composition was prepared. And to this was added the bleach-fix solution in Example 17 in an amount 10% thereof for examination of its preventive effect upon the generation of suspended matter due to sulfurization.

| Stabilizing solution | |
|---|---|
| 5-Chloro-2-methyl-4-isothiazoline-3-one | 0.02 g |
| 2-Methyl-4-isothiazoline-3-one | 0.02 g |
| Ethylene glycol | 1.5 g |
| 2-Octyl-4-isoazoline-3-one | 0.01 g |
| Benzotriazole | 1.2 g |
| Ammonia water (28%) | 3.0 ml |
| Water to make one liter. | |
| Adjust pH to 7.8 with potassium hydroxide or 20% sulfuric acid. | |

The above stabilizing solution was divided into parts; one as it is for comparison, and the rest for preparing three different samples by adding thereto 3 g/liter each of Exemplified Compounds III-1, III-17 and IV-16.

Each of these stabilizing solution samples, after adjusting its pH to 8.0 and added 100 ppm of a calcium ion thereto, was allowed to stand for days. As a result, the comparative sample, with nothing added thereto, produced a precipitate in the form of suspended matter appearing on the surface in two days, whereas the other samples prepared by adding Exemplified Compounds III-1, III-17 and IV-16 showed nothing abnormal even after 10 days, and further, they were found effective against mold growth.

Example 21

Ethylenediaminetetraacetic acid (EDTA), diethylenetriaminepentaacetic acid (DTPA) and N-hydroxyethylethylenediaminetriacetic acid (HEDTA), which are generally known as chelating agents for photographic use, and Exemplified Compounds A-1 and A-2 were examined to find their spontaneous decomposabilities in compliance with the 301C amended MITI test (I) in the OECD Chemical Materials testing guideline (adopted May 12, 1981).

In this instance, the decomposition rate of each compound was found and indicated with a relative value to the value of Exemplified Compound III-1 set at 100. The results are given in Table 23.

TABLE 23

| Chelating agent | Spontaneous decomposition rate (%) |
|---|---|
| EDTA | 3 |
| DTPA | 1 |
| HEDTA | 5 |
| III-1 | 100 |
| III-17 | 96 |
| IV-16 | 97 |

From Table 23, it is understood that the chelating agents of the invention are all satisfactory in the spontaneous decomposition, whereas EDTA and DTPA show almost no spontaneous decomposition, so that the chelating agents of the invention are very advantageous from the standpoint of the global environment protection.

Example 22

Samples were prepared and evaluated in the same manner as in Example 1 except that the added amount of the color developing agent to the color developer solution was changed to 5.7 g, the added amount of the potassium sulfite to the color developer replenisher was changed to $6\times10^{-4}$ mol, the organic ferric complex salt to the bleach-fix solution was replaced by the compounds described in Table 24 and 25 and their adding amount was changed to 0.17 mol/liter, the added amount of the thiosulfate was changed to 0.52 mol, and the added amount of the ethylenediaminetetraacetic acid to the stabilizing solution and to its replenisher was changed to 3.2 g.

The results are shown in Tables 24, 25 and 26. Evaluation criteria also is the same as in Example 1.

TABLE 24

| Sample No. | Organic ferric complex salt | Rate (mol %) of ammonium ion accounting for of the whole cations in the bleach-fix bath | Amount of residual silver (mg/100 cm$^2$) | Edge stain | Sulfurized condition |
|---|---|---|---|---|---|
| 22-1(Comp.) | EDTA.Fe | 100 | 0.7 | C | D |
| 22-2(Comp.) | " | 60 | 0.8 | C | D |
| 22-3(Comp.) | " | 50 | 0.8 | C | D |

TABLE 24-continued

| Sample No. | Organic ferric complex salt | Rate (mol %) of ammonium ion accounting for of the whole cations in the bleach-fix bath | Amount of residual silver (mg/100 cm$^2$) | Edge stain | Sulfurized condition |
|---|---|---|---|---|---|
| 22-4(Comp.) | " | 30 | 0.9 | B | D |
| 22-5(Comp.) | " | 10 | 1.0 | B | D |
| 22-6(Comp.) | " | 0 | 1.1 | B | D |
| 22-7(Comp.) | PDTA.Fe | 100 | 1.8 | C | E |
| 22-8(Comp.) | " | 60 | 1.9 | C | E |
| 22-9(Comp.) | " | 50 | 1.9 | B | E |
| 22-10(Comp.) | " | 30 | 1.9 | B | E |
| 22-11(Comp.) | " | 10 | 2.0 | B | E |
| 22-12(Comp.) | " | 0 | 2.1 | B | E |
| 22-13(Comp.) | DTPA.Fe | 100 | 0 | E | B |
| 22-14(Comp.) | " | 60 | 0 | E | B |
| 22-15(Comp.) | " | 50 | 0.1 | E | B |
| 22-16(Comp.) | " | 30 | 0.1 | E | B |
| 22-17(Comp.) | " | 10 | 0.2 | D | B |
| 22-18(Comp.) | " | 0 | 0.2 | D | B |
| 22-19(Comp.) | NTA.Fe | 100 | 1.2 | C | D |
| 22-20(Comp.) | " | 60 | 1.3 | C | D |
| 22-21(Comp.) | " | 50 | 1.3 | B | D |
| 22-22(Comp.) | " | 30 | 1.4 | B | D |
| 22-23(Comp.) | " | 10 | 1.5 | B | D |
| 22-24(Comp.) | " | 0 | 1.7 | B | D |
| 22-25(Inv.) | V-1.Fe | 100 | 0 | C | B |
| 22-26(Inv.) | " | 60 | 0 | C | B |
| 22-27(Inv.) | " | 50 | 0 | B | A |
| 22-28(Inv.) | " | 30 | 0 | B | A |
| 22-29(Inv.) | " | 10 | 0.1 | A | A |
| 22-30(Inv.) | " | 0 | 0.1 | A | A |

TABLE 25

| Sample No. | Organic ferric complex salt | Rate (mol %) of ammonium ion accounting for of the whole cations in the bleach-fix bath | Amount of residual silver (mg/100 cm$^2$) | Edge stain | Sulfurized condition |
|---|---|---|---|---|---|
| 22-31(Inv.) | V-2.Fe | 100 | 0 | C | B |
| 22-32(Inv.) | " | 60 | 0 | C | B |
| 22-33(Inv.) | " | 50 | 0 | B | A |
| 22-34(Inv.) | " | 30 | 0.1 | B | A |
| 22-35(Inv.) | " | 10 | 0.1 | A | A |
| 22-36(Inv.) | " | 0 | 0.1 | A | A |
| 22-37(Inv.) | V-6.Fe | 100 | 0 | C | B |
| 22-38(Inv.) | " | 60 | 0 | C | B |
| 22-39(Inv.) | " | 50 | 0 | C-B | A |
| 22-40(Inv.) | " | 30 | 0.1 | B | A |
| 22-41(Inv.) | " | 10 | 0.1 | A | A |
| 22-42(Inv.) | " | 0 | 0.2 | A | A |
| 22-43(Inv.) | V-12.Fe | 100 | 0 | C | B |
| 22-44(Inv.) | " | 60 | 0.1 | C | B |
| 22-45(Inv.) | " | 50 | 0.1 | C-B | B |
| 22-46(Inv.) | " | 30 | 0.1 | B | A |
| 22-47(Inv.) | " | 10 | 0.2 | B | A |
| 22-48(Inv.) | " | 0 | 0.4 | A | A |
| 22-49(Inv.) | V-16.Fe | 100 | 0 | C | B |
| 22-50(Inv.) | " | 60 | 0.1 | C | B |
| 22-51(Inv.) | " | 50 | 0.1 | C | B |
| 22-52(Inv.) | " | 30 | 0.2 | C-B | A |
| 22-53(Inv.) | " | 10 | 0.3 | A | A |
| 22-54(Inv.) | " | 0 | 0.4 | A | A |
| 22-55(Inv.) | VI-1.Fe | 100 | 0 | C | B |
| 22-56(Inv.) | " | 60 | 0 | C | B |
| 22-57(Inv.) | " | 50 | 0 | C | B |
| 22-58(Inv.) | " | 30 | 0.1 | B | A |
| 22-59(Inv.) | " | 10 | 0.2 | A | A |
| 22-60(Inv.) | " | 0 | 0.2 | A | A |

TABLE 26

| Sample No. | Organic ferric complex salt | Rate (mol %) of ammonium ion accounting for of the whole cations in the bleach-fix bath | Amount of residual silver (mg/100 cm$^2$) | Edge stain | Sulfurized condition |
|---|---|---|---|---|---|
| 22-61(Inv.) | VI-2.Fe | 100 | 0 | C | B |

TABLE 26-continued

| Sample No. | Organic ferric complex salt | Rate (mol %) of ammonium ion accounting for of the whole cations in the bleach-fix bath | Amount of residual silver (mg/100 cm$^2$) | Edge stain | Sulfurized condition |
|---|---|---|---|---|---|
| 22-62(Inv.) | " | 60 | 0 | C | B |
| 22-63(Inv.) | " | 50 | 0.1 | B | A |
| 22-64(Inv.) | " | 30 | 0.2 | B | A |
| 22-65(Inv.) | " | 10 | 0.2 | A | A |
| 22-66(Inv.) | " | 0 | 0.4 | A | A |
| 22-67(Inv.) | VI-7.Fe | 100 | 0 | C | B |
| 22-68(Inv.) | " | 60 | 0 | C | B |
| 22-69(Inv.) | " | 50 | 0.1 | C-B | B |
| 22-70(Inv.) | " | 30 | 0.2 | B | A |
| 22-71(Inv.) | " | 10 | 0.3 | A | A |
| 22-72(Inv.) | " | 0 | 0.5 | A | A |
| 22-73(Inv.) | VI-14.Fe | 100 | 0 | C | B |
| 22-74(Inv.) | " | 60 | 0 | C | B |
| 22-75(Inv.) | " | 50 | 0.1 | C-B | B |
| 22-76(Inv.) | " | 30 | 0.2 | B | A |
| 22-77(Inv.) | " | 10 | 0.3 | B | A |
| 22-78(Inv.) | " | 0 | 0.4 | A | A |
| 22-79(Inv.) | VI-19.Fe | 100 | 0 | C | B |
| 22-80(Inv.) | " | 60 | 0.1 | C | B |
| 22-81(Inv.) | " | 50 | 0.1 | C | B |
| 22-82(Inv.) | " | 30 | 0.2 | C-B | A |
| 22-83(Inv.) | " | 10 | 0.2 | B | A |
| 22-84(Inv.) | " | 0 | 0.3 | A | A |
| 22-85(Inv.) | VII-2.Fe | 100 | 0 | C | B |
| 22-86(Inv.) | " | 60 | 0.1 | C | B |
| 22-87(Inv.) | " | 50 | 0.2 | C | B |
| 22-88(Inv.) | " | 30 | 0.3 | B | B |
| 22-89(Inv.) | " | 10 | 0.3 | A | A |
| 22-90(Inv.) | " | 0 | 0.4 | A | A |

In Tables 24, 25 and 26, EDTA.Fe Stands for ferric complex salt of ethylenediaminetetraacetic acid, PDTA.Fe for ferric complex salt of 1,3-propylenediaminetetraacetic acid, NTA.Fe for ferric complex salt of nitrilotriacetic acid, V-1.Fe for ferric complex salt of Exemplified Compound V-1, VI-1 for ferric complex salt of Exemplified Compound VI-1, VI-4.Fe for ferric complex salt of Exemplified Compound VI-4, VII-2.Fe for ferric complex salt of Exemplified Compound VII-2, and the others likewise.

From Tables 24, 25 and 26 it is apparent that the samples of the invention, where organic ferric complex salts of the invention were used, show less amounts of residual silver, less edge stain and better storage stability of the bleach-fix solution than the comparative samples. Further, where the rate of ammonium ions accounting for of the whole cations in the bleach-fix bath is not more than 50 mol %, the above effects become better; when not more than 30 mol %, the effects become far better; and when not more than 10 mol%, the effects become the best.

Example 23

Samples were prepared and evaluated in the same manner as in Example 2 except that the added amount of the hydroxylamine sulfate to the color developer solution was changed to 2.3 g, that of the hydroxylamine sulfate to the color developer replenisher was changed to 3.3 g, the organic ferric complex salt in the bleaching bath was replaced by the compounds described in Tables 27, 28 and 29 and their added amount was changed to 0.32 mol, the added amount of the ethylenediaminetetraacetic acid was changed to 7 g, that of the bromide was changed to 1.1 mols and that of the glacial acetic acid was changed to 45 ml. Evaluation procedure also is the same as in Example 2.

The results are shown in Tables 27, 28 and 29.

TABLE 27

| Sample No | Organic ferric complex salt | Rate (mol %) of ammonium ion accounting for of the whole cations in the bleach-fix bath | Amount of residual silver (mg/100 cm$^2$) | Unexposed area's magenta transmission density |
|---|---|---|---|---|
| 23-1(Comp.) | EDTA.Fe | 100 | 7.5 | 0.57 |
| 23-2(Comp.) | " | 60 | 7.6 | 0.57 |
| 23-3(Comp.) | " | 50 | 7.6 | 0.57 |
| 23-4(Comp.) | " | 30 | 7.7 | 0.56 |
| 23-5(Comp.) | " | 10 | 7.8 | 0.56 |
| 23-6(Comp.) | " | 0 | 7.9 | 0.56 |
| 23-7(Comp.) | PDTA.Fe | 100 | 0 | 0.65 |
| 23-8(Comp.) | " | 60 | 0 | 0.63 |
| 23-9(Comp.) | " | 50 | 0.1 | 0.62 |
| 23-10(Comp.) | " | 30 | 0.1 | 0.62 |
| 23-11(Comp.) | " | 10 | 0.2 | 0.61 |
| 23-12(Comp.) | " | 0 | 0.3 | 0.60 |
| 23-13(Comp.) | DTPA.Fe | 100 | 6.5 | 0.58 |
| 23-14(Comp.) | " | 60 | 6.7 | 0.58 |
| 23-15(Comp.) | " | 50 | 6.8 | 0.58 |

TABLE 27-continued

| Sample No | Organic ferric complex salt | Rate (mol %) of ammonium ion accounting for of the whole cations in the bleach-fix bath | Amount of residual silver (mg/100 cm$^2$) | Unexposed area's magenta transmission density |
|---|---|---|---|---|
| 23-16(Comp.) | " | 30 | 6.9 | 0.56 |
| 23-17(Comp.) | " | 10 | 7.0 | 0.56 |
| 23-18(Comp.) | " | 0 | 7.0 | 0.56 |
| 23-19(Comp.) | NTA.Fe | 100 | 8.3 | 0.57 |
| 23-20(Comp.) | " | 60 | 8.4 | 0.56 |
| 23-21(Comp.) | " | 50 | 8.6 | 0.56 |
| 23-22(Comp.) | " | 30 | 8.8 | 0.56 |
| 23-23(Comp.) | " | 10 | 9.1 | 0.56 |
| 23-24(Comp.) | " | 0 | 9.3 | 0.54 |
| 23-25(Inv.) | V-1.Fe | 100 | 0 | 0.58 |
| 23-26(Inv.) | " | 60 | 0 | 0.57 |
| 23-27(Inv.) | " | 50 | 0 | 0.57 |
| 23-28(Inv.) | " | 30 | 0 | 0.57 |
| 23-29(Inv.) | " | 10 | 0.1 | 0.56 |
| 23-30(Inv.) | " | 0 | 0.2 | 0.56 |

TABLE 28

| Sample No | Organic ferric complex salt | Rate (mol %) of ammonium ion accounting for of the whole cations in the bleach-fix bath | Amount of residual silver (mg/100 cm$^2$) | Unexposed area's magenta transmission density |
|---|---|---|---|---|
| 23-31(Inv.) | V-2.Fe | 100 | 0 | 0.57 |
| 23-32(Inv.) | " | 60 | 0 | 0.57 |
| 23-33(Inv.) | " | 50 | 0 | 0.57 |
| 23-34(Inv.) | " | 30 | 0.1 | 0.56 |
| 23-35(Inv.) | " | 10 | 0.1 | 0.56 |
| 23-36(Inv.) | " | 0 | 0.2 | 0.56 |
| 23-37(Inv.) | V-6.Fe | 100 | 0 | 0.57 |
| 23-38(Inv.) | " | 60 | 0 | 0.57 |
| 23-39(Inv.) | " | 50 | 0.1 | 0.56 |
| 23-40(Inv.) | " | 30 | 0.1 | 0.56 |
| 23-41(Inv.) | " | 10 | 0.2 | 0.56 |
| 23-42(Inv.) | " | 0 | 0.3 | 0.56 |
| 23-43(Inv.) | V-16.Fe | 100 | 0 | 0.57 |
| 23-44(Inv.) | " | 60 | 0.1 | 0.57 |
| 23-45(Inv.) | " | 50 | 0.1 | 0.57 |
| 23-46(Inv.) | " | 30 | 0.2 | 0.56 |
| 23-47(Inv.) | " | 10 | 0.3 | 0.56 |
| 23-48(Inv.) | " | 0 | 0.4 | 0.55 |
| 23-49(Inv.) | VI-1.Fe | 100 | 0 | 0.58 |
| 23-50(Inv.) | " | 60 | 0 | 0.57 |
| 23-51(Inv.) | " | 50 | 0.1 | 0.57 |
| 23-52(Inv.) | " | 30 | 0.1 | 0.56 |
| 23-53(Inv.) | " | 10 | 0.2 | 0.56 |
| 23-54(Inv.) | " | 0 | 0.2 | 0.56 |
| 23-55(Inv.) | VI-4.Fe | 100 | 0 | 0.57 |
| 23-56(Inv.) | " | 60 | 0 | 0.56 |
| 23-57(Inv.) | " | 50 | 0.1 | 0.56 |
| 23-58(Inv.) | " | 30 | 0.2 | 0.56 |
| 23-59(Inv.) | " | 10 | 0.3 | 0.56 |
| 23-60(Inv.) | " | 0 | 0.3 | 0.56 |

TABLE 29

| Sample No | Organic ferric complex salt | Rate (mol %) of ammonium ion accounting for of the whole cations in the bleach-fix bath | Amount of residual silver (mg/100 cm$^2$) | Unexposed area's magenta transmission density |
|---|---|---|---|---|
| 23-61(Inv.) | VI-14.Fe | 100 | 0 | 0.58 |
| 23-62(Inv.) | " | 60 | 0 | 0.57 |
| 23-63(Inv.) | " | 50 | 0.1 | 0.56 |
| 23-64(Inv.) | " | 30 | 0.1 | 0.56 |
| 23-65(Inv.) | " | 10 | 0.2 | 0.55 |
| 23-66(Inv.) | " | 0 | 0.4 | 0.55 |
| 23-67(Inv.) | VI-16.Fe | 100 | 0 | 0.57 |
| 23-68(Inv.) | " | 60 | 0.1 | 0.57 |
| 23-69(Inv.) | " | 50 | 0.1 | 0.56 |
| 23-70(Inv.) | " | 30 | 0.2 | 0.56 |
| 23-71(Inv.) | " | 10 | 0.2 | 0.56 |
| 23-72(Inv.) | " | 0 | 0.3 | 0.55 |
| 23-73(Inv.) | VI-17.Fe | 100 | 0 | 0.57 |

TABLE 29-continued

| Sample No | Organic ferric complex salt | Rate (mol %) of ammonium ion accounting for of the whole cations in the bleach-fix bath | Amount of residual silver (mg/100 cm$^2$) | Unexposed area's magenta transmission density |
|---|---|---|---|---|
| 23-74(Inv.) | " | 60 | 0.1 | 0.57 |
| 23-75(Inv.) | " | 50 | 0.2 | 0.56 |
| 23-76(Inv.) | " | 30 | 0.3 | 0.56 |
| 23-77(Inv.) | " | 10 | 0.3 | 0.55 |
| 23-78(Inv.) | " | 0 | 0.4 | 0.55 |
| 23-79(Inv.) | VII-2.Fe | 100 | 0 | 0.57 |
| 23-80(Inv.) | " | 60 | 0.1 | 0.56 |
| 23-81(Inv.) | " | 50 | 0.2 | 0.56 |
| 23-82(Inv.) | " | 30 | 0.2 | 0.55 |
| 23-83(Inv.) | " | 10 | 0.3 | 0.55 |
| 23-84(Inv.) | " | 0 | 0.4 | 0.55 |

As is apparent from Tables 27, 28 and 29, the samples of the invention, where organic complex salts of the invention were used, show less amounts of residual silver and less rise of the magenta transmission density of the unexposed area than the comparative samples. Further, where the rate of ammonium ions accounting for of the whole cations in the bleaching solution is not more than 50 mol %, the above effects become better; when not more than 30 mol %, the effects become far better; and when not more than 10 mol %, the effects become the best.

Example 24

A color developer solution of the following composition was prepared.

| | |
|---|---|
| Potassium carbonate | 30.0 g |
| Sodium hydrogencarbonate | 2.5 g |
| Potassium sulfite | 3.2 g |
| Sodium bromide | 1.3 g |
| Potassium iodide | 1.2 mg |
| Hydroxylamine sulfate | 2.7 g |
| Sodium chloride | 0.6 g |
| 4-Amino-3-methyl-N-ethyl-N-(β-hydroxyethyl)-aniline sulfate | 4.3 g |
| Diethylenetriaminepentaacetic acid | 3.0 g |
| Potassium hydroxide | 1.2 g |
| Chelating agent (described in Table 30) | 2.0 g |
| Water to make one liter. | |
| Adjust pH to 10.00 with potassium hydroxide or 20% sulfuric acid. | |

And the following experiments were conducted.

The results of the respective experiments are collectively shown hereinafter.

Experiment 1

Each of the above developer solution Samples 24-1 to 24-18, after adding 1.5 ppm of a ferric ion and 0.4 ppm of copper ion thereto, was allowed to stand at 36° C. for 7 days, and then subjected to a quantitative analysis of the hydroxylamine to thereby find its attenuation rate.

Experiment 2

The same light-sensitive material as what was used in Example 2, after being exposed through a stepwedge to a white light, was processed according to the following processing steps by using the developing solution Samples 24-1 to 24-18 that were allowed to stand for 7 days in Experiment 1.

| Processing step | Time | Temperature |
|---|---|---|
| Color develop | 3 min. 15 sec. | 38° C. |
| Bleach | 45 seconds | 38° C. |
| Fix | 1 min. 30 sec. | 38° C. |
| Stabilizing | 50 seconds | 38° C. |
| Dry | 1 minute | 40 to 70° C. |

The compositions of the bleaching, fixing and stabilizing solutions used in the above processing steps are as follows:

| Bleaching solution | |
|---|---|
| Ferric ammonium 1,3-propylenediaminetetraacetate | 0.32 mol |
| Disodium ethylenediaminetetraacetate | 10 g |
| Ammonium bromide | 100 g |
| Glacial acetic acid | 40 g |
| Ammonium nitrate | 40 g |
| Water to make one liter. | |
| Adjust pH to 4.4 with ammonia water or glacial acetic acid. | |

Fixing solution, stabilizing solution

The same as those used in Example 2.

Each color-processed light-sensitive material piece was measured with respect to its unexposed area's fog density in the form of a blue-reflection density by using a PDA65 photoelectric densitometer, manufactured by KONICA Corp.

Experiment 3

Each of the developer solution Samples 24-1 to 24-18, after adding 180 ppm of a calcium ion and 3000 ppm of a sodium ion thereto, was allowed to stant at room temperature for 7 days, and then its precipitated condition was examined visually.

The results of Experiments 1 to 3 are shown in Table 30.

TABLE 30

| Sample No. | Chelating agent | (Exp.1) Developing agent attenuation rate (%) | (Exp.2) Fog density | (Exp.3) Precipitated condition |
|---|---|---|---|---|
| 24-1 (Comp.) | Not added | 51 | 0.14 | xxx |
| 24-2 (Inv.) | V-1 | 16 | 0.01 | ○ |
| 24-3 (Inv.) | V-2 | 17 | 0.02 | ○ |
| 24-4 (Inv.) | V-3 | 19 | 0.02 | ○ |
| 24-5 (Inv.) | V-6 | 16 | 0.01 | ○ |
| 24-6 (Inv.) | V-16 | 15 | 0.01 | ○ |
| 24-7 (Inv.) | V-21 | 19 | 0.02 | ○ |
| 24-8 (Inv.) | VI-1 | 20 | 0.02 | ○ |

TABLE 30-continued

| Sample No. | Chelating agent | (Exp.1) Developing agent attenuation rate (%) | (Exp.2) Fog density | (Exp.3) Precipitated condition |
|---|---|---|---|---|
| 24-9 (Inv.) | VI-2 | 21 | 0.03 | o |
| 24-10 (Inv.) | VI-4 | 27 | 0.03 | o |
| 24-11 (Inv.) | VI-14 | 26 | 0.03 | o |
| 24-12 (Inv.) | VI-19 | 20 | 0.02 | o |
| 24-13 (Inv.) | VII-2 | 26 | 0.03 | o |
| 24-14 (Comp.) | HMP | 50 | 0.09 | x |
| 24-15 (Comp.) | HEDP | 35 | 0.02 | xxx |
| 24-16 (Comp.) | EDTA | 77 | 0.15 | o |
| 24-17 (Comp.) | NTA | 72 | 0.17 | x |
| 24-18 (Comp.) | PDTA | 69 | 0.19 | o |

In Table 30, HMP stands for sodium hexametaphosphate, HEDP for hydroxyethylidene-1,1-diphosphonic acid, EDTA for ethylenediaminetetraacetic acid, NTA for nitrilotriacetic acid, and PDTA for trimethylenediaminetetraacetic acid.
Note: In the Exp. 3 column of the above table,
o: Not precipitated at all.
x: Precipitated; the number of x marks increases as the precipitate increases.

In Table 30, HMP stands for sodium hexametaphosphate, HEDP for hydroxyethylidene-1,1-diphosphonic acid, EDTA for ethylenediaminetetraacetic acid, NTA for nitrilotriacetic acid, and PDTA for trimethylenediaminetetraacetic acid.

Note: In the Exp.3 column of the above table, o: Not precipitated at all.

x: Precipitated; the number of x marks increases as the precipitate increases.

As is apparent from the above table, the developer solution Samples 24-2 to 24-13 of the invention show little decomposition of the hydroxylamine, little fog and no generation of the precipitate caused by the presence of metallic ions.

On the other hand, the comparative Sample 24-15 is effective to some extent in preventing the decomposition of hydroxylamine and fogging, but is ineffective to prevent the precipitation attributable to the presence of metallic ions, and thus unacceptable for practical use.

Further, the comparative Samples 24-16 and 24-18, although effective similarly to the chelating agent of the invention in preventing the generation of a precipitate, accelerates the decomposition of the hydroxylamine to cause the light-sensitive material to be badly fogged, thus being unacceptable for practical use. Samples 24-1, 24-14 and 24-17 also decompose the hydroxylamine to produce a fog and are weak in preventing the formation of a precipitate due to the presence of metallic ions, and therefore not suitable for practical use.

Example 25

First developer Samples 25-1 to 25-8 of the following compositions for reversal film processing (black-and-white developer solutions) were prepared.

| | |
|---|---|
| Potassium sulfite (50% solution) | 40.0 ml |
| Sodium bromide | 2.0 g |
| Sodium thiocyanate | 1.1 g |
| Potassium iodide | 3.0 mg |
| Diethylene glycol | 20.0 ml |
| 1-Phenyl-3-pyrazolidone (Phenidone) | 0.61 g |
| Hydroquinone | 5.8 g |
| Potassium carbonate | 28.0 g |
| Potassium hydroxide | 2.8 g |
| Chelating agent (described in Table 31) | 2.0 g |
| Water to make one liter. | |
| Adjust pH to 9.90 with potassium hydroxide or 20% sulfuric acid. | |

Each of the above samples, after adding 2.5 ppm of a ferric ion and 180 ppm of a calcium ion thereto, was allowed to stant at 35° C. for 7 days, and then subjected to a quantitative analysis to determine the attenuation rate of the Phenidone, and also the precipitated condition of each sample was visually examined.

The obtained results are shown in Table 31.

TABLE 31

| Sample No. | Chelating agent | Phenidone attenuation rate (%) | Precipitated condition |
|---|---|---|---|
| 25-1 (Comp.) | Not added | 35 | xxx |
| 25-2 (Inv.) | V-1 | 13 | o |
| 25-3 (Inv.) | V-2 | 11 | x |
| 25-4 (Inv.) | VI-1 | 14 | o |
| 25-5 (Inv.) | VI-4 | 16 | o |
| 25-6 (Inv.) | VII-1 | 14 | o |
| 25-7 (Comp.) | EDTP | 29 | x |
| 25-8 (Comp.) | EDTA | 70 | o |

Note: o: Not precipitated at all.
x: Precipitated; the number of x marks increases as the precipitate increases.

As is apparent from Table 22, the comparative Sample 25-8 effectively prevents the generation of a precipitate due to the presence of metallic ions, but accelerates the decomposition of the Phenidone, a developing agent.

On the other hand, the comparative Samples 25-1 and 25-7 are little or not effective in decomposing the Phenidone, and not so effective in preventing the generation of a precipitate. In contrast, Samples 25-2 and 25-6, containing the chelating agent of the invention, are capable of effectively preventing the generation of a precipitate and also effectively inhibiting the Phenidone from decomposing.

Example 26

Fixing and Bleach-fix solutions of the following compositions were prepared to examine the following exemplified compounds' effect on the generation of precipitates due to the presence of metallic ions.

| | |
|---|---|
| Fixing solution | |
| Ammonium thiosulfate | 200 g |
| Ammonium sulfite | 20 g |
| Potassium metabisulfite | 5 g |
| Water to make one liter. | |
| Bleach-fix solution | |
| Ferric ammonium ethylenediaminetetraacetate | 60 g |
| Ammonium sulfite (40% solution) | 20 ml |
| Ammonium thiosulfate (70% solution) | 180 ml |
| Ammonia water (28% solution) | 30 ml |
| Water to make one liter. | |

Each of both fixing and bleach-fix solutions was divided into parts; one as it is for comparison and the rest for preparing 8 different samples by adding thereto 4 g/liter each of Exemplified Compounds V-1, V-2, IV-1 and IV-14. Ammonia water or acetic acid was used to adjust pH of each fixing solution sample to 6.8 and pH of each bleach-fix solution Sample to 7.1, and then 200 ppm of a calcium ion were added to each solution.

When these samples were allowed to stand for days, both comparative fixing solution and bleach-fix solution samples, with nothing added thereto, produced conspicuous precipitates, whereas the other samples prepared by adding Exemplified Compounds V-1, V-2, IV-1 and IV-14 showed no precipitates at all.

Example 27

A stabilizing solution (also called a washing-substitute satilizing solution) of the following composition was prepared. And to this was added the bleach-fix solution in Example 3 in an amount 10% thereof for examination of its preventive effect upon the generation of suspended matter due to sulfurization.

| Stabilizing solution | |
|---|---|
| 5-Chloro-2-methyl-4-isothiazoline-3-one | 0.02 g |
| 2-Methyl-4-isothiazoline-3-one | 0.02 g |
| Ethylene glycol | 1.5 g |
| 2-Octyl-4-isoazoline-3-one | 0.01 g |
| Benzotriazole | 1.2 g |
| Ammonia water (28%) | 2.5 ml |
| Water to make one liter. | |
| Adjust pH to 7.8 with potassium hydroxide or 20% sulfuric acid. | |

The above stabilizing solution was divided into parts; one as it is for comparison, and the rest for preparing three different samples by adding thereto 3 g/liter each of Exemplified Compounds V-1, V-2 and VI-1.

Each of these stabilizing solution samples, after adjusting its pH to 8.0 with KOH or 20% sulfuric acid and added 200 ppm of a calcium ion thereto, was allowed to stand for days. As a result, the comparative sample, with nothing added thereto, produced a precipitate in the form of suspended matter appearing on the surface in two days, whereas the other samples prepared by adding Exemplified Compounds V-1, V-2 and VI-1 showed nothing abnormal even after 10 days, and further, they were found effective against mold growth.

Example 28

Ethylenediaminetetraacetic acid (EDTA), diethylenetriaminepentaacetic acid (DTPA) and N-hydroxyethylethylenediaminetriacetic acid (HEDTA), which are generally known as chelating agents for photographic use, and Exemplified Compounds V-1, V-2, VI-1 and VII-2 were examined to find their spontaneous decomposabilities in compliance with the 301C amended MITI test (I) in the OECD Chemical Materials testing guideline (adopted May 12, 1981).

In this instance, the decomposition rate of each compound was found and indicated with a relative value to the value of Exemplified Compound V-2 set at 100. The results are given in Table 32.

TABLE 32

| Chelating agent | Spontaneous decomposition rate (%) |
|---|---|
| EDTA | 2 |
| DTPA | 1 |
| HEDTA | 4 |
| V-1 | 95 |
| V-2 | 100 |
| VI-1 | 90 |
| VII-2 | 92 |

From Table 32, it is understood that the chelating agents of the invention are all satisfactory in the spontaneous decomposition, whereas EDTA and DTPA show almost no spontaneous decomposition, so that the chelating agents of the invention are excellent from the standpoint of the global environment protection.

What is claimed is:

1. A chemical composition for processing an exposed silver halide photographic light-sensitive material comprised of a support and at least one silver halide emulsion layer which contains silver halide grains and a color forming coupler, wherein said composition is a bleaching solution or bleach fixing solution containing a ferric complex salt of a compound represented by the following Formula I, II, III or VI in an amount of 0.05 to 2.0 mol/l;

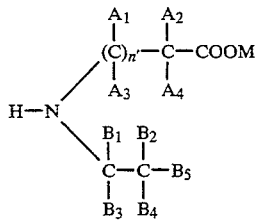

(I)

wherein n' is an integer of 1 to 3; $A_1$, $A_2$, $A_3$, $A_4$, $B_1$, $B_2$, $B_3$, $B_4$ and $B_5$ are each independently a hydrogen atom, an —OH group, a $-C_nH_{2n+1}$ group, or a $-(CH_2)_lX$ group in which n is an integer 1 to 3; is an integer of 0 to 3; X is a —COOM group, an $-NH_2$ group or an —OH group, in which M is a hydrogen atom, an alkali metal ion or another cation; provided that all of $B_1$, $B_2$, $B_3$, $B_4$ and $B_5$ are not hydrogen atoms at the same time;

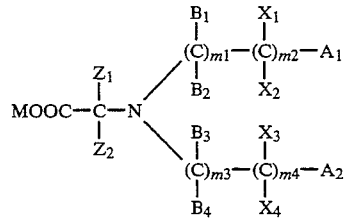

(II)

wherein $B_1$, $B_2$, $B_3$, $B_4$, $X_1$, $X_2$, $X_3$ and $X_4$ are each independently a hydrogen atom, a $-C_nH_{2n+1}$ group or a $-(CH_2)_lY$ group; n and l are each an integer of 1 to 3 and 0 to 3, respectively; Y is a —COOM group, an $-NH_2$ group or a —OH group in which M is a hydrogen ion, an alkali metal ion or another cation, provided that all of $B_1$, $B_2$, $B_3$ and $B_4$ are not hydrogen atoms at the same time, and all of $X_1$, $X_2$, $X_3$ and $X_4$ are not hydrogen atoms at the same time and any number, except 2, of $X_1$, $X_2$, $X_3$ and $X_4$ may be —OH groups at the same time; m1, m2, m3 and m4 are independently an integer of 1 to 3; and $A_1$ and $A_2$ are each a $-COOM_1$ group, a $-COOM_2$ group, an $-NH_2$ group or an —OH group, wherein $M_1$ and $M_2$ are each a hydrogen ion, an alkali metal ion or another cation; and $Z_1$ and $Z_2$ are each a hydrogen atom, a $-COOM_1$ group, a $-COOM_2$ group, an alkyl group having 1 to 3 carbon atoms or an —OH group, wherein $M_1$ and $M_2$ are each a hydrogen ion, an alkali metal ion or another cation;

$$(R_1)(R_2)N-X_1-(Z-X_2)_n-N(R_3)(R_4) \quad \text{(III)}$$

wherein $R_1$, $R_2$ and $R_3$ are each a $-L_1-Y_1$ group in which $L_1$ is a substituted or unsubstituted alkylene group having 1 to 3 carbon atoms and $Y_1$ is an —OH group, an $-NH_2$ group or a —COOM group, M is a hydrogen ion, an alkali metal ion or another cation; $R_4$ is a hydrogen atom, a $-CH_3$ group or a $-C_2H_5$ group; n is an integer 0 to 4; Z is an alkylene group, an —O— atom, an —NH— group, an $>N-L_2-Y_2$ group or a >CH—$L_3$—$Y_3$ group in which $L_2$ and $L_3$ are each a substituted or unsubstituted alkylene group having 1 to 4 carbon atoms; $Y_2$ and $Y_3$ are each a hydrogen atom, an —OH group, an —$NH_2$ group, a —$COOM_1$ group or a —$COOM_2$ group in which $M_1$ and $M_2$ are each a hydrogen ion, an alkali metal ion or another cation; $X_1$ and $X_2$ are each a substituted or unsubstituted alkylene group having 1 to 6 carbon atoms or a >CH—$L_4$—$Y_4$ group in which $L_4$ is a substituted or unsubstituted alkylene group having 1 to 4 carbon atoms and $Y_4$ is a hydrogen atom, an —OH group, an —$NH_2$ group, a —$COOM_1$ group or a —$COOM_2$ group, $M_1$ and $M_2$ are each a hydrogen ion, an alkali metal ion or another cation; provided that when n=0, $X_1$ is a substituted or unsubstituted alkylene group having 2 to 6 carbon atoms;

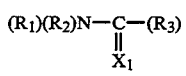

(VI)

wherein $X_1$ is an oxygen atom or a sulfur atom; and $R_1$, $R_2$ and $R_3$ are each a hydrogen atom or a group in which $Z_1$ and $Z_2$ are each a hydrogen atom, a —COOM group, an —OH group or an —$NH_2$ group, m1, m2 and m3 are each an integer of 0 to 2, provided that a least one of the $R_1$, $R_2$ and $R_3$ is and at least one of $Z_1$ and $Z_2$ is a —COOM group, and M is a hydrogen ion, an alkali metal ion or another cation.

2. The composition of claim 1, wherein said compound is a compound represented by Formula I or III.

3. The composition of claim 2, wherein said compound is a compound represented by Formula I.

4. The composition of claim 2, wherein said compound is a compound represented by Formula III.

5. The composition of claim 2, wherein the ferric complex salt of said compound represented by Formula I, II, III or VI is used in an amount of 0.1 mol/l to 1.0 mol/l.

6. The composition of claim 1 wherein said compound is a compound represented by Formula I, II or VI.

7. The composition of claim 6 wherein said compound is a compound represented by Formula VI.

8. The composition of claim 6 wherein said compound is a compound of formula II.

9. A method for processing exposed silver halide color photographic light-sensitive material comprised of a support and at least one silver halide emulsion layer which contains silver halide grains and a color forming coupler, comprising the steps of developing the color photographic light-sensitive material with a color developer containing a color developing agent, and bleaching and fixing said developed light-sensitive material with a bleaching solution comprising a bleaching agent and a fixing solution comprising a fixing agent or a bleach-fixing solution, wherein said bleaching solution or said bleach-fixing solution contains a ferric complex salt of a compound represented by Formula I, II, III or VI in an amount of 0.05 to 2.0 mol/l;

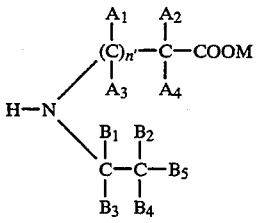

(I)

wherein n' is an integer of 1 to 3; $A_1$, $A_2$, $A_3$, $A_4$, $B_1$, $B_2$, $B_3$, $B_4$ and $B_5$ are each independently a hydrogen atom, an —OH group, a —$C_nH_{2n+1}$ group, or a —$(CH_2)_lX$ group in which n is an integer 1 to 3; l is an integer of 0 to 3; X is a —COOM group, an —$NH_2$ group or an —OH group, in which M is a hydrogen atom, an alkali metal ion or another cation; provided that all of $B_1$, $B_2$, $B_3$, $B_4$ and $B_5$ are not hydrogen atoms at the same time;

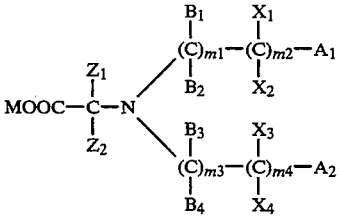

(II)

wherein $B_1$, $B_2$, $B_3$, $B_4$, $X_1$, $X_2$, $X_3$ and $X_4$ are each independently a hydrogen atom, a —$C_nH_{2n+1}$ group or a —$(CH_2)_lY$ group; n and l are each an integer of 1 to 3 and 0 to 3, respectively; Y is a —COOM group, an —$NH_2$ group or a —OH group in which M is a hydrogen ion, an alkali metal ion or another cation, provided that all of $B_1$, $B_2$, $B_3$ and $B_4$ are not hydrogen atoms at the same time, and all of $X_1$, $X_2$, $X_3$ and $X_4$ are not hydrogen atoms at the same time and any number, except 2, of $X_1$, $X_2$, $X_3$ and $X_4$ may be —OH groups at the same time; m1, m2, m3 and m4 are independently an integer of 1 to 3; and $A_1$ and $A_2$ are each a —$COOM_1$ group, a —$COOM_2$ group, an —$NH_2$ group or an —OH group, wherein $M_1$ and $M_2$ are each a hydrogen ion, an alkali metal ion or another cation; and $Z_1$ and $Z_2$ are each a hydrogen atom, a —$COOM_1$ group, a —$COOM_2$ group, an alkyl group having 1 to 3 carbon atoms or an —OH group, wherein $M_1$ and $M_2$ are each a hydrogen ion, an alkali metal ion or another cation;

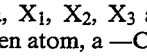

$(R_1)(R_2)N—X_1—(Z—X_2)_n—N(R_3)(R_4)$ (III)

wherein $R_1$, $R_2$ and $R_3$ are each a —$L_1$—$Y_1$ group in which $L_1$ is a substituted or unsubstituted alkylene group having 1 to 3 carbon atoms and $Y_1$ is an —OH group, an —$NH_2$ group or a —COOM group, M is a hydrogen ion, an alkali metal ion or another cation; $R_4$ is a hydrogen atom, a —$CH_3$ group or a —$C_2H_5$ group; n is an integer 0 to 4; Z is an alkylene group, an —O— atom, an —NH— group, an >N—$L_2$—$Y_2$ group or a >CH—$L_3$—$Y_3$ group in which $L_2$ and $L_3$ are each a substituted or unsubstituted alkylene group having 1 to 4 carbon atoms; $Y_2$ and $Y_3$ are each a hydrogen atom, an —OH group, an —$NH_2$ group, a —$COOM_1$ group or a —$COOM_2$ group in which $M_1$ and $M_2$ are each a hydrogen ion, an alkali metal ion or another cation; $X_1$ and $X_2$ are each a substituted or unsubstituted alkylene group having 1 to 6 carbon atoms or a >CH—$L_4$—$Y_4$ group in which $L_4$ is a substituted or unsubstituted alkylene group having 1 to 4 carbon atoms and $Y_4$ is a hydrogen atom, an —OH group, an —$NH_2$ group, a —$COOM_1$ group or a —$COOM_2$ group, $M_1$ and $M_2$ are each a hydrogen ion, an alkali metal ion or another cation; provided that when n=0, $X_1$ is a substituted or unsubstituted alkylene group having 2 to 6 carbon atoms;

$$(R_1)(R_2)N-\underset{\underset{X_1}{\|}}{C}-(R_3) \qquad (VI)$$

wherein $X_1$ is an oxygen atom or a sulfur atom; and $R_1$, $R_2$ and $R_3$ are each a hydrogen atom or a group in which $Z_1$ and $Z_2$ are each a hydrogen atom, a —COOM group, an —OH group or an —$NH_2$ group, m1, m2 and m3 are each an integer of 0 to 2, provided that a least one of the $R_1$, $R_2$ and $R_3$ is and at least one of $Z_1$ and $Z_2$ is a —COOM group, and M is a hydrogen ion, an alkali metal ion or another cation.

10. The method of claim 9, wherein said bleaching solution or bleach-fixing solution contains the ferric complex salt of said compound represented by Formula I, II, III or VI in an amount of 0.1 mol/l to 1.0 mol/l.

11. The method of claim 9, wherein said compound is a compound represented by Formula I or III.

12. The method of claim 11, wherein said compound is a compound represented by Formula I.

13. The method of claim 11, wherein said compound is a compound represented by Formula III.

* * * * *